US006489086B1

(12) United States Patent
Kamosaki et al.

(10) Patent No.: US 6,489,086 B1
(45) Date of Patent: Dec. 3, 2002

(54) SILVER HALIDE COLOR PHOTOGRAPHIC PHOTOSENSITIVE MATERIAL AND METHOD FOR FORMING IMAGE

(75) Inventors: Tetsu Kamosaki, Minami-Ashigara (JP); Keizo Kimura, Minami-Ashigara (JP); Masashi Ogiyama, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/527,918

(22) Filed: Mar. 17, 2000

(30) Foreign Application Priority Data

Mar. 18, 1999 (JP) ..... 11-074525

(51) Int. Cl.[7] ..... G03C 8/40; G03C 1/83

(52) U.S. Cl. ..... 430/350; 430/383; 430/405; 430/510; 430/513; 430/516; 430/517; 430/543; 430/566

(58) Field of Search ..... 430/512, 513, 430/510, 517, 203, 507, 543, 559, 530, 505, 566, 350, 383, 405, 516

(56) References Cited

U.S. PATENT DOCUMENTS 5,756,275 A 5/1998 Takizawa et al.
5,776,664 A 7/1998 Yamashita et al.
6,051,359 A * 4/2000 Ohkawa et al. ..... 430/203
6,066,440 A * 5/2000 Araki et al. ..... 430/354
6,337,177 B1 * 1/2001 Kikuchi ..... 430/506

FOREIGN PATENT DOCUMENTS

EP 0276566 A1 8/1988
EP 0704759 A2 4/1996
EP 0731380 A1 9/1996
EP 0846982 A2 6/1998

OTHER PUBLICATIONS

Patent Abstracts of Japan—Publication No. 01167838A, Publication Date Jul. 3, 1989; vol. 013; No. 438 (Abstract).

* cited by examiner

*Primary Examiner*—Thorl Chea
(74) *Attorney, Agent, or Firm*—Birch, Stewart, Kolasch & Birch, LLP

(57) ABSTRACT

Disclosed are an improved silver halide color photographic photosensitive material comprising a support having thereon a photosensitive layer containing at least one kind of photosensitive silver halide grain, a color developing agent, a coupler and a binder, and a non-photosensitive layer, wherein a one dye is contained as a dispersion of solid fine particles at least one of the layers the dye being represented by general formula (I) as follows:

$$D\text{-}(X)_y \qquad \text{General formula (I)}$$

wherein D represents a compound having a chromophore; X represents a dissociative proton or a group having a dissociative proton which is linked to D directly or via a divalent linking group; and y represents an integer of 1 to 7.

7 Claims, No Drawings

SILVER HALIDE COLOR PHOTOGRAPHIC PHOTOSENSITIVE MATERIAL AND METHOD FOR FORMING IMAGE

BACKGROUND OF THE INVENTION

1. Field of the Invention

The present invention relates to a silver halide color photographic photosensitive material which enables rapid image formation. More specifically, the present invention relates to a silver halide color photographic photosensitive material which produces an image excellent in color separation and sharpness even by simple and rapid developing processing and has excellent storage stability as a product.

2. Description of the Related Art

Despite the advantage that a very fine image can be obtained, a silver halide color photographic photosensitive material is associated with the disadvantage that, since its development is conducted by using a processing solution having a complicated composition, the processing is subject to environmental restrictions and the control of the solution is complicated. In recent years, a dye transfer-type photosensitive material based on heat development, which dispenses with a developing solution and enables a high-quality image to be produced by using a small amount of water and heat, and an image forming apparatus using this type of photosensitive material have been developed and have become commercially available (such as "Pictrography" 2000, 3000 and 4000, and "Pictrostat" 100 and 200 manufactured by Fuji Photo Film Co., Ltd.). Further, silver salt diffusion transfer-type photosensitive materials based on heat development are described in Japanese Patent Application Laid-Open (JP-A) Nos. 62-283,332; 63-198,050 and others. These systems are intended to provide, by simple heat development, print images for visual appreciation. Although heat development systems similar to those described above have been limited to photosensitive materials for the above-mentioned prints, JP-A No. 9-146,247 discloses a method for preparing a recording material for photography by a heat development system. The term "recording material for photography" as used herein means a color negative for photography, an intermediate material for plate making, and the like.

Meanwhile, in silver salt photosensitive materials for use in photography requiring high-quality images, colloidal silver or filter dye has been normally used for the purpose of improvement of color separation and sharpness. In a case where a photosensitive material for heat development is used as a recording material for photography, colloidal silver or filter dye is also necessary.

However, it is difficult to incorporate colloidal silver into a photosensitive material for heat development in which bleaching and fixing treatments are conducted using a small amount of water and processing materials. Furthermore, since colloidal silver becomes the nuclei for fog formation, the colloidal silver needs to be separated from a silver halide emulsion layer. Because of this, the film thickness increases due to the formation of an intermediate layer and the like, thus undesirably diminishing the effect of improvement of sharpness to be brought about.

The filter dye employed in the prior art is a dye which is eluted into a processing solution or decolorized at the time of developing processing. The decolorization of such a filter dye, however, is insufficient when used in photosensitive materials for heat development in which only a small amount of water is used and no developing solution is used.

As a result, the insufficiently decolorized filter dye undesirably remains as an unnecessary density component when image information is read from the photosensitive material after heat development.

Further, in the heat development system which is conducted by supplying a small amount of water to the photosensitive material, if a water-soluble dye is used, the dye is eluted into the small amount of water to thereby contaminate the water. This phenomenon causes a problem that the water cannot be used repeatedly. In order to solve this problem, JP-A No. 6-337,511 discloses an image forming method wherein the photosensitive material contains a water-insoluble organic pigment in a state of a dispersion of solid fine particles so that heat development is conducted in the presence of water. This method is still associated with a problem that the pigment may remain as an unnecessary density component.

In order to solve these problems, JP-A No. 8-101,487 discloses an image forming method wherein a dye in a state of a solid dispersion is used. This method is likely to present a problem that, since part of the dye becomes soluble and is transferred during the storage of the photosensitive material, the reactivity between the coupler and color development agent is reduced.

Furthermore, JP-A No. 9-146,247 discloses a system wherein a color forming substance, composed of a leuco dye and a color developer, is decolorized by an alkali at the time of developing processing. This system, though excellent in decolorizing property, requires use of a large amount of the color developer and alkali to be consumed accordingly and therefore often reduces the reactivity between the coupler and color development agent.

As dyes capable of solving the above-mentioned problems, JP-A Nos. 10-207,030 and 10-207,027 (corresponding to European Patent No. 0846982A2) disclose dyes which are decolorized by simple heat developing processing. However, there is no mention in these documents that the objectives of providing the photosensitive material with both decolorizing property in heat development and of preserving the improvement in color separation and sharpness when a photosensitive material incorporating a color developing agent and a coupler is stored (this preservation is hereinafter referred to as "storage stability before use" upon occasion)are effectively achieved by the incorporation of these dyes as a dispersion of solid fine particles into the photosensitive material.

SUMMARY OF THE INVENTION

It is, accordingly, the object of the present invention to provide a silver halide color photographic photosensitive material incorporating a color developing agent and a coupler, characterized by excellent dye decolorizing property in a simple developing processing and absence of unnecessary remaining color components when image information is read and also by excellent color separation and sharpness even after a period of storage, and to provide an image forming method.

The above-mentioned object has been accomplished by the present invention described below.

According to one aspect of the present invention, there is provided a silver halide color photographic photosensitive material comprising a support having thereon a photosensitive layer containing photosensitive silver halide grains, a color developing agent, a coupler and a binder, and a non-photosensitive layer, wherein a dye is contained as a dispersion of solid fine particles in at least one of the layers, the dye being represented by general formula (I) as follows:

$$D-(X)_y \qquad \text{General formula (I)}$$

wherein D represents a compound having a chromophore; X represents a dissociative proton or a group having a dissociative proton which is linked to D directly or via a divalent linking group; and y represents an integer of 1 to 7.

According to another aspect of the present invention, there is provided a silver halide color photographic photosensitive material, wherein the dye represented by the general formula (I) is a compound represented by a general formulae selected from the group consisting of (I-1) to (I-6):

$$A^1=L^1-(L^2=L^3)_m-Q \qquad \text{General formula (I-1)}$$

$$A^1=N-Q \qquad \text{General formula (I-2)}$$

$$A^1=L^1-(L^2=L^3)_n-A^2 \qquad \text{General formula (I-3)}$$

$$B^1=L^1-(L^2=L^3)_p-B^2 \qquad \text{General formula (I-4)}$$

$$A^1=L^1-(L^2=L^2)_q-B^1 \qquad \text{General formula (I-5)}$$

$$B^2-(L^2=L^3)_r-Q \qquad \text{General formula (I-6)}$$

wherein $A^1$ and $A^2$ each represents an acidic nucleus; $B^1$ represents a basic nucleus; $B^2$ represents an onium form of a basic nucleus; Q represents an aryl or heterocyclic group; $L^1$, $L^2$ and $L^3$ each represents a methine group; m represents an integer selected from the group consisting of 0, 1 and 2; n and q each represents an integer selected from the group consisting of 0, 1, 2 and 3; p represents an integer selected from the group consisting of 0, 1, 2, 3 and 4; and r represents an integer selected from the group consisting of 1 and 2.

According to another aspect of the present invention, there is provided a silver halide color photographic photosensitive material, wherein the dye represented by the general formula (I) is an antihalation dye represented by a general formula selected from the group consisting of (I-7) and (I-8):

General formula (I-7)

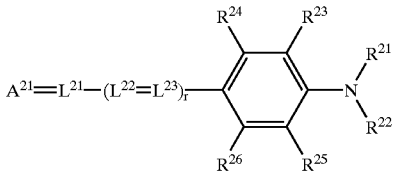

General formula (I-8)

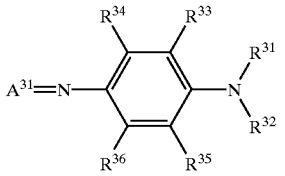

wherein $A^{21}$ and $A^{31}$ each represents an acidic nucleus; $L^{21}$, $L^{22}$ and $L^{23}$ each represents a methine group; $R^{21}$, $R^{22}$, $R^{31}$ and $R^{32}$ each represents an alkyl or aryl group; $R^{23}$, $R^{24}$, $R^{25}$, $R^{26}$, $R^{33}$, $R^{34}$, $R^{35}$ and $R^{36}$ each represents a hydrogen atom or a substituent group; and r represents an integer selected from the group consisting 0, 1 and 2, wherein $R^{23}$ and $R^{24}$, $R^2$ and $R^{23}$, $R^{21}$ and $R^{22}$, $R^{22}$ and $R^{25}$, $R^{25}$ and $R^{26}$, $R^{33}$ and $R^{34}$, $R^{31}$ and $R^{33}$, $R^{31}$ and $R^{32}$, $R^{32}$and $R^{35}$, and $R^{35}$ sand $R^{36}$ are joinable for forming a ring.

According to another aspect of the present invention, there is provided a silver halide color photographic photosensitive material, wherein the photosensitive layer and the non-photosensitive layer have a combined thickness of at least 15 $\mu$m.

According to another aspect of the present invention, there is provided a silver halide color photographic photosensitive material, wherein at least one of the layers contains a basic metal compound poorly soluble in water.

According to another aspect of the present invention, there is provided a method of forming an image comprising the steps of:

(a) disposing on a support a photosensitive layer containing photosensitive silver halide grains, a color developing agent, a coupler and a binder;

(b) further disposing on the support a non-photosensitive layer;

(c) providing a dye as a dispersion of solid fine particles in at least of the layers;

(d) providing a basic metal compound poorly soluble in water in at least of the layers;

(e) providing a processing material having processing layer containing a compound capable of performing a complex forming reaction with a metal ion resulting from said basic metal compound;

(f) placing the processing material together with the photosensitive layer thereon facing the processing layer;

(g) swelling the layers by adding water, wherein the amount of water ranges from the minimum amount required for maximum swelling, excluding layers that function only as backing, to 1/10 of said minimum; and (h) heating from 1 to 120 seconds to achieve a temperature ranging from 50 to 100 degrees C. in the photosensitive layer and processing layer.

In a photosensitive material, such as the silver halide color photographic photosensitive material (hereinafter referred to simply as "photosensitive material" upon occasion), suited for use as a recording material for photography, the silver halide emulsion layer as a photosensitive layer and other layers are generally and often colored in order to allow these layers to absorb light of a specific wavelength range.

When it is required to control the spectral composition of the light incident on a photographic emulsion layer, it is a common practice to form a colored layer on the far side from the support relative to the silver halide emulsion layer. Such a colored layer is called filter layer. If a plurality of silver halide emulsion layers exist, the filter layer may be positioned between these emulsion layers.

In order to prevent image fogging or halation, which is based on that the rays of light, in the process of passing through the silver halide emulsion layer (hereinafter referred to simply as "emulsion layer" upon occasion) or scattered-after passing through the emulsion layer, are reflected by the interface between the emulsion layer and the support or by the surface of the photosensitive material opposite to the emulsion side so that these rays of light fall again on the silver halide layer, a colored layer called antihalation layer is formed between the silver halide emulsion layer and the support or on the surface of the support on the side opposite to the silver halide emulsion layer. If a plurality of silver halide emulsion layers exist, the antihalation layer may be positioned between these layers.

In order to prevent the degradation of image sharpness, which is based on the scattering of rays of light in the silver halide emulsion layer (this phenomenon is generally called "irradiation"), the emulsion layer may also be colored.

Normally, a dye is incorporated into these layers to be colored and the dye to be incorporated for this purpose needs to meet the following requirements.

(1) The dye should exhibit proper spectral absorption in accordance with the purpose of use.

(2) The dye should be inert in terms of photographic chemistry.

That is, the dye should not exert any chemically adverse influence, such as reduction in sensitivity, latent image regression or fogging, on the performance of the silver halide emulsion layer.

(3) The dye should be decolorized in the heat development process and should not leave any unnecessary coloration after the heat developing processing.

(4) The dye should not be diffused from the colored layer to other layer.

(5) The dye should be stable with the passage of time within a photosensitive material or in a solution and should not change color or fade.

It has been found that the dye represented by the general formula (I) is effective as a dye that meets the above-mentioned requirements.

In the present invention, it is more effective that the photosensitive layer and the non-photosensitive layer formed on the support have a total thickness of at least 15 $\mu$m (upper limit being preferably 30 $\mu$m) from the standpoint of use for a recording material for photography whose thickness is relatively larger than that of a material for color print.

DETAILED DESCRIPTION OF THE INVENTION

Details of the present invention are described below.

First, the details of the dyes featuring the present invention and represented by the general formula (I) are given below.

A compound having a chromophore represented by D in the general formula (I) can be selected from many of known dye compounds. Examples of the compound include oxonol dyes, merocyanine dyes, cyanine dyes, styryl dyes, arylidene dyes, azomethine dyes, triphenylmethane dyes, azo dyes, anthraquinone dyes, indoaniline dyes, and so on.

The group, which is represented by X and is a dissociative proton or a group having a dissociative proton, is non-dissociative in the condition where the compound represented by the general formula (I) is incorporated in the silver halide photographic photosensitive material to thereby render the compound represented by the general formula (I) substantially water-insoluble, but is dissociative in the process where the silver halide photographic photosensitive material is developed to thereby render the compound represented by the general formula (I) substantially water-soluble. Examples of the group represented by X include carboxyl groups, sulfonamide groups, unsubstituted sulfamoyl groups, alkylsulfamoyl groups, arylsulfamoyl groups, sulfonylcarbamoyl groups, carbonylsulfamoyl groups, enol groups of oxonol dyes, phenolic hydroxyl groups, and so on.

The divalent linking group between X and D is an alkylene group, an arylene group, a heterocyclic group residue, —CO—, —$SO_n$— (where n is 0, 1 or 2), —NR— (where R is a hydrogen atom, an alkyl group or an aryl group), —O—, or a divalent group composed of a combination of these linking groups. These groups may further have substituent groups such as an alkyl group, an aryl group, an alkoxy group, an amino group, an acyl group, an acylamino group, a halogen atom, a hydroxyl group, a carboxyl group, a sulfamoyl group, a carbamoyl group, a sulfonamide group, and the like. Preferred examples include —$(CH_2—)_n$— (where n is 1, 2or 3), —$CH_2CH(CH_3)CH_2$—, 1,2-phenylene, 5-carboxy-1,3-phenylene, 1,4-phenylene, 6-methoxy-1,3-phenylene, —$CONHC_6H_4$—, and the like.

y is preferably an integer of 1 to 5, and more preferably an integer of 1 to 3.

Among the compounds represented by the general formula (I), more preferred are compounds represented by a general formulae selected from the group consisting of (I-1) to (I-6).

$A^1=L^1-(L^2=L^3)_m-Q$ General formula (I-1)

$A^1=N-Q$ General formula (I-2)

$A^1=L^1-(L^2=L^3)_n-A^2$ General formula (I-3)

$B^1=L^1-(L^2=L^3)_p-B^2$ General formula (I-4)

$A^1=L^1-(L^2=L^2)_q-B^1$ General formula (I-5)

$B^2-(L^2=L^3)_r-Q$ General formula (I-6)

wherein $A^1$ and $A^2$ each represents an acidic nucleus; $B^1$ represents a basic nucleus; $B^2$ represents an onium form of a basic nucleus; Q represents an aryl or heterocyclic group; $L^1$, $L^2$ and $L^3$ each represents a methine group; m represents an integer selected from the group consisting of 0, 1 and 2; n and q each represents an integer selected from the group consisting of 0, 1, 2 and 3; p represents an integer selected from the group consisting of 0, 1, 2, 3 and 4; and r represents an integer selected from the group consisting of 1 and 2, with the proviso that the compound represented by any one of the formulae (I-1) to (I-6) has in the molecule at least one dissociative group selected from the group consisting of carboxyl groups, sulfonamide groups, arylsulfamoyl groups, sulfonylcarbamoyl groups, carbonylsulfamoyl groups, enol groups of oxonol dyes and phenolic hydroxyl groups and does not have other water-soluble group (e.g., sulfo group, phosphate group, and the like).

The acidic nucleus represented by $A^1$ or $A^2$is preferably a cyclic ketomethylene compound or a compound having a methylene group sandwiched between electron-attractive groups.

Examples of the cyclic ketomethylene compound include 2-pyrazoline-5-one, rhodanine, hydantoin, thiohydantoin, 2,4-oxazoline-dione, iso-oxazoline, barubituric acid, thiobarubituric acid, indandione, dioxopyrazolopyridine, hydroxypyridine, pyrazolidine-dione, 2,5-dihydrofuran-2-one, pyrroline-2-one, and so on. These compounds may each have a substituent group.

Examples of the compound having a methylene group sandwiched between electron-attractive groups can be represented by $Z^1CH_2Z^2$ where $Z^1$ and $Z^2$ each represents —CN, —$SO_2R^1$, —$COR^1$, —$COOR^2$, —$CONR^1R^2$, —$SO_2R^1R^2$, or —$C[=C(CN)_2]R^1$, or —$C[=C(CN)_2]NHR^1$. $R^1$ represents an alkyl group, an aryl group or a heterocyclic group, and $R^2$ represents a hydrogen atom or the same group as $R^1$. $R^1$ and $R^2$ may each have a substituent group.

Examples of the basic nucleus represented by $B^1$ include pyridine, quinoline, indolenine, oxazole, imidazole, thiazole, benzoxazole, benzimidazole, benzothiazole, oxazoline, naphthoxazole, pyrrole, and so on. These compounds may each have a substituent group.

$B^2$ is an onium form of a basic nucleus and examples of the onium form include the onium forms illustrative of $B^1$.

Examples of the aryl group represented by Q include phenyl groups and naphthyl groups. These groups may each have a substituent group (preferably an electron-donative group). The most preferred are phenyl groups substituted by an alkyl group, a dialkylamino group, a hydroxyl group, and/or an alkoxy group.

Examples of the heterocyclic groups represented by Q include pyrrole, indole, furan, thiophene, imidazole, pyrazole, indolidine, quinone, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and coumarone. These may each have a substituent group.

The methine groups represented by $L^1$, $L^2$ and $L^3$ may each have a substituent group. These substituent groups may join together to form a 5- or 6-membered ring (e.g., cyclopentene, cyclohexene and the like).

The substituent groups which may be borne by the above-mentioned groups are not particularly limited unless these substituent groups allow the compound represented by any one of the formulae (I-1) to (I-6) to substantially dissolve in water having a pH value of 5 to 7. Examples of the substituent groups include a carboxyl group, a sulfonamide group having 1 to 10 carbon atoms (e.g., a methanesulfonamide, benzenesulfonamide, butanesulfonamide, or n-octanesulfonamide group), a sulfamoyl group having 0 to 10 carbon atoms (e.g., an unsubstituted sulfamoyl, methylsulfamoyl, phenylsulfamoyl, or butylsulfamoyl group), a sulfonylcarbamoyl group having 2 to 10 carbon atoms (e.g., a methanesulfonylcarbamoyl, propanesulfonylcarbamoyl, or benzenesulfonylcarbamoyl group), an acylsulfamoyl group having 1 to 10 carbon atoms (e.g., an acetylsulfamoyl, propionylsulfamoyl, pivaloylsulfamoyl, or benzoylsulfamoyl group), a straight-chain or cyclic alkyl group having 1 to 8carbonatoms (e.g., a methyl, ethyl, isopropyl, butyl, hexyl, cyclopropyl, cyclohexyl, 2-hydroxyethyl, 4-carboxybutyl, 2-methoxyethyl, benzyl, phenethyl, 4-carboxybenzyl, or 2-diethylaminoethyl group), an alkenyl group having 2 to 8 carbon atoms (e.g., a vinyl or allyl group), an alkoxy group having 1 to 8 carbon atoms (e.g., a methoxy, ethoxy, or butoxy group), a halogen atom (e.g., F, Cl, or Br atom), an amino group having 0 to 10 carbon atoms (e.g., an unsubstituted amino, dimethylamino, diethylamino, or carboxyethylamino group), an ester group having 2 to 10 carbon atoms (e.g., a methoxycarbonyl group), an amide group having 1 to 10 carbon atoms (e.g., an acetamide or benzamide group), a carbamoyl group having 1 to 10 carbon atoms (e.g., an unsubstituted carbamoyl, methylcarbamoyl, or ethylcarbamoyl group), an aryl group having 6 to 10 carbon atoms (e.g., a phenyl, naphthyl, 4-carboxylphenyl, 3-carboxyphenyl, 3,5-dicarboxyphenyl, 4-methanesulfonamidephenyl, or 4-butanesulfonamidephenyl group), an aryloxy group having 6 to 10 carbon atoms (e.g., a phenoxy, 4-carboxylphenoxy, 3-methylphenoxy, or naphthoxy group), an alkylthio group having 1 to 8 carbon atoms (e.g., a methylthio, ethylthio, octylthio group), an arylthio group having 6 to 10 carbon atoms (e.g., a phenylthio or naphthylthio group), an acyl group having 1 to 10 carbon atoms (e.g., an acetyl, benzoyl, or propanoyl group), a sulfonyl group having 1 to 10 carbon atoms (e.g., a methanesulfonyl or benzenesulfonyl group), a ureido group having 1 to 10 carbon atoms (e.g., a ureido or methylureido group), a urethane group having 2 to 10 carbon atoms (e.g., a methoxycaronylamino or ethoxycarbonylamino group), a cyano group, a hydroxyl group, a nitro group, a heterocyclic group (e.g., a 5-carboxybenzoxazole, pyridine, sulfolane, furan, pyrrole, pyrrolidine, morpholine, piperazine, or pyrimidine ring).

The antihalation layer may contain dyes represented by the general formula (I) and having various hues in accordance with wavelengths of light for exposure. Among these compounds, preferred is the compound represented by any one of the formulae (I-1) to (I-6), more preferred is the compound represented by the formula (I-1), (I-2), (I-3) or (I-4), and the most preferred is the compound represented by the formula (I-1) or (I-2). The compound represented by the general formula (I-1) is generally called arylidene dye while the compound represented by the general formula (I-2) is generally called azomethine dye. In addition, if the dye represented by the general formula (I-1) is an antihalation dye, the dye is preferably a compound represented by a general formula selected from the group consisting of(I-7) and (I-8).

General formula (I-7)

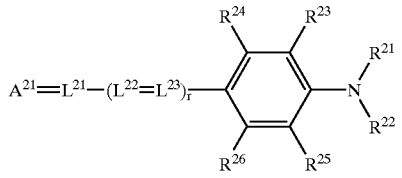

General formula (I-8)

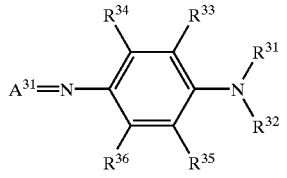

wherein $A^{21}$ and $A^{31}$ each represents an acidic nucleus; $L^{21}$, $L^{22}$ and $L^{23}$ each represents a methine group; $R^{21}$, $R^{22}$, $R^{31}$ and $R^{32}$ each represents an alkyl or aryl group; $R^{23}$, $R^{24}$, $R^{25}$, $R^{26}$, $R^{33}$, $R^{34}$ $R^{35}$ and $R^{36}$ each represents a hydrogen atom or a substituent group; and r represents an integer selected from the group consisting 0, 1 and 2, wherein $R^{23}$and $R^{24}$, $R^{21}$ and $R^{23}$, $R^{21}$and $R^{22}$, $R^{22}$ and $R^{25}$ $R^{25}$ and $R^{26}$ $R^{33}$ and $R^{34}$, $R^{31}$and $R^{33}$, $R^{31}$ and $R^{32}$, $R^{32}$ and $R^{35}$, and $R^{35}$ and $R^{35}$ are joinable for forming a ring.

The general formulae (I-7) and (I-8) are explained in detail below. $A^{21}$ and $A^{31}$ each represent an acidic nucleus and are the same as $A^1$ in the general formula (I-1). Preferably, $A^{21}$ and $A^{31}$ are each 2-pyrazoline-5-one, isooxazoline, hydroxypyridine, pyrazolidine-dione, or barubituric acid. More preferably, $A^{21}$ and $A^{31}$are each hydroxypyridine or barubituric acid. Most preferably, $A^{21}$ and $A^{31}$ are each hydroxypyridine.

In the general formulae (I-7) and (I-8), $L^{21}$, $L^{22}$ and $L^{23}$ each represent a methine group like $L^1$, $L^2$and $L^3$ in the general formula (I-1). Preferably, the methine group represented by $L^{21}$, $L^{22}$ or $L^{23}$ is represented by $=CR^{27}-$ (where $R^{27}$ is an alkyl group having 1 to 10 carbon atoms or a hydrogen atom). As to the combination of $L^{21}$, $L^{22}$ and $L^{23}$, preferably $R^{27}$is a hydrogen atom in all of $L^{21}$, $L^{22}$ and $L^{23}$, or alternatively, $R^{27}$ is a hydrogen atom in $L^{21}$and $L^{23}$ while $R^{27}$ in $L^{22}$is a methyl group. Most preferably, $R^{27}$ is a hydrogen atom in $L^{21}$, $L^{22}$ and $L^{23}$.

In the general formulae (I-7) and (I-8), $R^{21}$, $R^{22}$, $R^{31}$ and $R^{32}$ each represents an alkyl or aryl group which may be substituted by an alkyl group, an alkenyl group, an alkynyl group, an aryl group, a hydroxyl group, a nitro group, a cyano group, a halogen atom, or a substituent group composed of an oxygen, nitrogen, sulfur or carbon atom, with the proviso that the carbon atoms of $R^{21}$, $R^{22}$, $R^{31}$ and $R^{32}$, which carbon atoms are directly linked to the nitrogen atom in the general formulae (I-7) and (I-8), preferably have no elements other than two elements, namely hydrogen or carbon, if $R^{21}$, $R^{22}$, $R^{31}$ and $R^{32}$ are each an alkyl group. The alkyl group is a straight-chain, branched, or cyclic alkyl group having 1 to 15 carbon atoms, preferably 1 to 5 carbon atoms, e. g., a methyl, ethyl, propyl, isopropyl, butyl, isobutyl, t-butyl, 2-methanesulfonamidoethyl, 2-hydroxylethyl, cyclopentyl, carboxymethyl, 2-carboxyethyl, 2,3-dicarboxypropryl, 3-methanesufonylcarbamoylpropyl, 2-acetamideethyl, 2-carbamoylethyl, or 2-carbamoylamioethyl group.

The aryl group is an aryl group having 6 to 24 carbon atoms, preferably 6 to 12 carbon atoms, e.g., a phenyl, naphthyl, 4-carboxyphenyl, 3-carboxyphenyl, 2-carboxyphenyl, or 3,5-dicarboxyphenyl group.

Preferably, $R^{21}$, $R^{22}$, $R^{31}$ and $R^{32}$ are each an alkyl group. More specifically, $R^{21}$, $R^{22}$, $R^{31}$ and $R^{32}$ are each a methyl, ethyl, propyl, isopropyl, 2-methanesulfonamidoethyl, 2-hydroxylethyl, phenyl, carboxymethyl, 2-carboxyethyl, 2,3-dicarboxypropryl, 3-methanesufonylcarbamoylpropyl, or 2-carbamoylamioethyl group. More preferably, $R^{21}$, $R^{22}$, $R^{31}$ land $R^{32}$ are each a methyl, ethyl, propyl, carboxymethyl, 2-carboxyethyl, or 2,3-dicarboxypropryl group.

$R^{23}$, $R^{24}$, $R^{25}$, $R^{26}$, $R^{33}$ $R^{34}$, $R^{35}$ and $R^{36}$ each represents a hydrogen atom or a substituent group. Examples of the substituent group include a halogen atom, an alkyl group, an aryl group, a heterocyclic group, a cyano group, a nitro group, a hydroxyl group, a carboxyl group, a sulfo group, an alkoxy group, an aryloxy group, an acylamino group, an amino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocycloxy group, an azo group, an acyloxy group, a carbamoyloxy group, a silyl group, a silyloxy group, an aryloxycarbonylamino group, an imido group, a heterocyclothio group, a sulfinyl group, aphosphonyl group, an aryloxycarbonyl group, and an acyl group. These groups may be substituted by an alkyl group, an alkenyl group, an alkynyl group, an aryl group, a hydroxyl group, a nitro group, a cyano group, a halogen atom, or a substituent group composed of an oxygen, nitrogen, sulfur or carbon atom.

More specific examples of the substituent groups of $R^{23}$, $R^{24}$, $R^{25}$, $R^{26}$, $R^{33}$, $R^{34}$, $R^{35}$ and $R^{36}$ are given below. Examples of the halogen atom include a fluorine atom, a chlorine atom, and so on. Examples of the alkyl group and the aryl group are the same as those listed for the explanation of $R^{21}$, $R^{22}$, $R^{31}$ and $R^{32}$. Examples of the heterocyclic group are the same as those listed for the explanation of the substituent groups which may be borne by the compounds represented by the formulae (I-1) to (I-6).

The alkoxy group is an alkoxy group having 1 to 16 carbon atoms, preferably 1 to 3 carbon atoms, e.g. , a methoxy, ethoxy, 2-methoxyethoxy, or 2-methansulfonylethoxy group. The aryloxy group is an aryloxy group having 6 to 24 carbon atoms, preferably 6 to 8 carbon atoms, e.g., a phenoxy, p-methoxyphenoxy, or m-(3-hydroxypropionamide)phenoxy group. The acylamino group is an acylamino group having 1 to 16 carbon atoms, preferably 1 to 6 carbon atoms, e.g., an acetamide, 2-methoxypropionamide, or p-nitrobenzoylamide group.

The alkylamino group is an alkylamino group having 1 to 16 carbon atoms, preferably 1 to 4 carbon atoms, e.g., dimethylamino, diethylamino, or 2-hydroxyethylamino group. The anilino group is an anilino group having 6 to 24 carbon atoms, e.g., an m-nitroanilino or N-methylanilino group. The ureido group is a ureido group having 1 to 16 carbon atoms, preferably 1 to 6 carbon atoms, e.g., a ureido, methylureido, N,N-diethylureido, or 2-methanesulfonamidoethylureido group.

The sulfamoylamino groups is a sulfamoylamino group having 0 to 16 carbon atoms, preferably 0 to 3 carbon atoms, e.g., a dimethylsulfamoylamino, methylsulfamonylamino, or 2-methoxylethylsulfamoylamino group. The alkylthio group is an alkylthio group having 1 to 16 carbon atoms, preferably 1 to 3 carbon atoms, e.g., a methylthio, ethylthio, 2-phenoxyethylthio group. The arylthio group is an arylthio group having 6 to 22 carbon atoms, preferably 6 to 8 carbon atoms, e.g., a phenylthio, 2-carboxyphenylthio, or 4-cyanophenylthio group. The alkoxycarbonylamino group is an alkoxycarbonylamino group having 2 to 16 carbon atoms, preferably 2 to 6 carbon atoms, e.g., a methoxycarbonylamino, ethoxycarbonylamino, 3-methanesulfonylpropoxycarbonylamino group.

The sulfonamide group is a sulfonamide group having 1 to 16 carbon atoms, preferably 1 to 6 carbon atoms, e.g., a methanesulfonamide, p-toluenesulfonamide, or 2-methoxyethanesulfonamide group. The carbamoyl group is a carbamoyl group having 1 to 16 carbon atoms, preferably 1 to 6 carbon atoms, e.g., a carbamoyl, N,N-dimethylcarbamoyl, or N-ethylcarbamoyl group. The sulfamoyl groups is a sulfamoyl group having 0 to 16 carbon atoms, preferably 0 to 6 carbon atoms, e.g., a sulfamoyl, dimethylsulfamony, or ethylsulfamoyl group.

The sulfonyl group is an aliphatic or aromatic sulfonyl group having 1 to 16 carbon atoms, preferably 1 to 6 carbon atoms, e.g., a methanesulfonyl, ethanesulfonyl, or 2-chloroethanesulfonyl group. The alkoxycarbonyl group is an alkoxycarbonyl group having 1 to 16 carbon atoms, preferably 1 to 3 carbon atoms, e.g., a methoxycarbonyl, ethoxycarbonyl, or t-butoxycarbonyl group. The heterocycloxy group is a 5- or 6-membered, saturated or unsaturated heterocycloxy group having 1 to 5 carbon atoms and at least one oxygen, nitrogen or sulfur atom, wherein the number of the heteroatom and the kind of the element constituting the ring may be one or more, e.g., a 1-phenyltetrazolyl-5-oxy, 2-tetrahydropyranyloxy, or 2-pyridyloxy group.

The azo group is an azo group having 1 to 16 carbon atoms, preferably 1 to 6 carbon atoms, e.g., a phenylazo, 2-hydroxy-4-propanoylphenylazo, 4-sulfophenylazo group. The acyloxy group is an acyloxy group having 1 to 16 carbon atoms, preferably 1 to 6 carbon atoms, e.g., an acetoxy, benzoyloxy, or 4-hydroxybutanoyloxy group. The carbamoyloxy group is a carbamoyloxy group having 1 to 16 carbon atoms, preferably 1 to 6 carbon atoms, e.g., an N,N-dimethylcarbamoyloxy, N-methylcarbamoyloxy, or N-phenylcarbamoyloxy group.

The silyl group is a silyl group having 3 to 16 carbon atoms, preferably 3 to 6 carbon atoms, e.g., a trimethylsilyl, isopropyldiethylsilyl, or t-butyldimethylsilyl group. The silyloxy group is a silyloxy group having 3 to 16 carbon atoms, preferably 3 to 6 carbon atoms, e.g., a trimethylsilyloxy, triethylsilyloxy, or diisopropylethylsilyloxy group. The aryloxycarbonylamino group is an aryloxycarbonylamino group having 7 to 24 carbon atoms, preferably 7 to 11 carbon atoms, e.g., a phenoxycarbonylamino, 4-cyanophenoxycarbonylamino, or 2,6-dimethoxyphenoxycarbonylamino group.

The imido group is an imido group having 4 to 16 carbon atoms, preferably 4 to 8 carbon atoms, e.g., an N-succinimido or N-phthalimide group. The heterocyclothio group is a 5-or 6-membered, saturated or unsaturated heterocyclothio group having 1 to 5 carbon atoms and at least one oxygen, nitrogen or sulfur atom, wherein the number of the heteroatom and the kind of the element constituting the ring may be one or more, e.g., a 2-benzothiazolylthio or 2-pyridylthio group.

The sulfinyl group is a sulfinyl group having 1 to 16 carbon atoms, preferably 1 to 6 carbon atoms, e.g., a methanesulfinyl, benzenesulfinyl, or ethanesulfinyl group. The phosphonyl group is a phosphonyl group having 2 to 16 carbon atoms, preferably 2 to 6 carbon atoms, e.g., a methoxyphosphonyl, ethoxyphosphonyl, or phenoxyphosphonyl group. The aryloxycarbonyl group is an aryloxycarbonyloxy group group having 7 to 24 carbon atoms, preferably 7 to 11 carbon atoms, e.g., a phenoxycarbonyl, 2-methylphenoxycarbonyl, or 4-acetamidophenoxycarbonyl group. The acyl group is an acyl group having 1 to 16 carbon atoms, preferably 1 to 6 carbon atoms, e.g., an acetyl, benzoyl, or 4-chlorobenzoyl group.

Preferred examples of $R^{23}$, $R^{24}$, $R^{25}$, $R^{26}$, $R^{33}$, $R^{34}$, $R^{35}$ and $R^{36}$ include a hydrogen atom, an alkyl group, an aryl group, an alkoxy group, an acylamino group, a ureido group, a sulfamoylamino group, a sulfonylamino group, a carbamoyl group, and a sulfamoyl group. More preferably, $R^{23}$, $R^{24}$, $R^{25}$ $R^{26}$, $R^{33}$, $R^{34}$, $R^{35}$ and $R^{36}$ are each a hydrogen atom, an alkyl group, an alkoxy group, a carbamoyl group, a sulfamoyl group, or a ureido group, and most preferably a hydrogen atom, an alkyl group, or an alkoxy group.

Specifically, preferred examples of $R^{23}$, $R^{24}$, $R^{25}$, $R^{26}$, $R^{33}$, $R^{34}$, $R^{35}$ and $R^{36}$ include a hydrogen atom, methyl, ethyl, n-propyl, i-propyl, n-butyl, t-butyl, t-pentyl, di-t-octyl, hydroxymethyl, 1,3-dihydroxy-2-propyl, phenyl, m-hydroxyphenyl, methoxy, ethoxy, i-propoxy, 2-hydroxyethoxy, 2-methanesulfonylethoxy, acetamide, 2-methoxypropionamide, p-hydroxybenzoylamide, ureido, methylureido, N,N-dimethylureido, 2-methanesulfonamideethylureido, dimethylsulfamoylamino, methylsulfamoylamino, 2-methoxyethylsulfamoylamino, methanesulfonamide, p-toluenesulfonamide, 2-methoxyethanesulfoneamide, carbamoyl, N,N-dimethylcarbamoyl, N-ethylcarbamoyl, sulfamoyl, dimethylsulfamoyl, and ethylsulfamoyl groups. $R^{23}$, $R^{24}$, $R^{25}$, $R^{26}$, $R^{33}$, $R^{34}$, $R^{35}$ and $R^{36}$ are more preferably a hydrogen atom, methyl, ethyl, n-propyl, i-propyl, t-butyl, methoxy, i-propoxy, acetamide, methylureido, N,N-dimethylureido, dimethylsulfamoylamino, methylsulfamoylamino, methanesulfonamide, carbamoyl, N,N-dimethylcarbamoyl, N-ethylcarbamoyl, sulfamoyl, and dimethylsulfamoyl groups, and most preferably a hydrogen atom, methyl, ethyl, i-propyl, methoxy, and i-propoxy groups.

Further, $R^{23}$ and $R^{24}$, $R^{21}$ and $R^{23}$, $R^{21}$ and $R^{22}$, $R^{22}$ and $R^{25}$, $R^{25}$ and $R^{26}$, $R^{33}$ and $R^{34}$, $R^{31}$ and $R^{33}$, $R^{31}$ and $R^{32}$, $R^{32}$ and $R^{35}$, and $R^{35}$ and $R^{36}$ may each join together to form a ring. Furthermore, any one of $R^{24}$ and $R^{22}$ may form a ring together with $L^{21}$ or $L^{23}$. In particular, it is preferable that any one of $R^{21}$ and $R^{23}$, $R^{22}$ and $R^{25}$, $R^{31}$ and $R^{33}$, $R^{32}$and $R^{35}$ and $R^{24}$ and $R^{26}$ joins with $L^{21}$ or L23 to form a substituted or unsubstituted ethylene or trimethylene chain. In this case, the substituent groups are the same as those listed for the explanation of $R^{23}$, $R^{24}$, $R^{25}$, $R^{26}$, $R^{33}$, $R^{34}$, $R^{35}$and $R^{36}$. Preferred examples of the substituent group include a hydroxy group, a halogen atom, an alkyl group, an alkoxy group, a carboxyl group, an acylamino group, an alkylamino group, a ureido group, a sulfamoylamino group, an alkoxycarbonylamino group, a sulfonylamino group, a carbamoyl group, a sulfamoyl group, a sulfonyl group, an alkoxycarbonyl group, an acyloxy group, a carbamoyloxy group, an acyl group, and so on. The substituent groups are more preferably a hydroxy group, an alkyl group, a carboxyl group, an acylamino group, a ureido group, an alkoxycarbonylamino group, a sulfonylamino group, a carbamoyl group, an acyloxy group, and a carbamoyloxy group, and most preferably a hydroxy group, an alkyl group, and a carboxyl group.

Specific examples of the dyes represented by the general formula (I) are given below. It should be understood that the present invention is not limited to these examples.

F-1

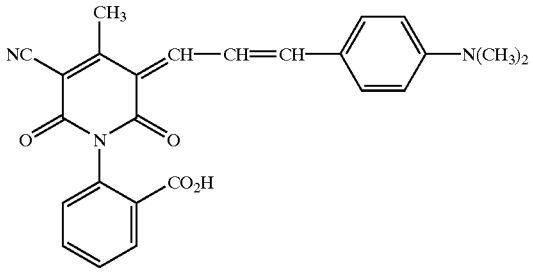

F-2

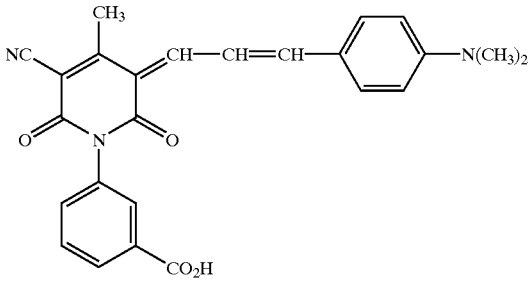

F-3

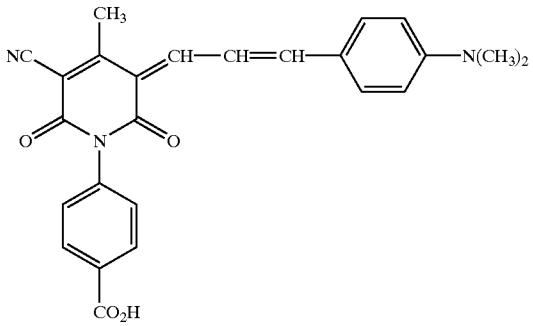

F-4

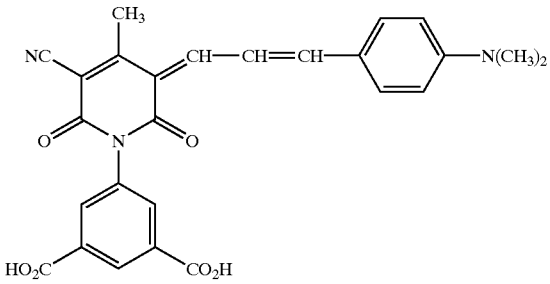

-continued
F-5
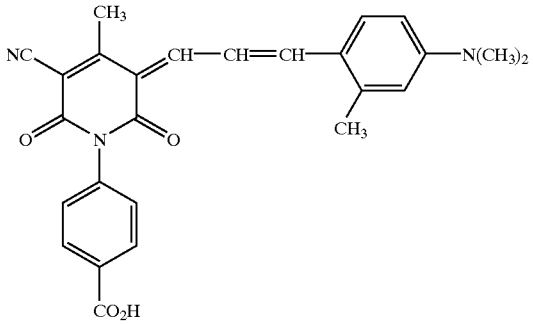
F-6
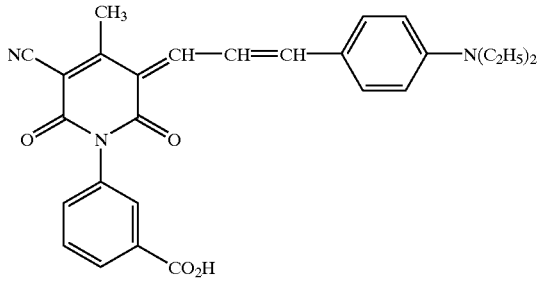
F-7
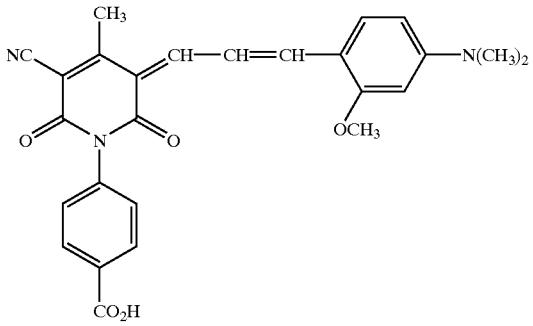
F-8
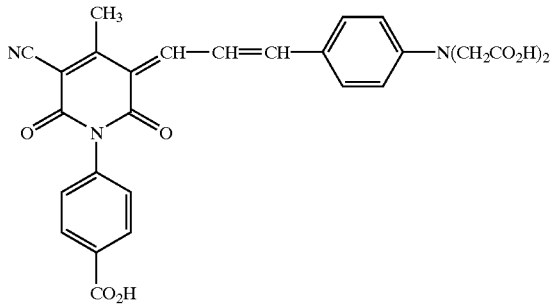
F-9
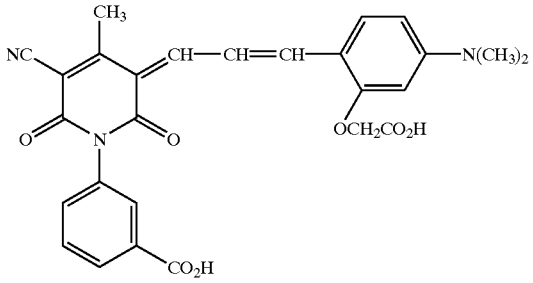
F-10
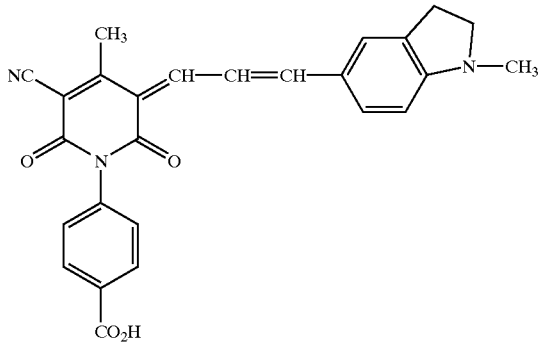
F-11
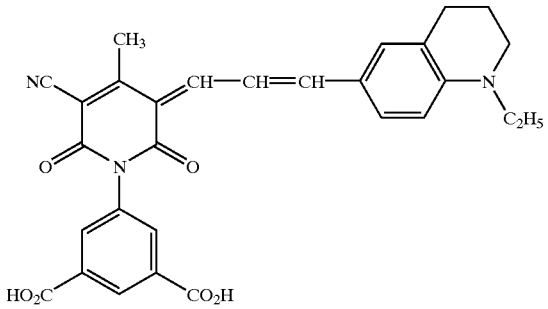
F-12
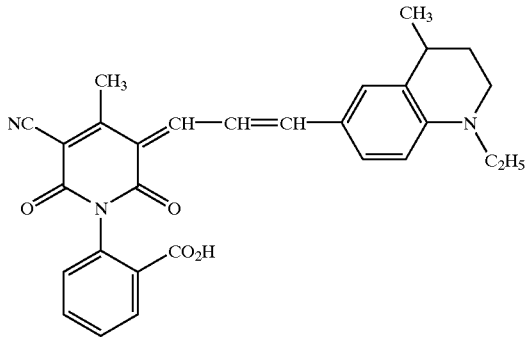

-continued
F-13
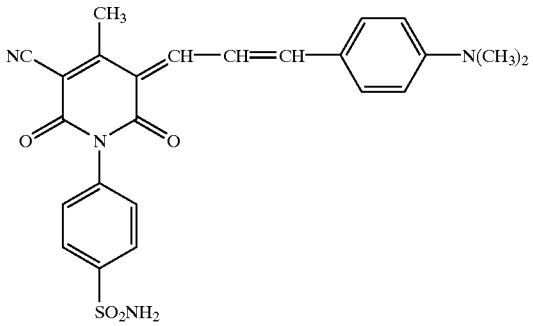
F-14
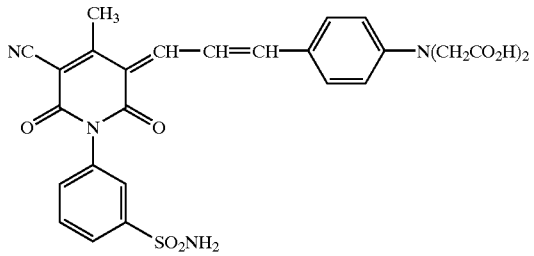
F-15
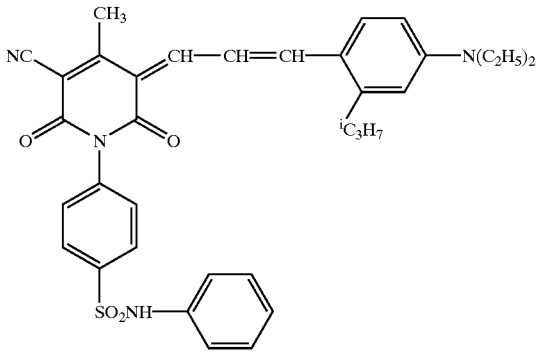
F-16
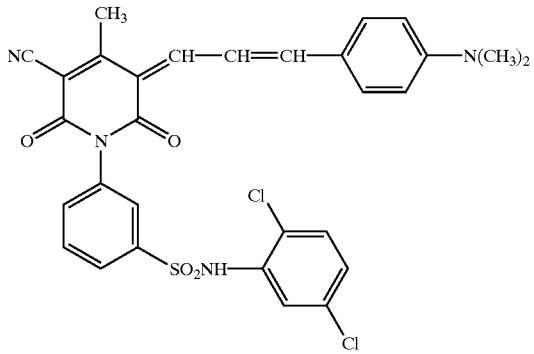
F-17
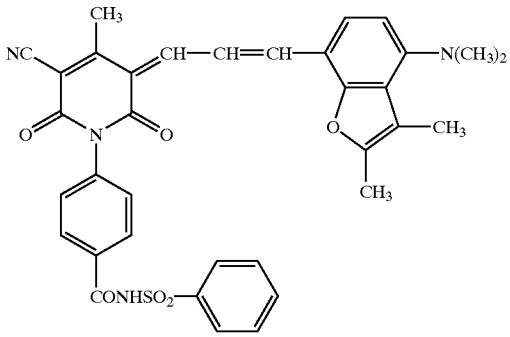
F-18
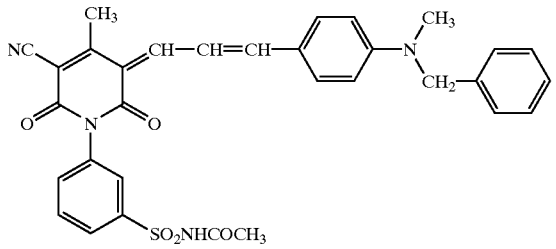
F-19
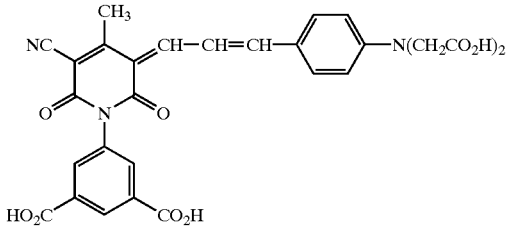
F-20
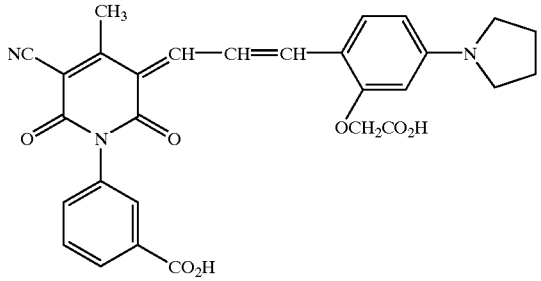

-continued
F-21
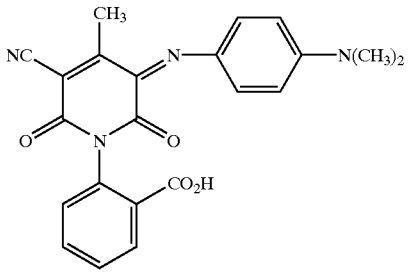
F-22
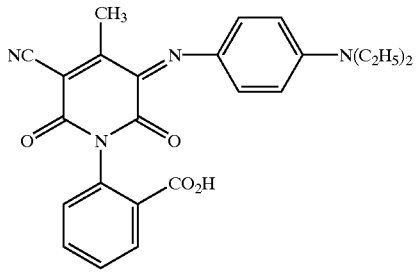
F-23
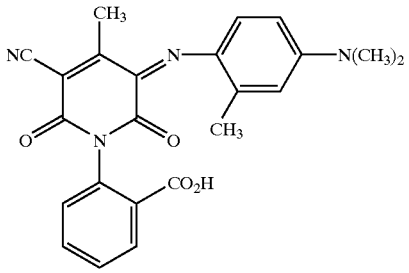
F-24
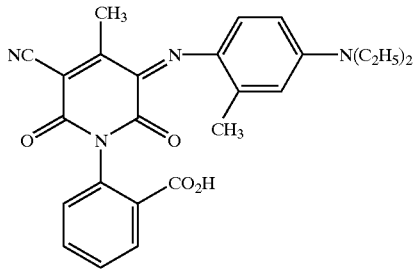
F-25
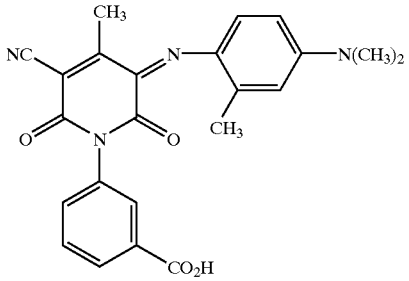
F-26
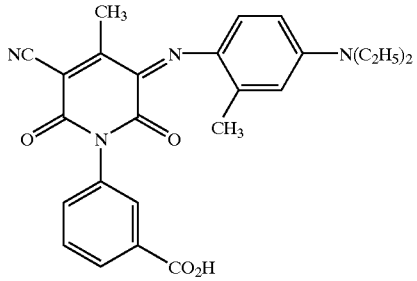
F-27
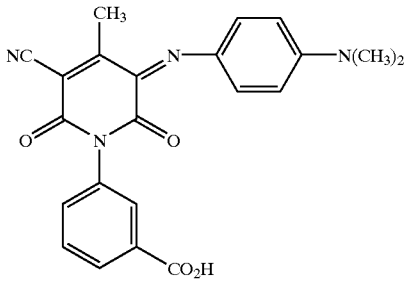
F-28
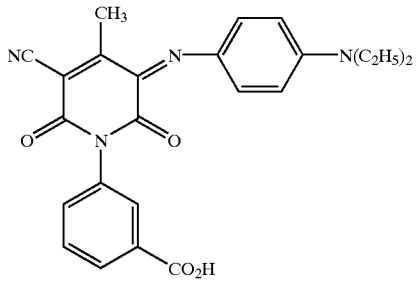
F-29
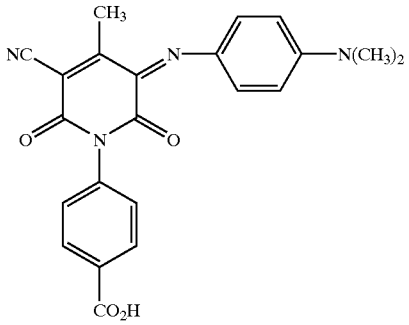
F-30
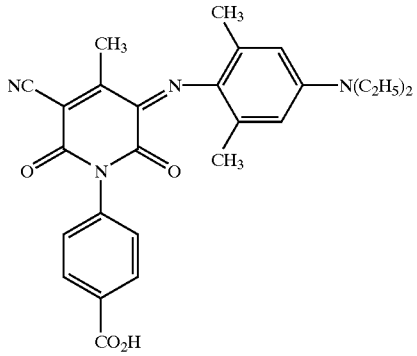

-continued
F-31
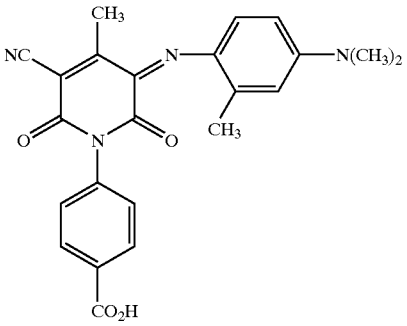
F-32
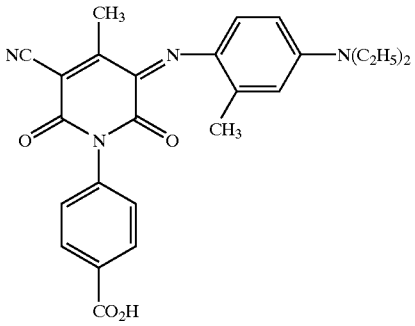
F-33
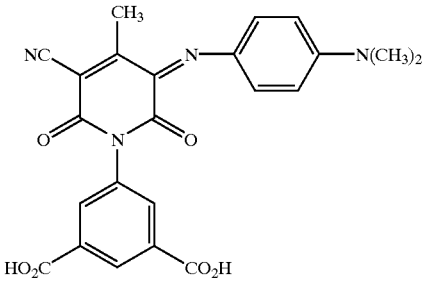
F-34
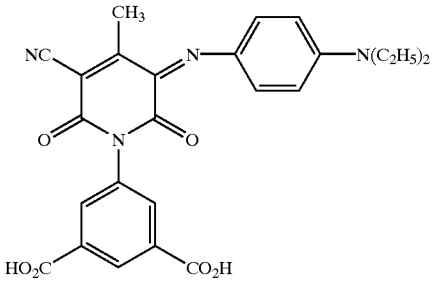
F-35
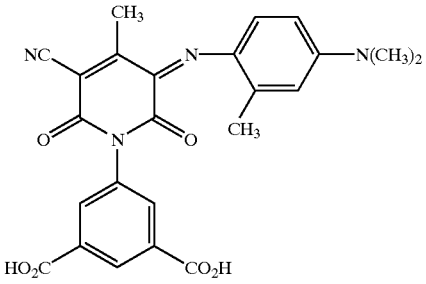
F-36
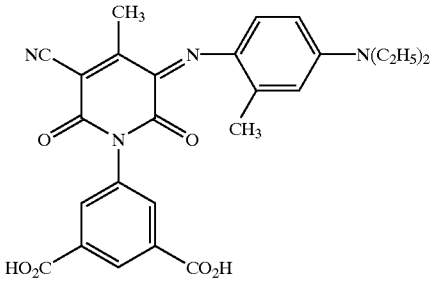
F-37
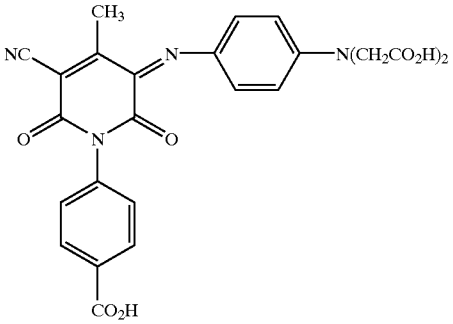
F-38
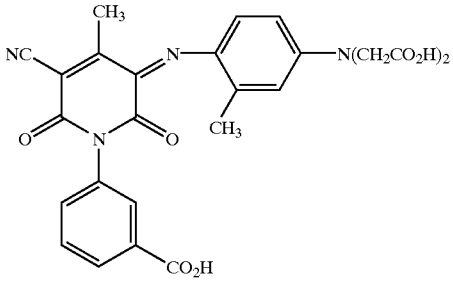
F-39
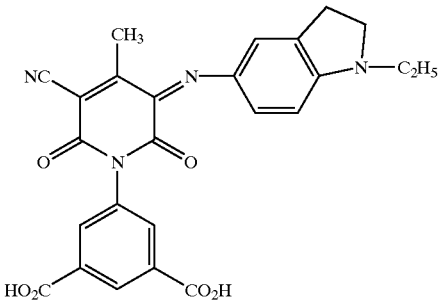
F-40
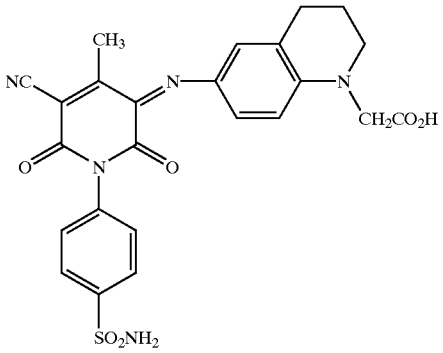

-continued
F-41
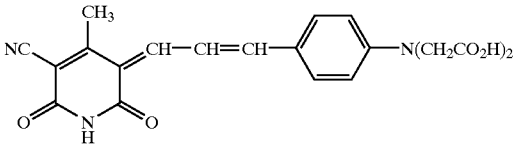
F-42
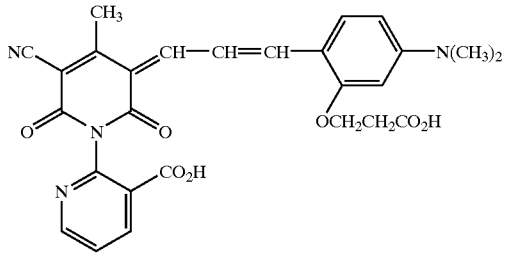
F-43
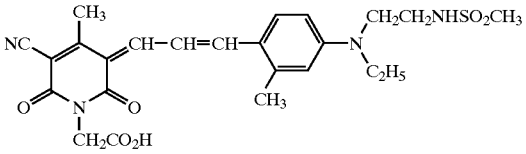
F-44
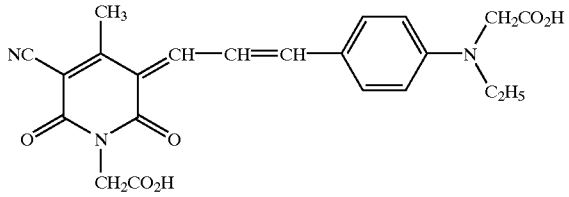
F-45
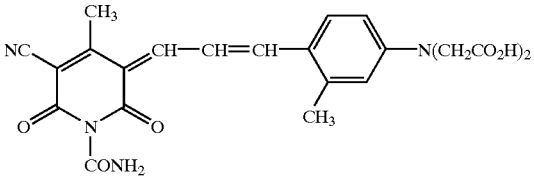
F-46
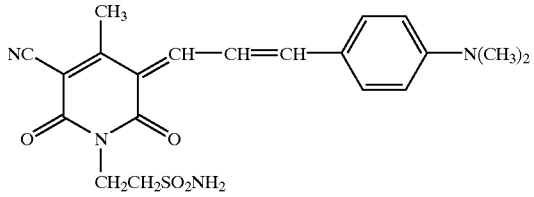
F-47
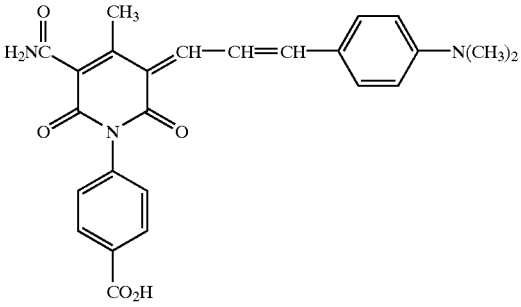
F-48
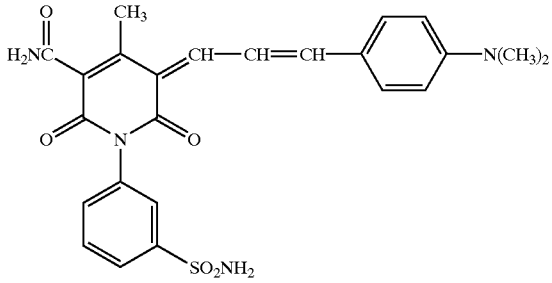
F-49
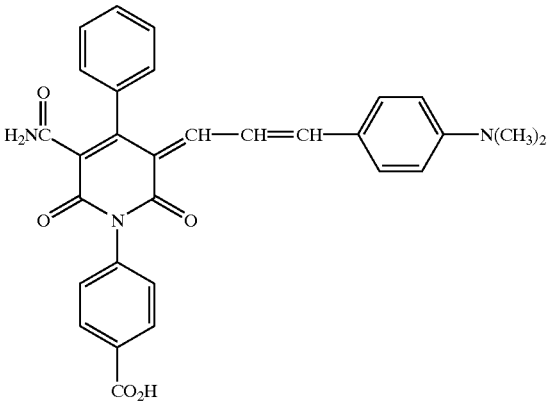
F-50
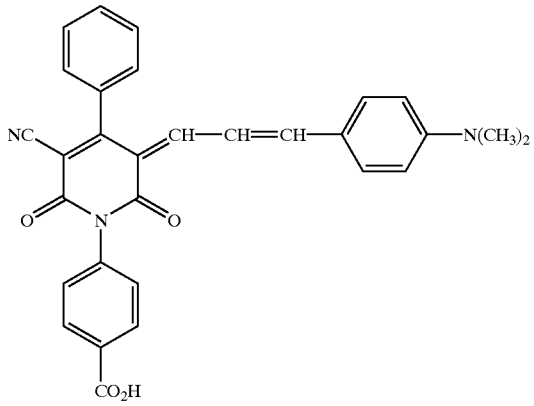
F-51
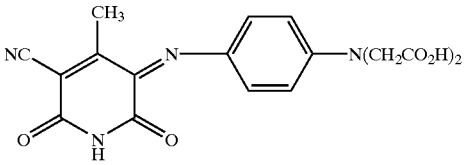
F-52
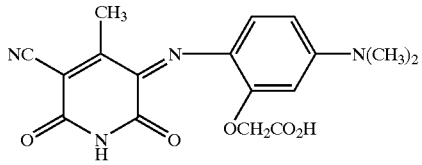

-continued
F-53
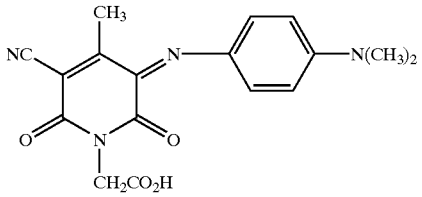
F-54
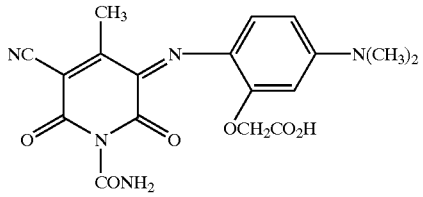
F-55
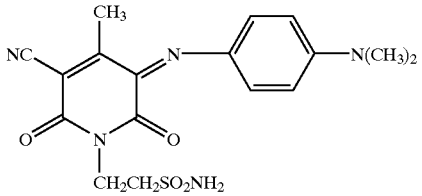
F-56
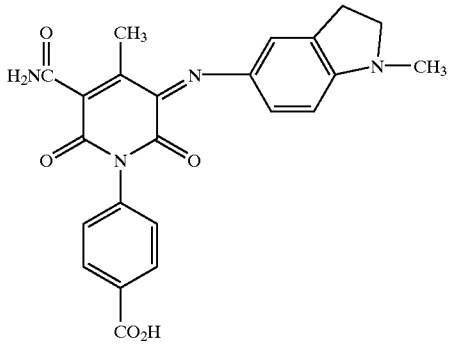
F-57
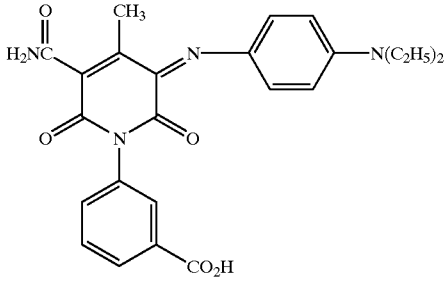
F-58
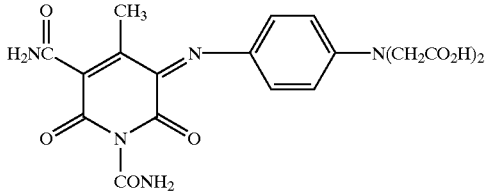
F-59
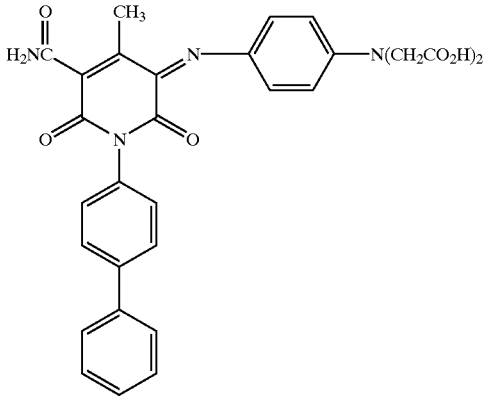
F-60
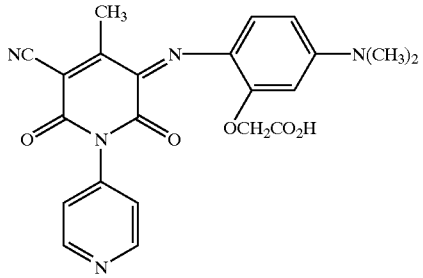

-continued
F-61
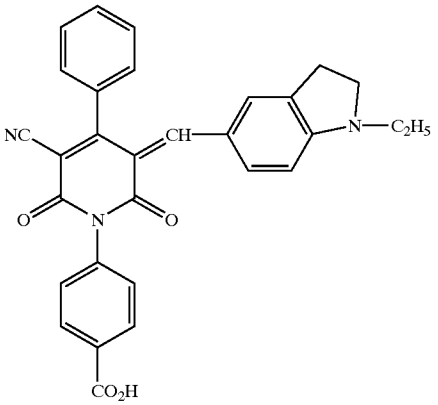
F-62
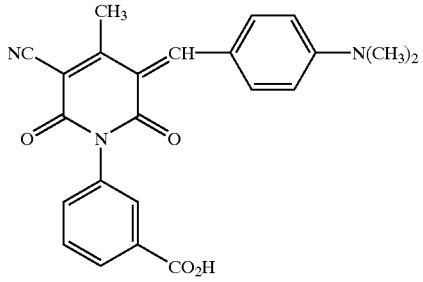
F-63
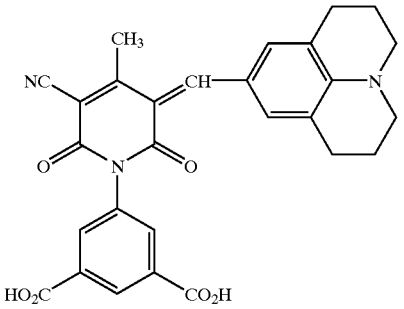
F-64
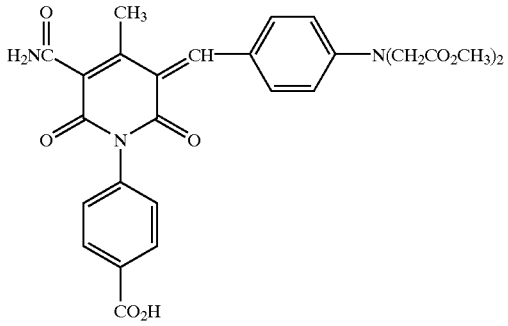
F-65
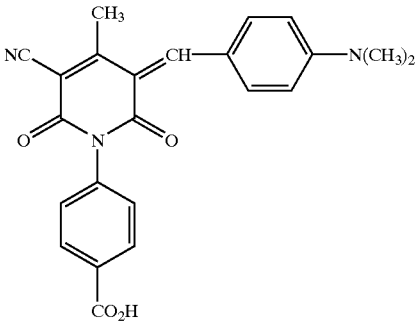
F-66
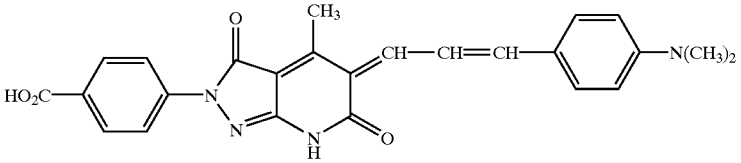
F-67
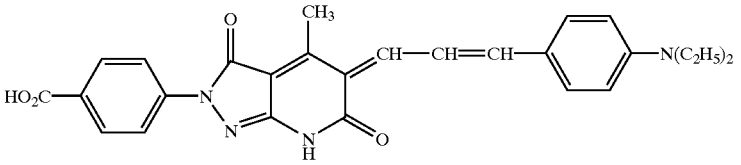
F-68
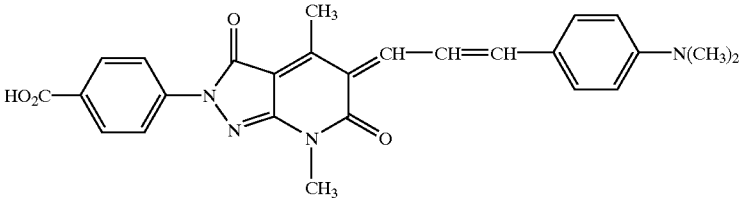

-continued
F-69
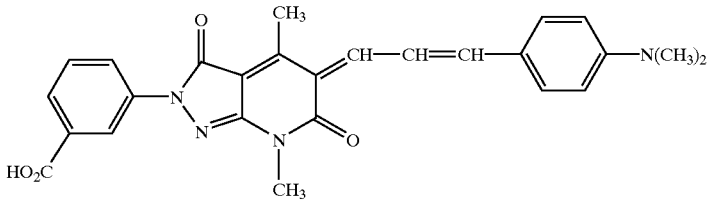
F-70
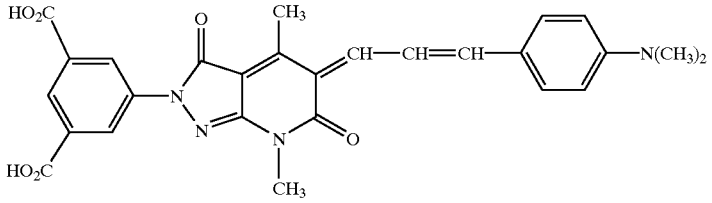
F-71
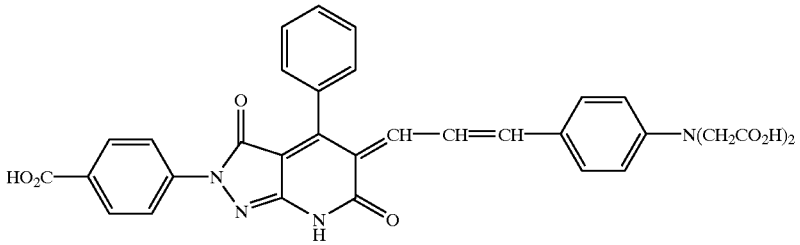
F-72
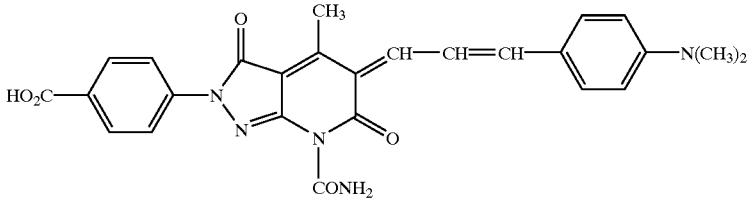
F-73
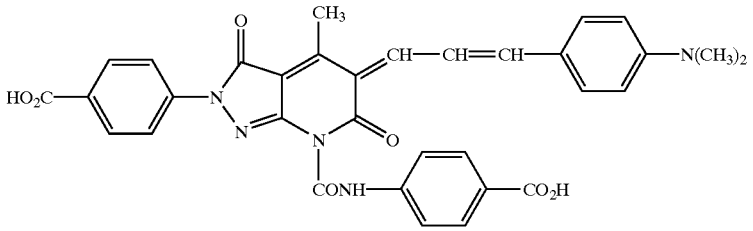
F-74
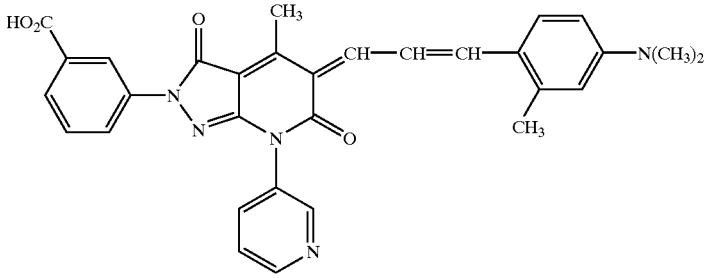
F-75
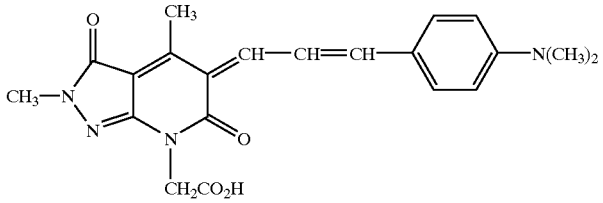

-continued
F-76
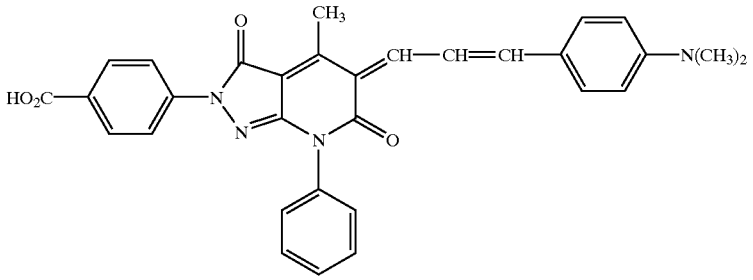
F-77
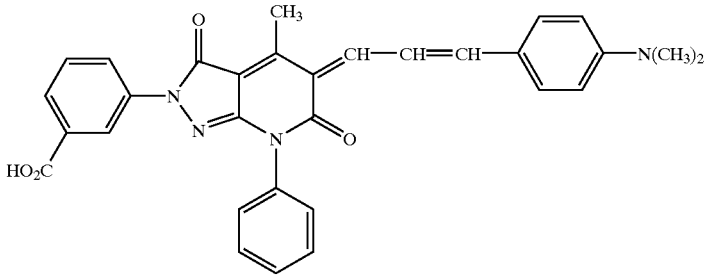
F-78
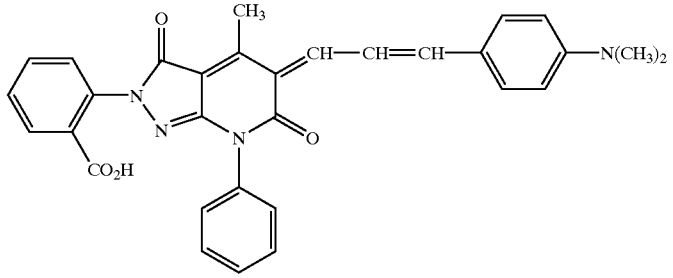
F-79
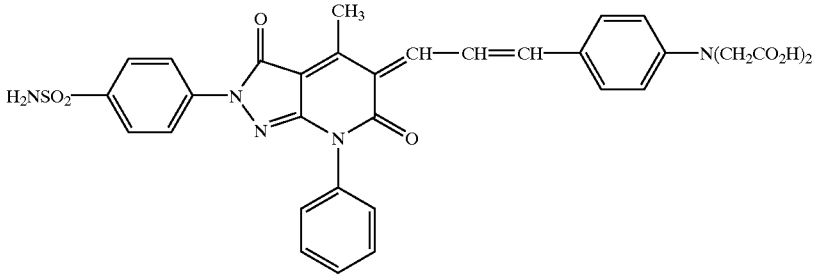
F-80
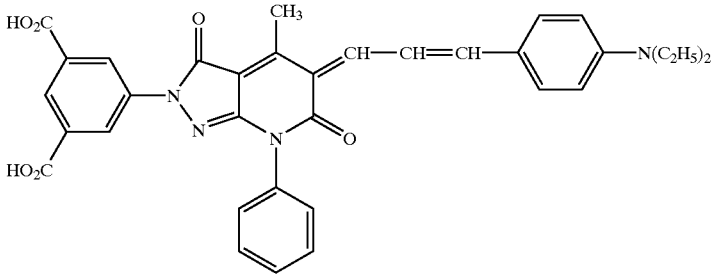

-continued
F-81
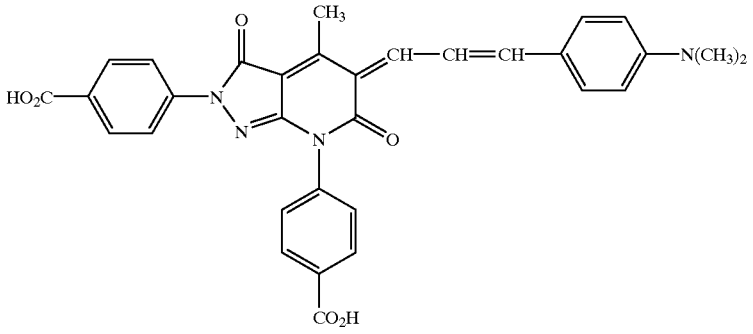
F-82
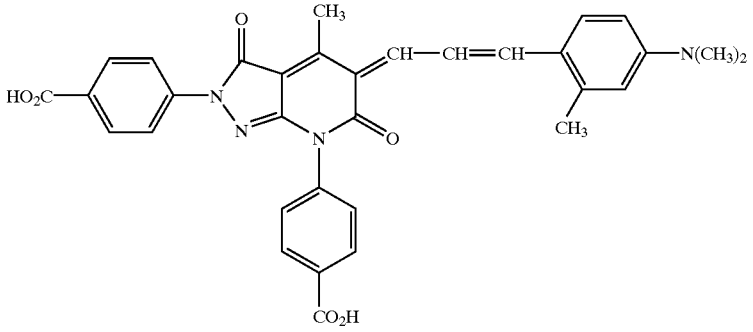
F-83
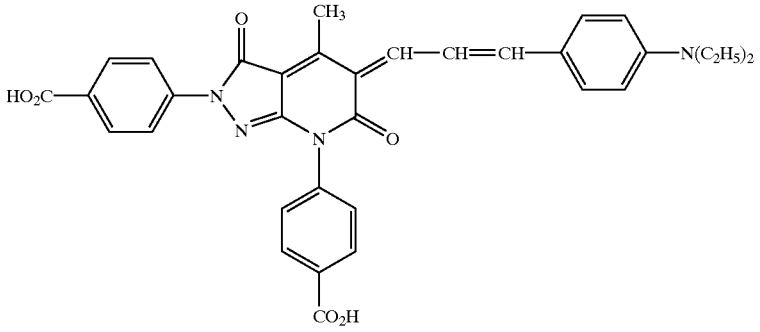
F-84
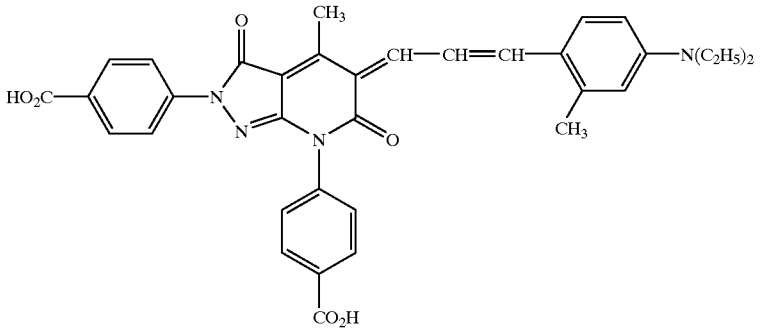

-continued
F-85
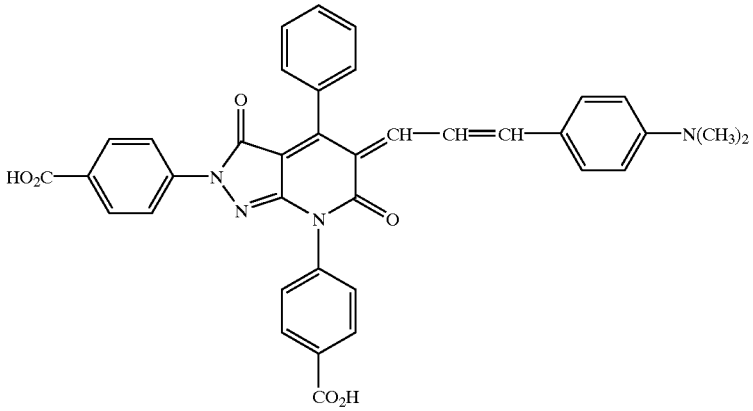
F-86
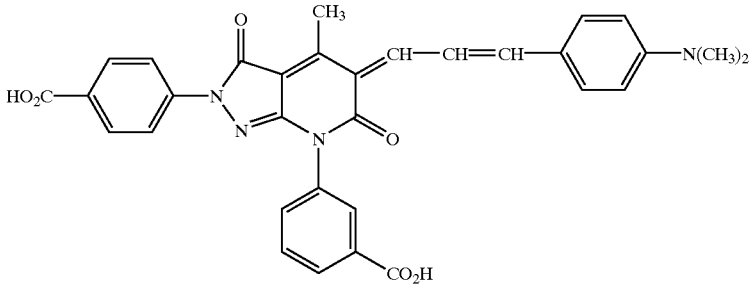
F-87
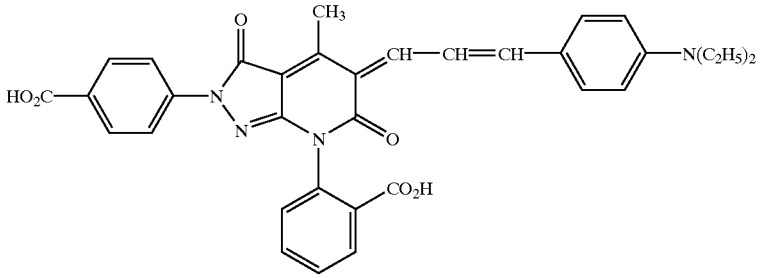
F-88
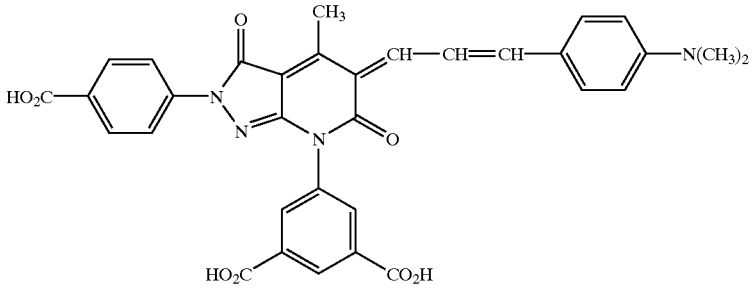
F-89
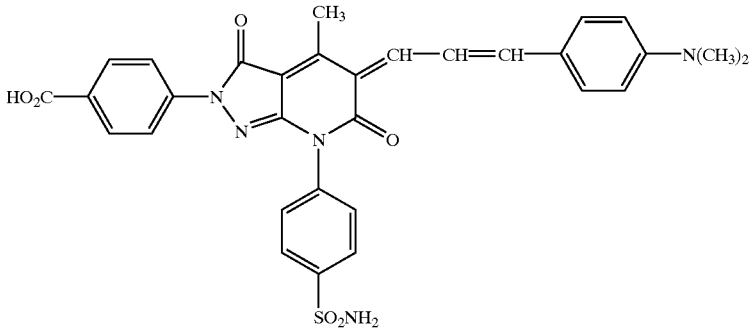

-continued
F-90
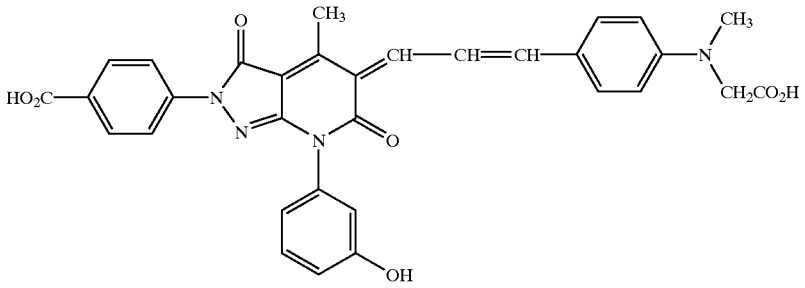
F-91
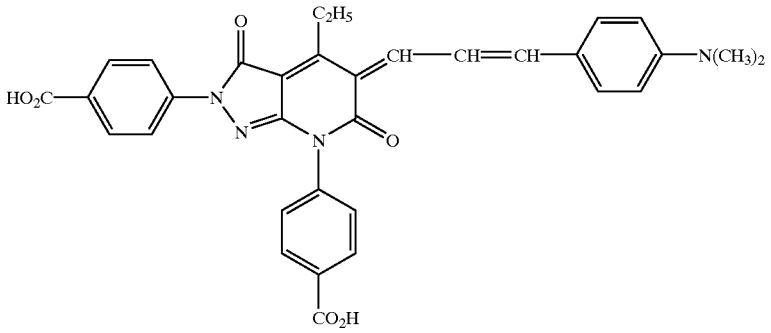
F-92
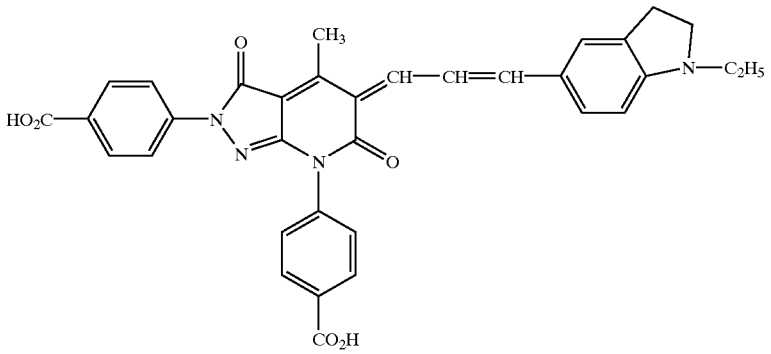
F-93
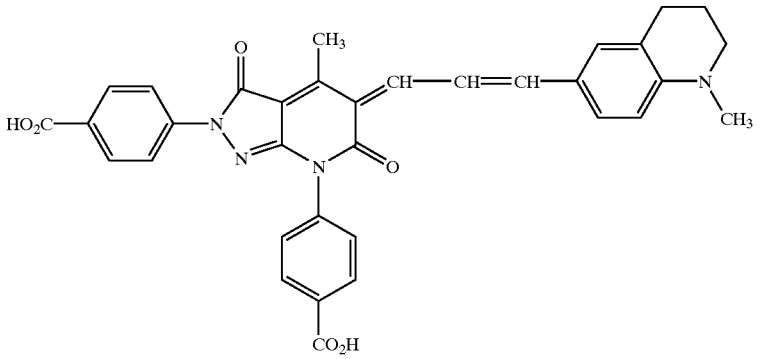

-continued
F-94
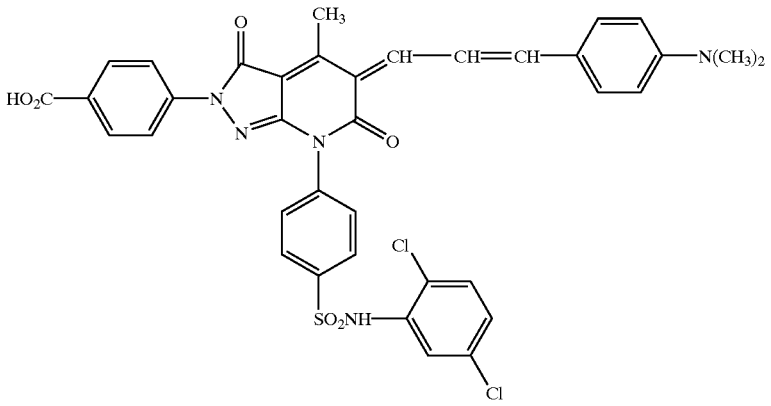
F-95
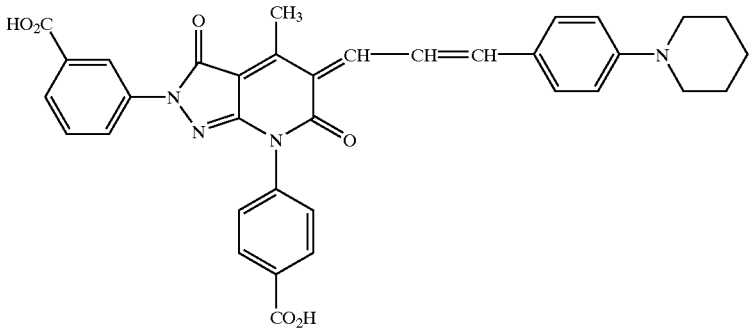
F-96
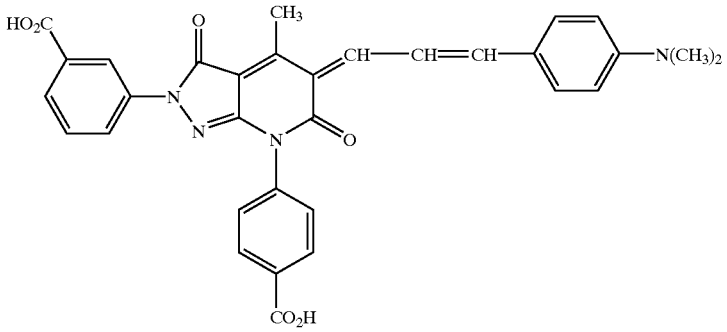
F-97
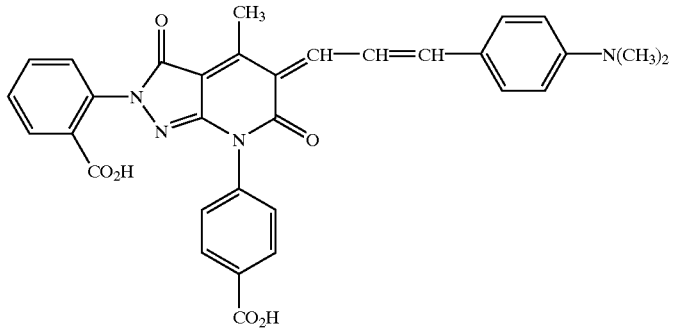

-continued
F-98
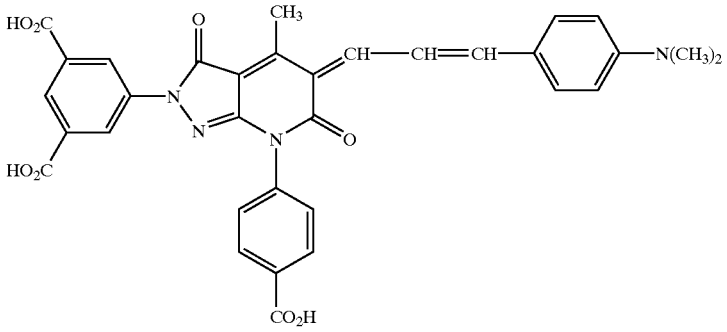
F-99
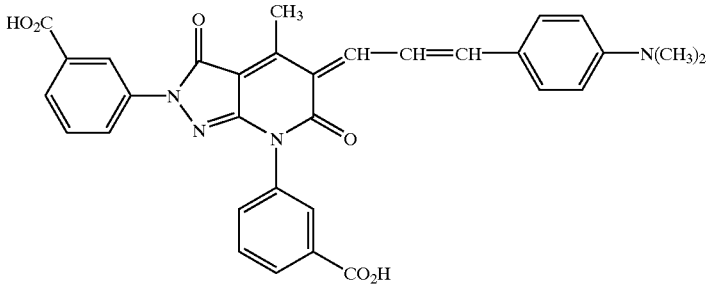
F-100
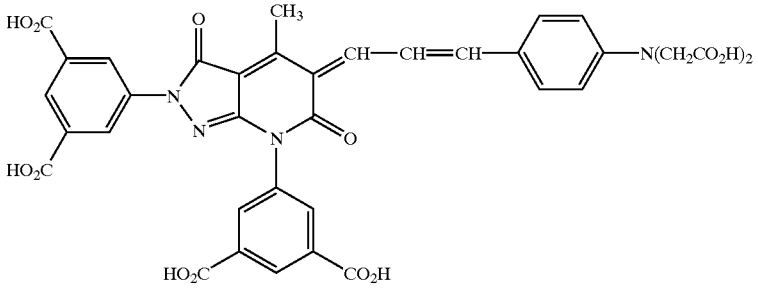
F-101
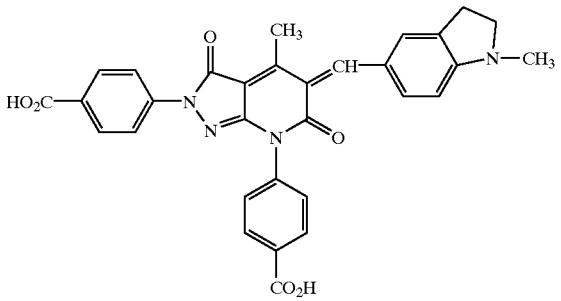
F-102
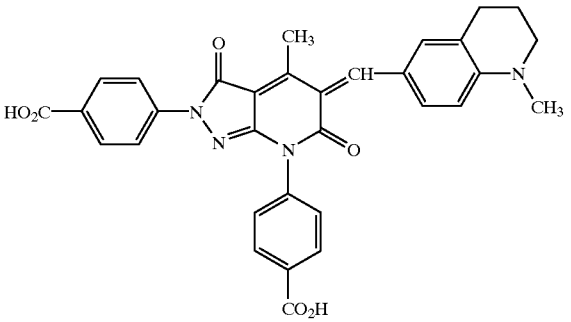
F-103
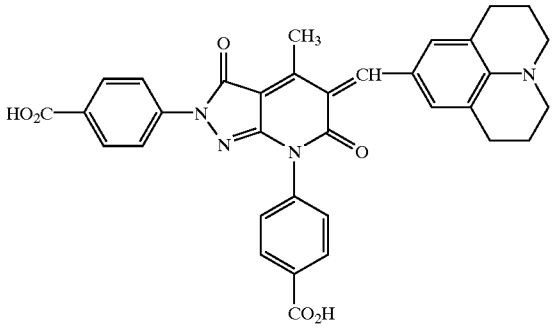
F-104
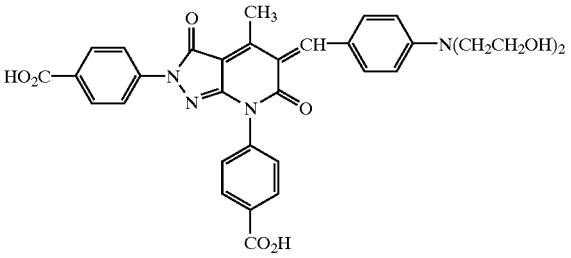

-continued
F-105
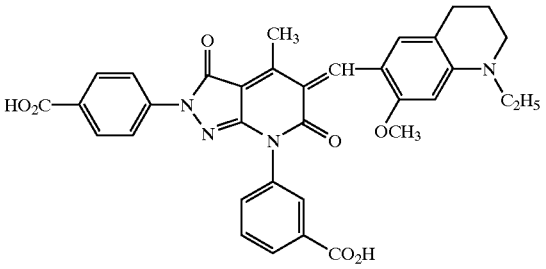
F-106
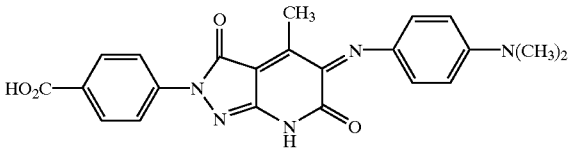
F-107
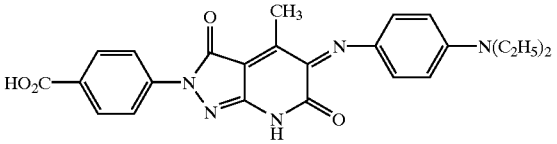
F-108
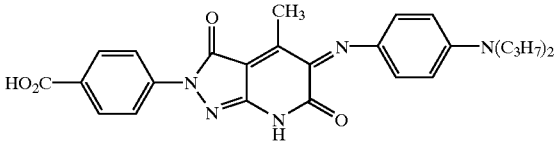
F-109
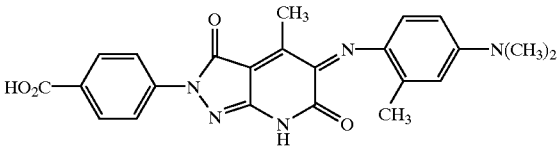
F-110
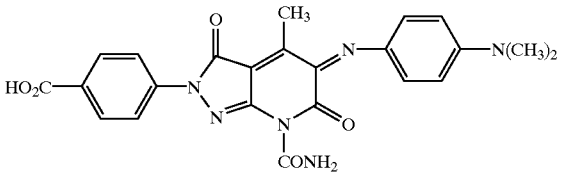
F-111
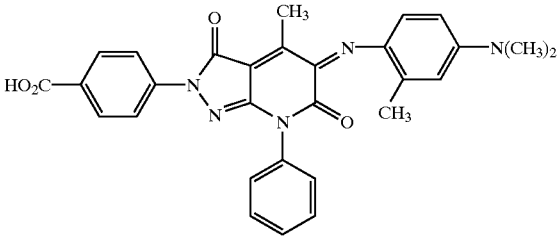
F-112
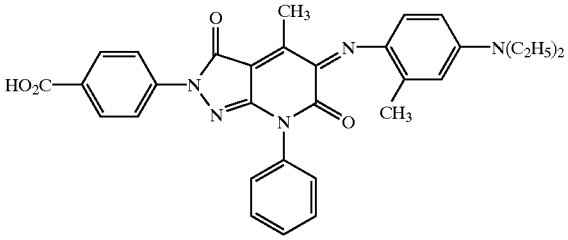
F-113
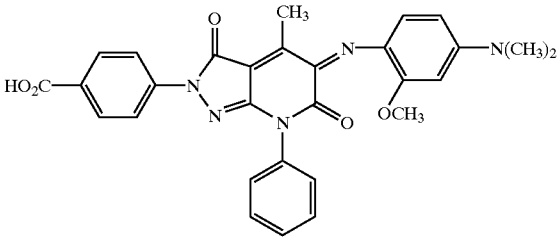
F-114
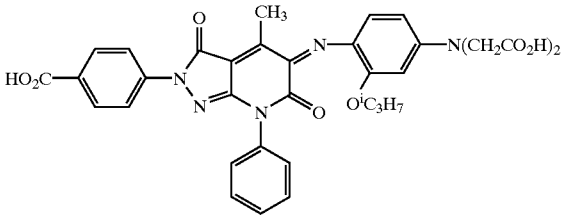
F-115
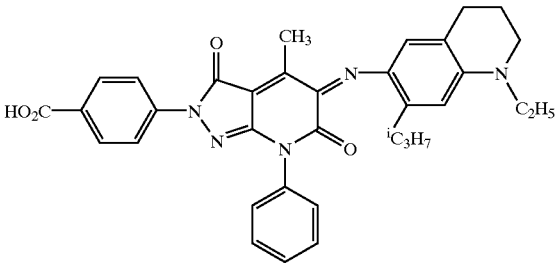
F-116
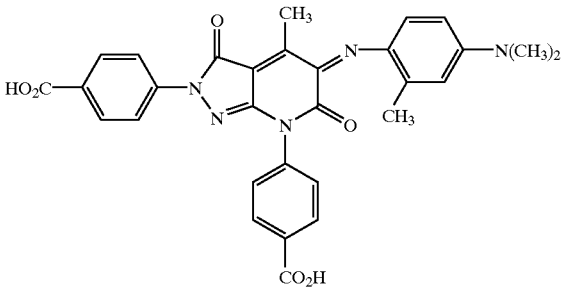

-continued
F-117
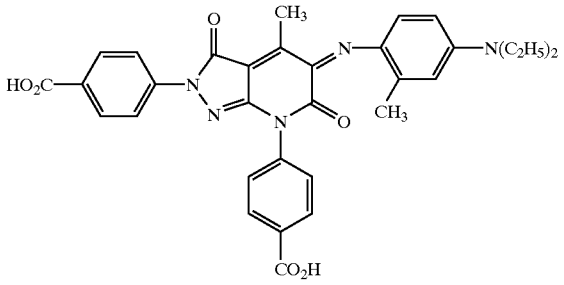
F-118
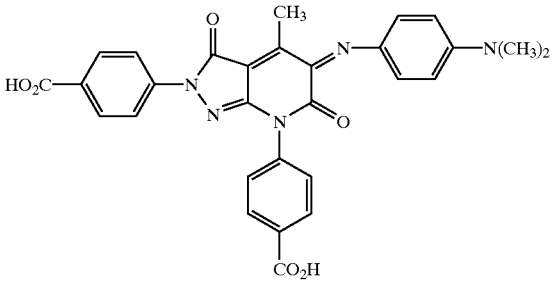
F-119
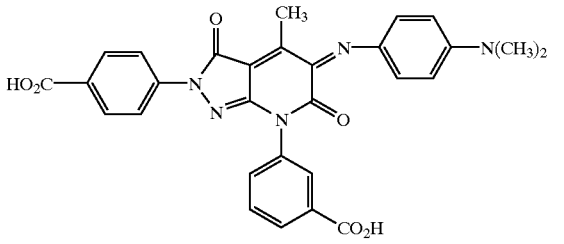
F-120
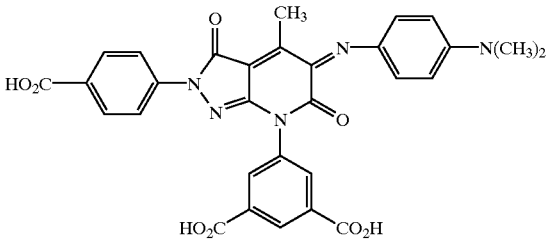
F-121
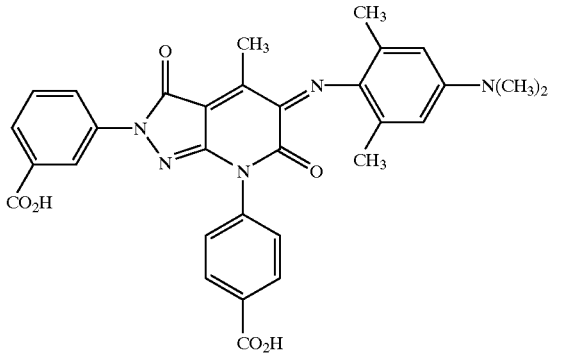
F-122
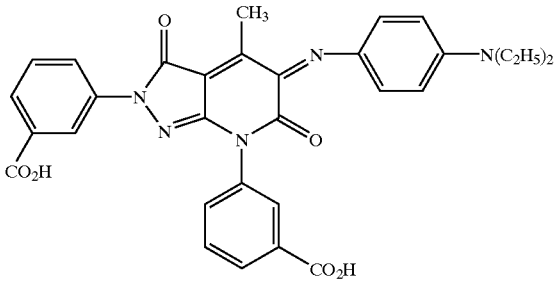
F-123
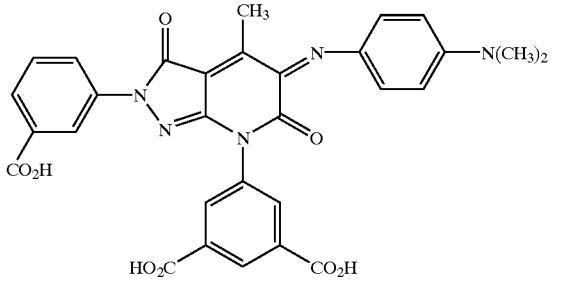
F-124
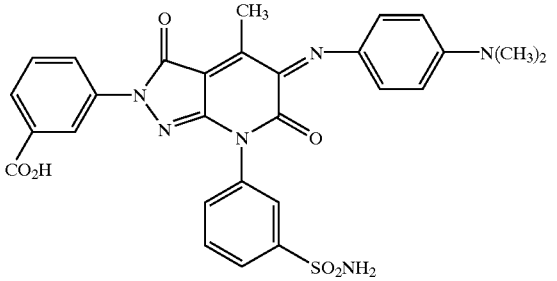

-continued
F-125
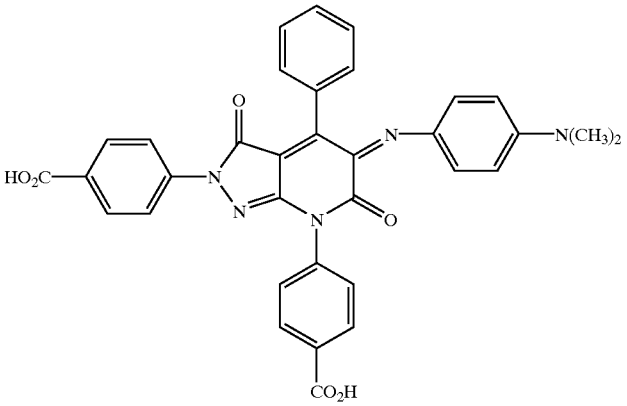
F-126
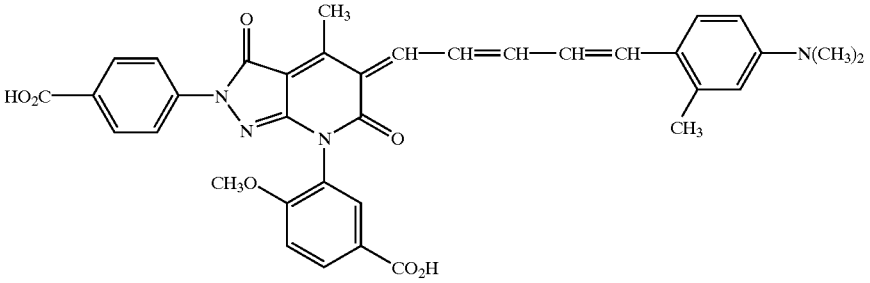
F-127
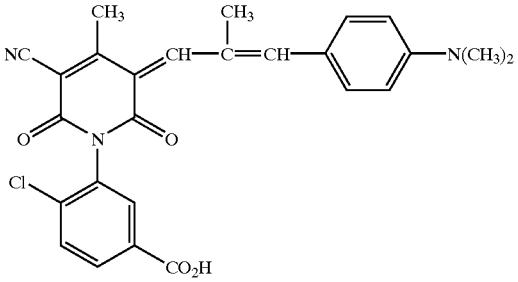
F-128
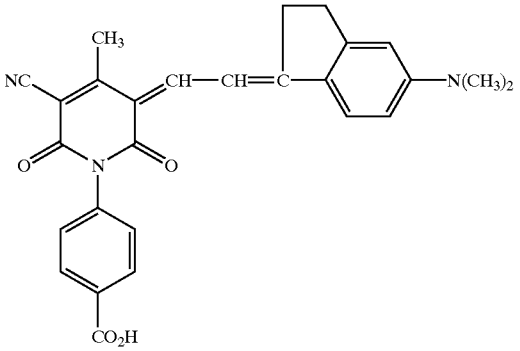
F-129
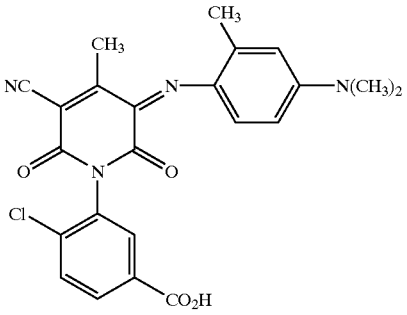
F-130
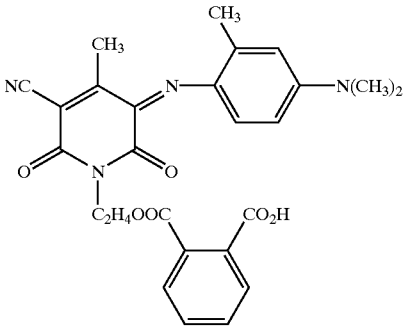
F-131
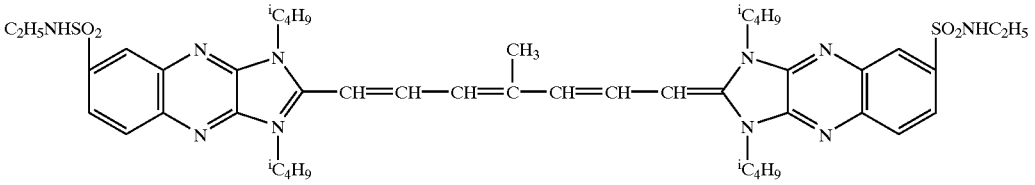

-continued
F-132
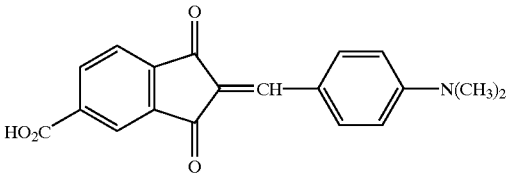
F-133
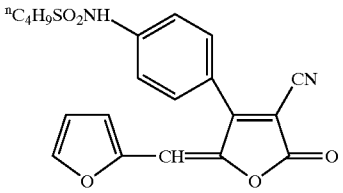
F-134
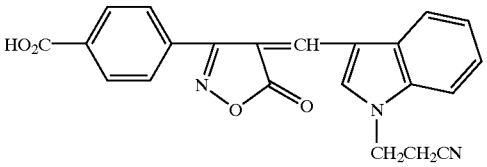
F-135
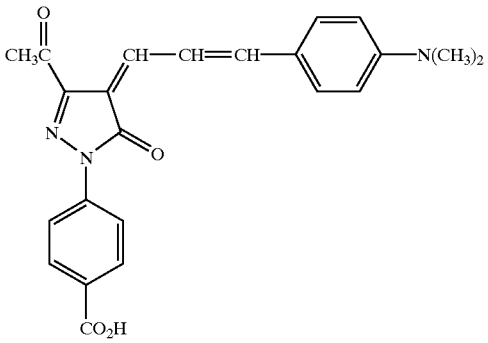
F-136
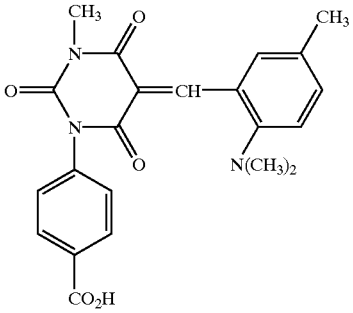
F-137
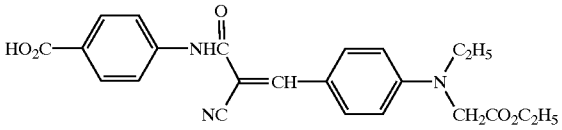
F-138
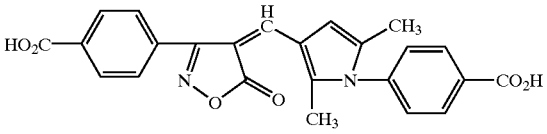
F-139
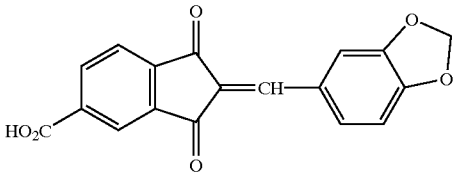
F-140
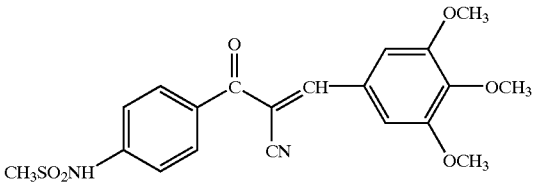
F-141
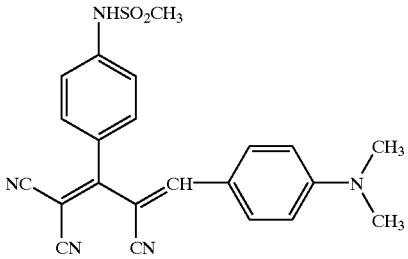
F-142
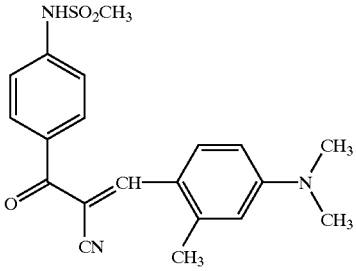
F-143
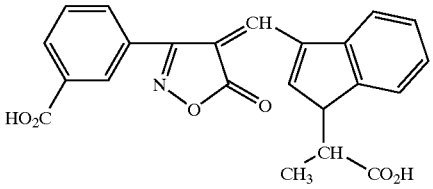

-continued
F-144
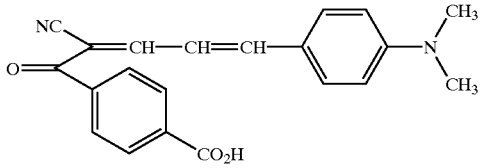
F-145
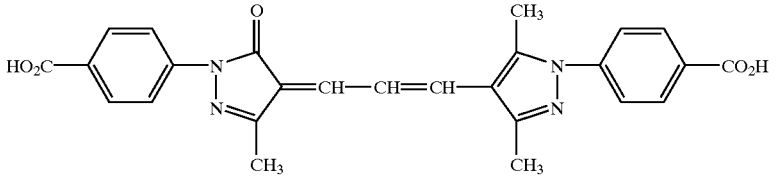
F-146
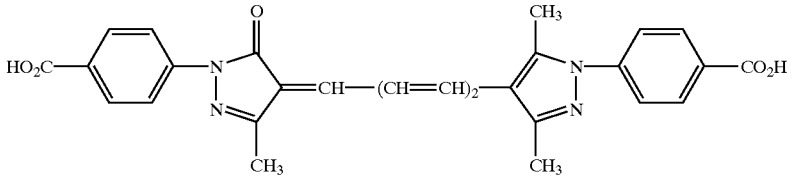
F-147
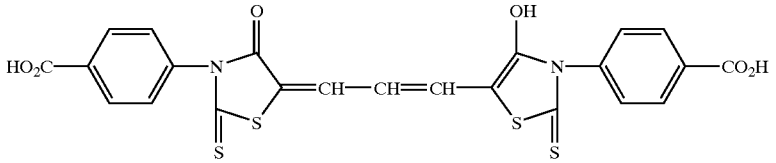
F-148
F-149
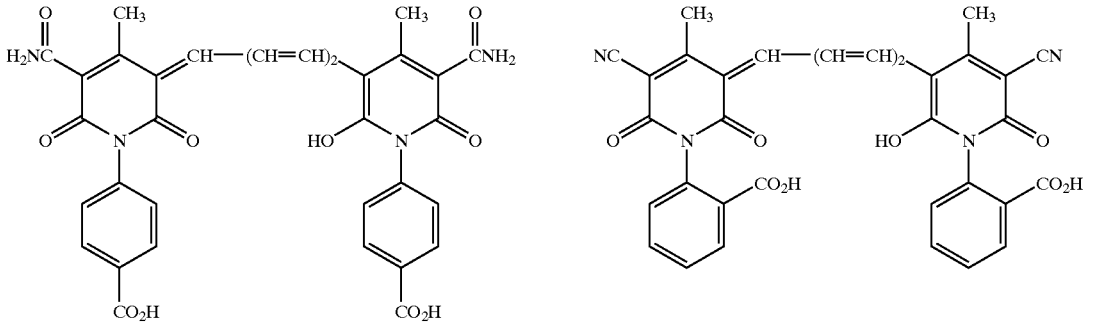
F-150
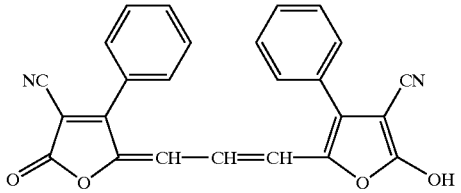
F-151
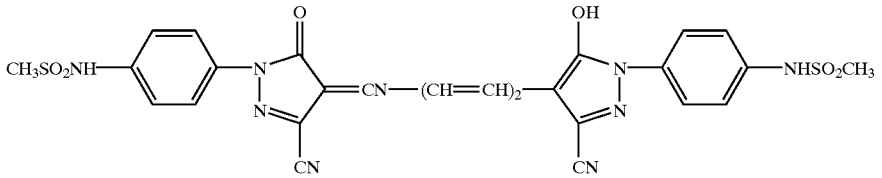

-continued
F-152
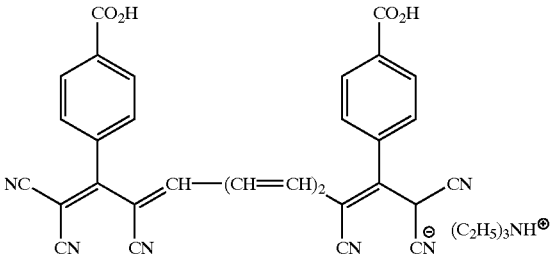
F-153
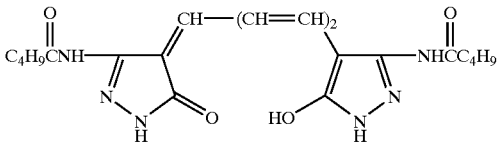
F-154
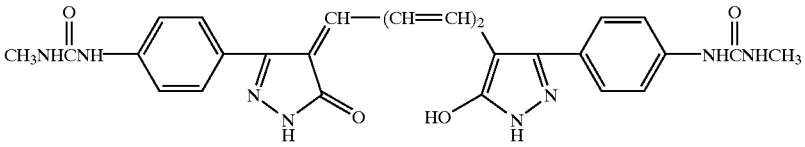
F-155
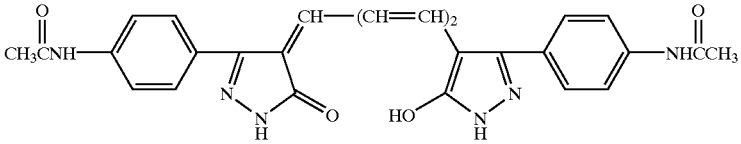
F-156
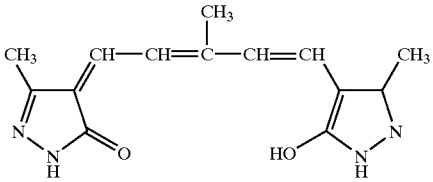
F-157
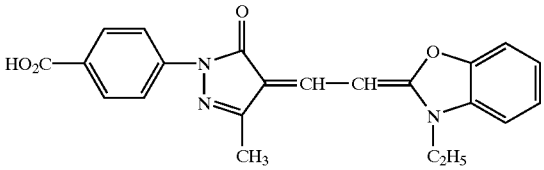
F-158
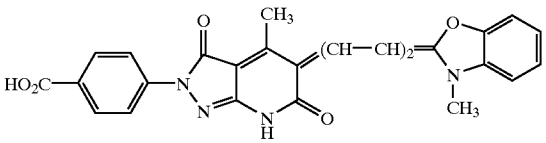
F-159
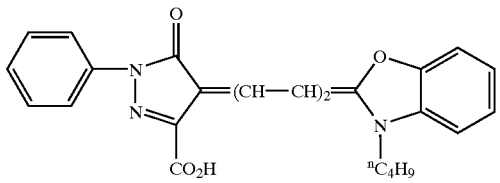
F-160
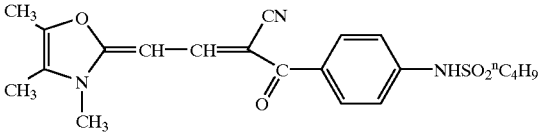
F-161
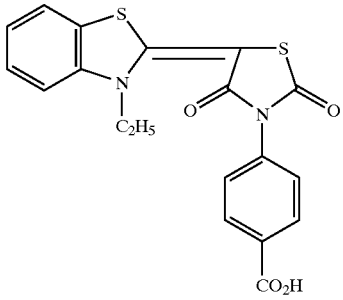

-continued
F-162
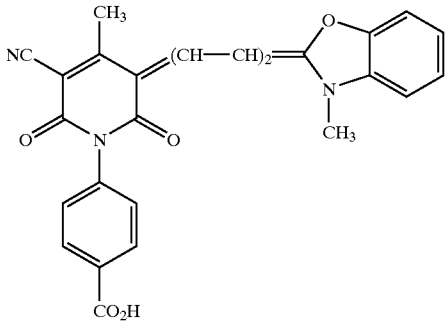
F-163
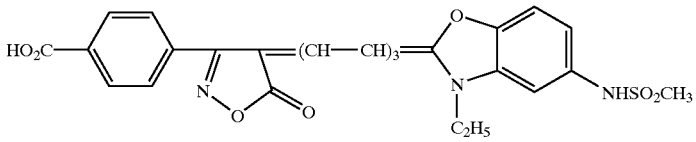
F-164
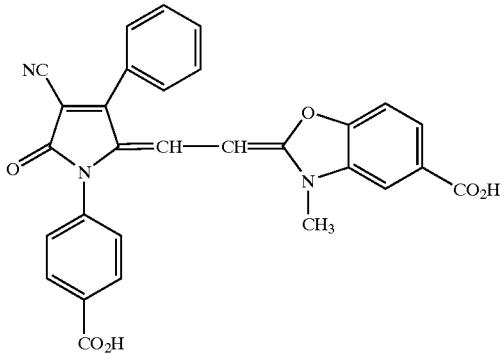
F-165
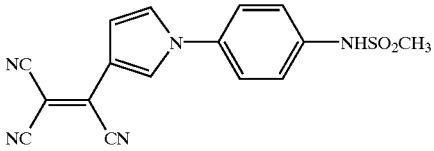
F-166
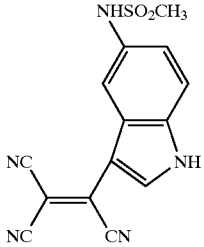
F-167
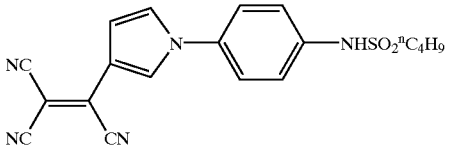
F-168
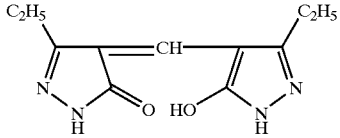
F-169
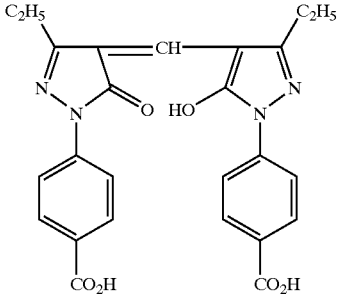
F-170
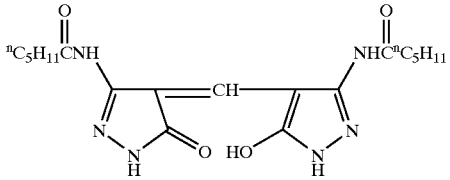
F-171
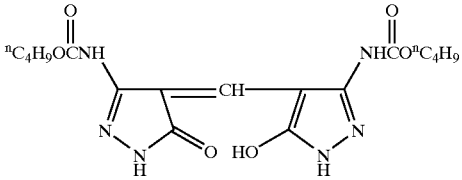

-continued
F-172
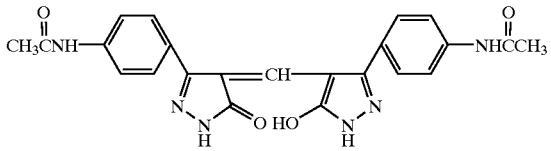
F-173
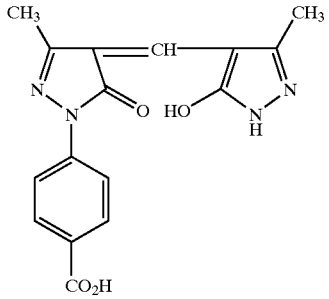
F-174
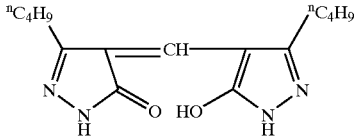
F-175
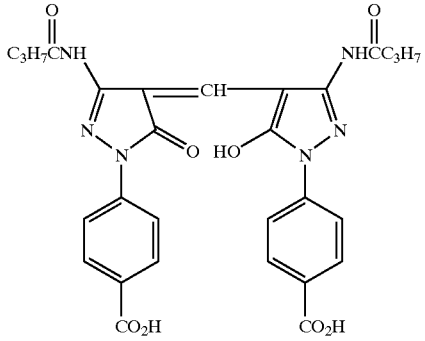
F-176
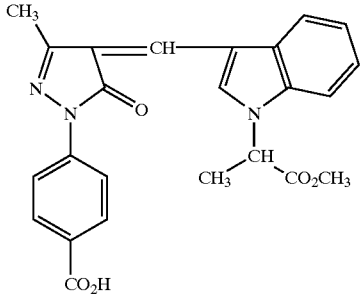
F-177
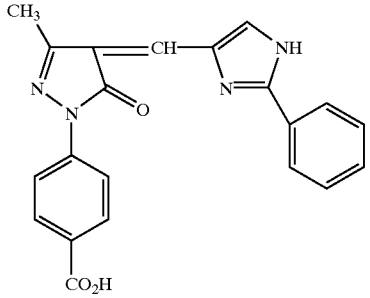
F-178
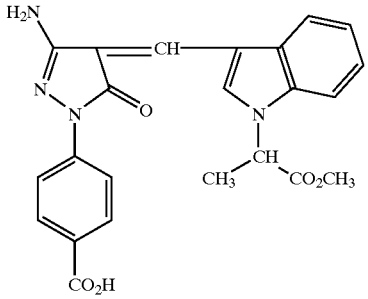
F-179
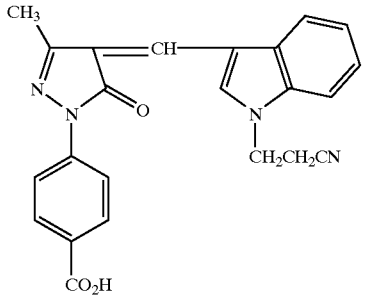
F-180
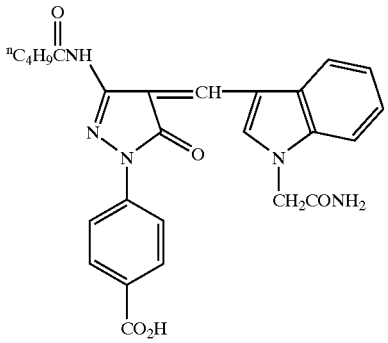
F-181
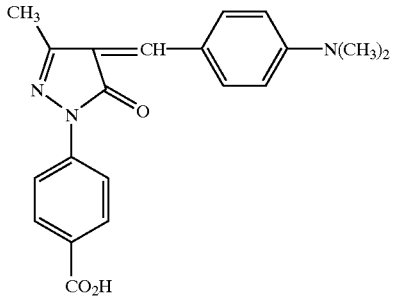

-continued
F-182
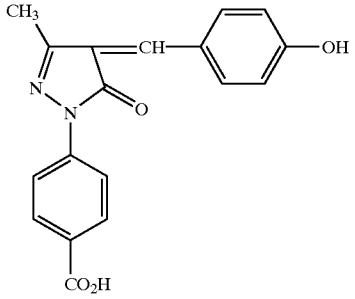
F-183
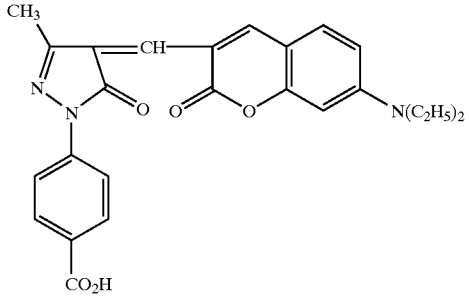
F-184
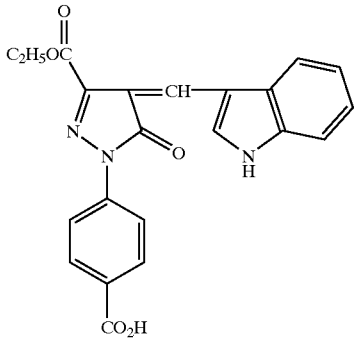
F-185
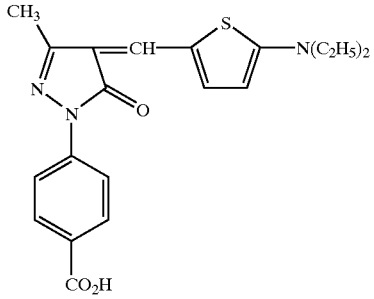
F-186
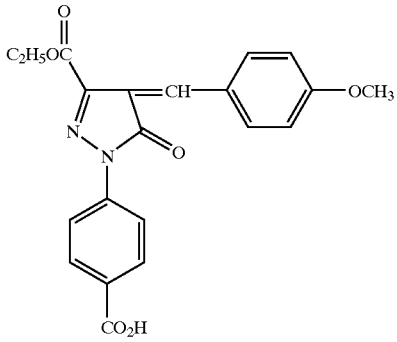
F-187
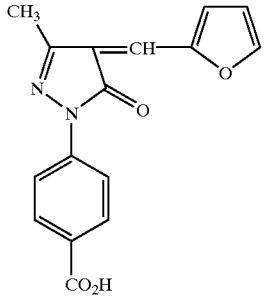
F-188
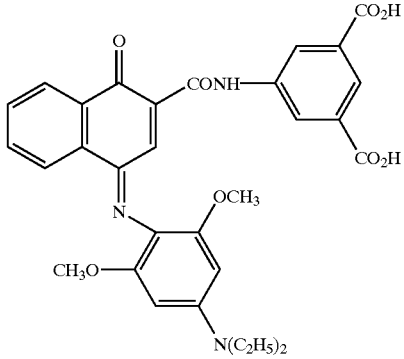
F-189
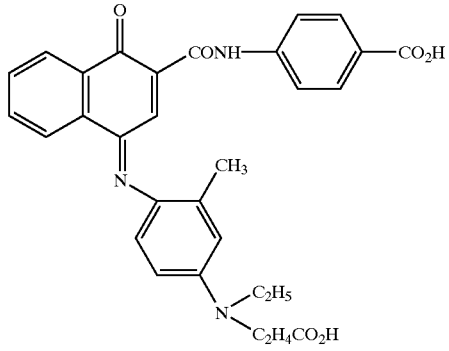

-continued
F-190
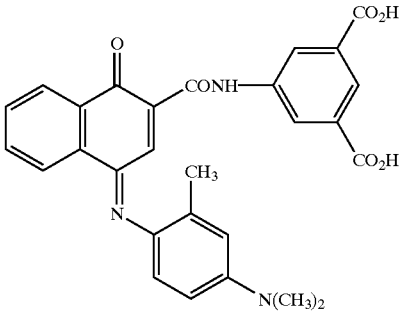
F-191
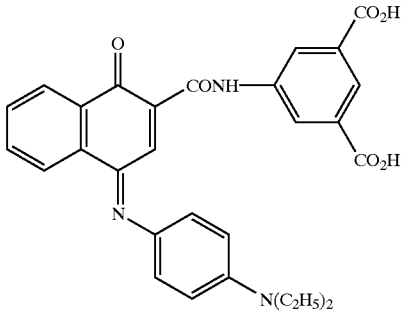
F-192
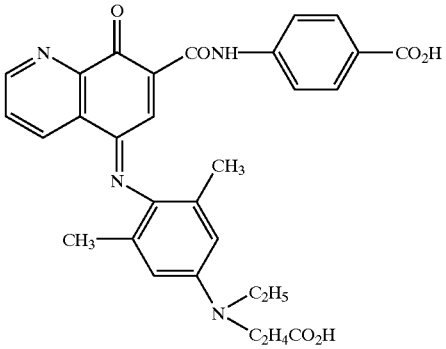
F-193
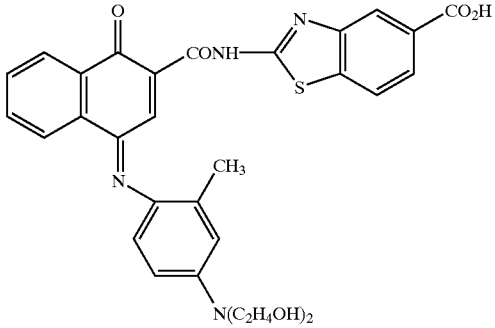
F-194
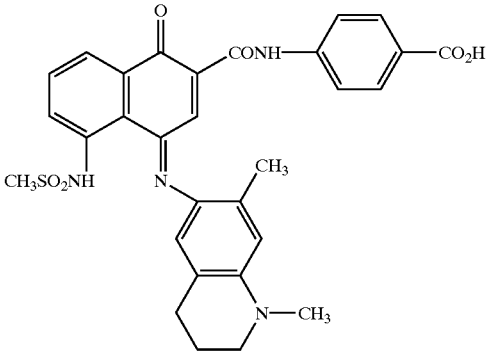
F-195
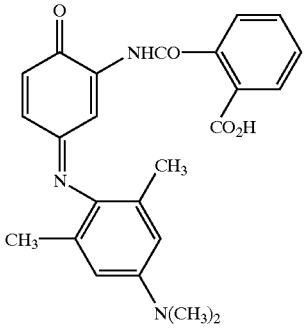
F-196
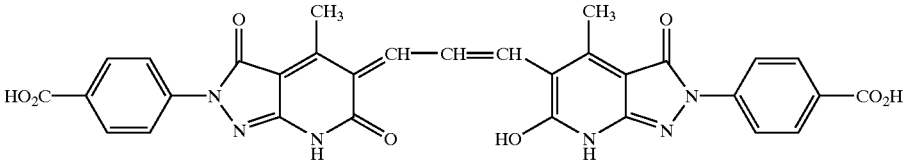
F-197
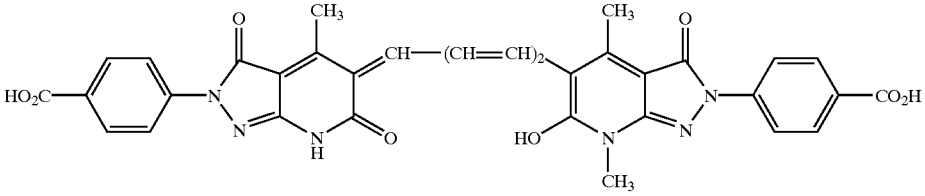
F-198
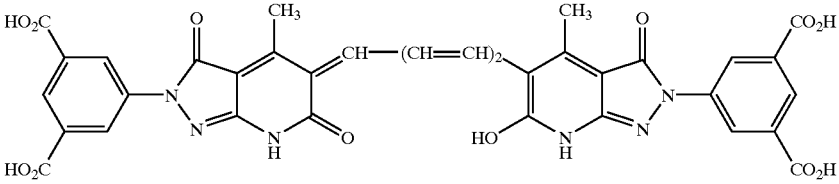

-continued
F-199
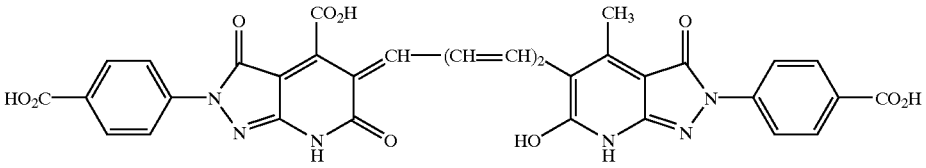
F-200
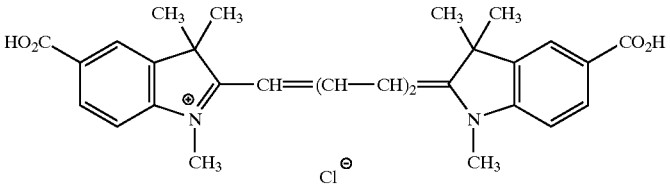
F-201
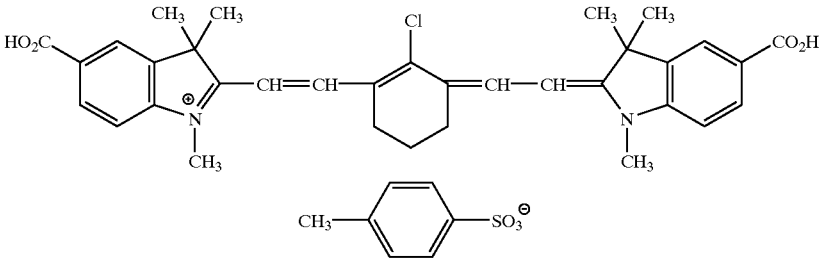
F-202
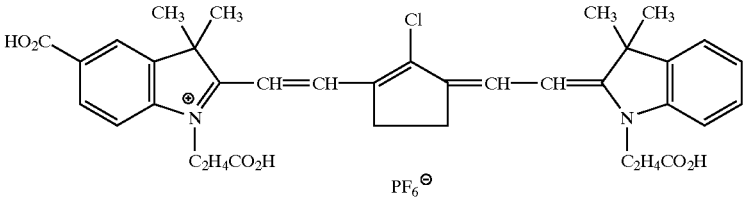
F-203
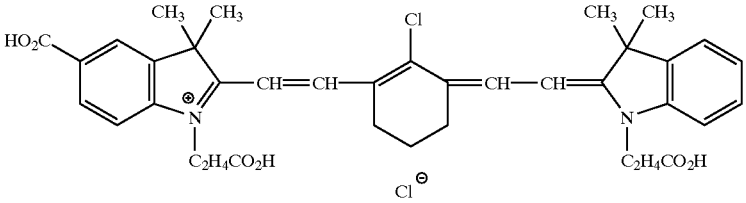
F-204
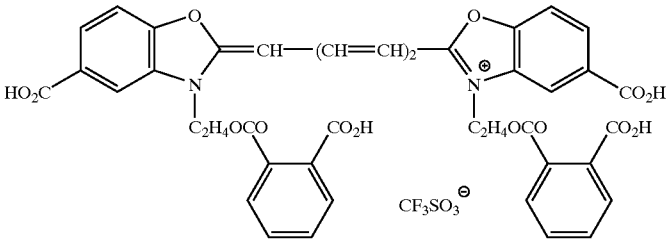
F-205
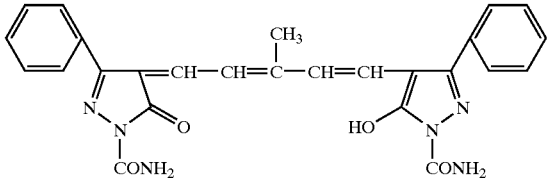
F-206
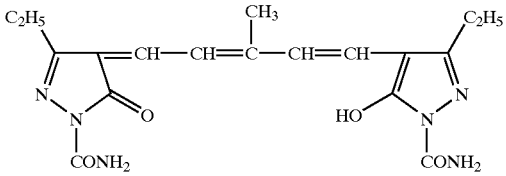

-continued
F-207
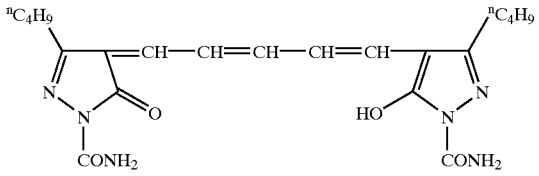
F-208
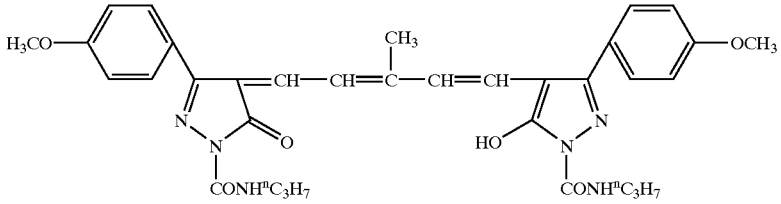
F-209
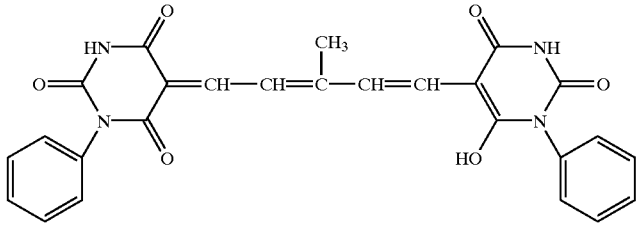
F-210
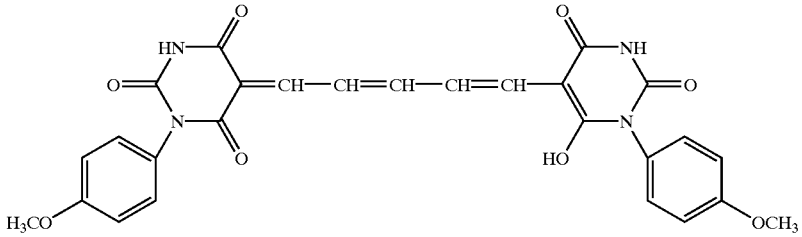
F-211
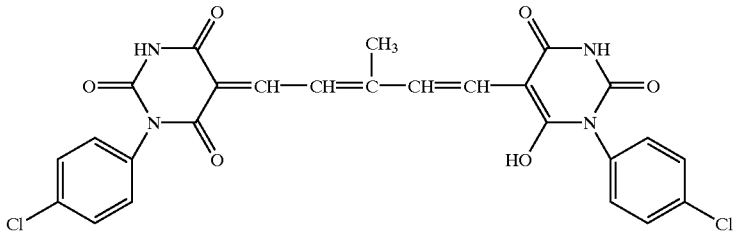
F-212
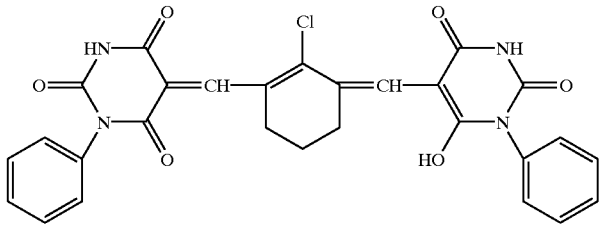

-continued

F-213

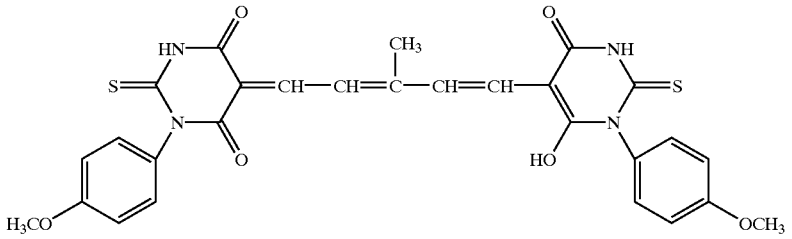

The dyes which are to be used in the present invention and are represented by the general formula (I) can be synthesized by the same or nearly the same processes as those described in International Patent WO88/04794; European Patent Application Nos. EP0274,723A1; 276,566; and 299,435; U.S. Pat. Nos. 2,527,583; 3,486,897; 3,746,539; 3,933,798; 4,130,429; 4,040,841; JP-A Nos. 48-68,623; 52-92,716; 55-155,350; 55-155,351; 61-205,934; 2-173,630; 2-230,135; 2-277,044; 2-282,244; 3-7,931; 3-167,546; 3-13,937; 3-206,443; 3-208,047; 3-192,157; 3-216,645; 3-274,043; 4-37,841; 4-45,436; 4-138,449; 5-197,077; 6-332,112; 7-206,824; 8-20,582; and so on.

As typical examples, some specific synthetic processes for making the illustrative compounds as the dyes represented by the general formula (I) are given below.

(Synthesis-1) Synthesis of the illustrative compound F-3

The process for the synthesis of the illustrative compound F-3 is indicated by the following chemical formulae.

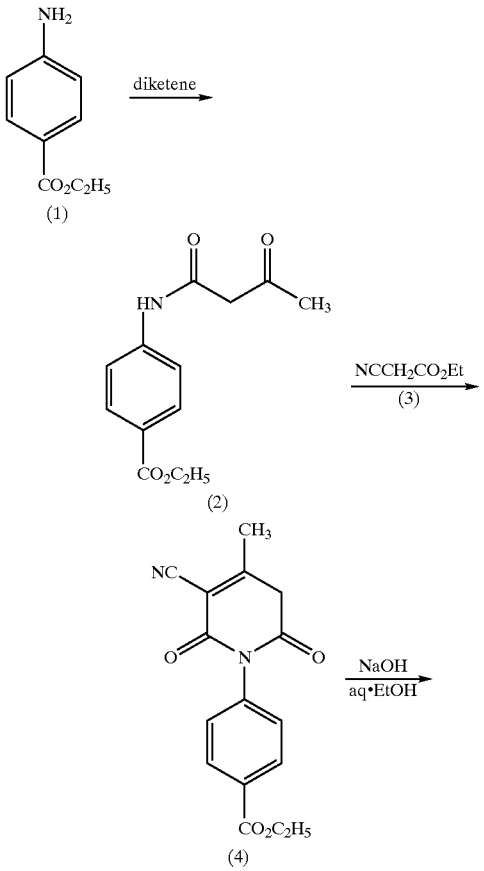

-continued

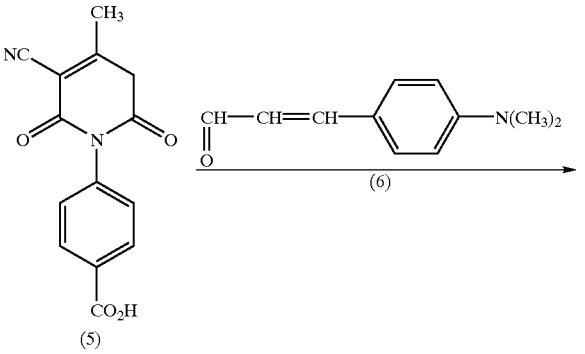

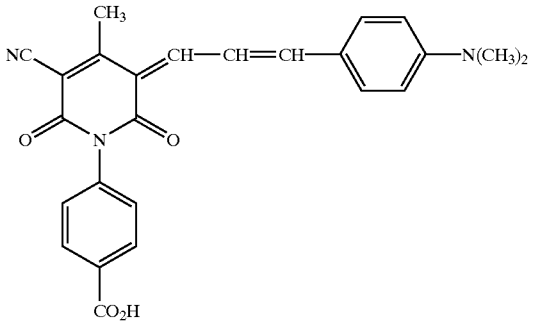

(illustrative compound F-3)

Steps of the process are explained below.

Synthesis of the Compound (2)

A three-neck flask was charged with 165 g of the compound (1), 40.4 mL of pyridine, and 500 mL of dimethylacetamide. While the reaction mixture was stirred at a liquid temperature of 83° C. on a steam bath, 126 g of diketene was added dropwise to the reaction mixture over a period of 20 minutes. After the completion of the dropwise addition, the reaction mixture was continuously heated with stirring at that temperature for additional 2 hours and thereafter cooled to room temperature. Then, 1L of ethyl acetate and 1L of water were added to the reaction mixture to extract the reaction product. The ethyl acetate layer thus obtained was washed 4 times with a solvent mixture composed of 100 mL of saturated aqueous solution of sodium chloride and 600 mL of water. The solution in ethyl acetate was dried by using anhydrous sodium sulfate and thereafter concentrated by using a rotary evaporator. In this way, the target compound (2) was obtained as a crude product. The compound (2) thus obtained as a crude product was subjected straight to the following step.

Synthesis of the Compound (4)

A three-neck flask was charged with the compound (2) obtained in the preceding step, 102 g of piperidine, and 500 mL of isopropyl alcohol. While the reaction mixture was stirred at reflux temperature, 139 g of the compound (3) was added dropwise to the reaction mixture over a period of 20 minutes. After the completion of the dropwise addition, the reaction mixture was maintained at reflux temperature with stirring for additional 3 hours and thereafter cooled to room temperature. Then, 1L of ethyl acetate, 1L of water and 120 mL of a concentrated aqueous solution of hydrochloric acid were added to the reaction mixture to extract the reaction product. The ethyl acetate layer thus obtained was washed 4 times with a solvent mixture composed of 100 mL of saturated aqueous solution of sodium chloride and 600 mL of water. The solution in ethyl acetate was dried by using anhydrous sodium sulfate and thereafter concentrated by using a rotary evaporator. Then, 1L of acetonitrile was added to the residue thus obtained and the crystals that deposited were collected by filtration under suction. In this way, 238 g (80% yield) of the target compound (4) was obtained.

Synthesis-of the Compound (5)

A three-neck flask was charged with 149 g of the compound (4) and 450 mL of ethanol. While the reaction mixture was stirred, a solution prepared by dissolving 80 g of sodium hydroxide in 160 mL of water was added dropwise to the reaction mixture over a period of 5 minutes. After the completion of the dropwise addition, the reaction mixture was stirred for additional 30 minutes and thereafter poured into 1 kg of water. Then, while the reaction mixture was stirred, 257 mL of a concentrated aqueous solution of hydrochloric acid was added to the reaction mixture and the reaction mixture was stirred for one hour. After that, the crystals that deposited were collected by filtration under suction. In this way, 128 g (95% yield) of the target compound (5) was obtained. Synthesis of the illustrative compound F-3.

A three-neck flask was charged with 81 g of the compound (5), 53 g of the compound (6), and 1.2 L of methanol. The reaction mixture was stirred at reflux temperature for 30 minutes and thereafter cooled to room temperature. After that, the crystals that deposited were collected by filtration under suction. The crystals thus collected were added with 500 mL of methanol. The mixture was stirred at reflux temperature for 15 minutes and thereafter cooled to room temperature. After that, the crystals were collected by filtration under suction and were then dried. In this way, 112 g (87% yield) of the illustrative compound F-3 aimed at was obtained.

(Synthesis-2) Synthesis of the Illustrative Compound F-81

The process for the synthesis of the illustrative compound F-81 is indicated by the following chemical formulae.

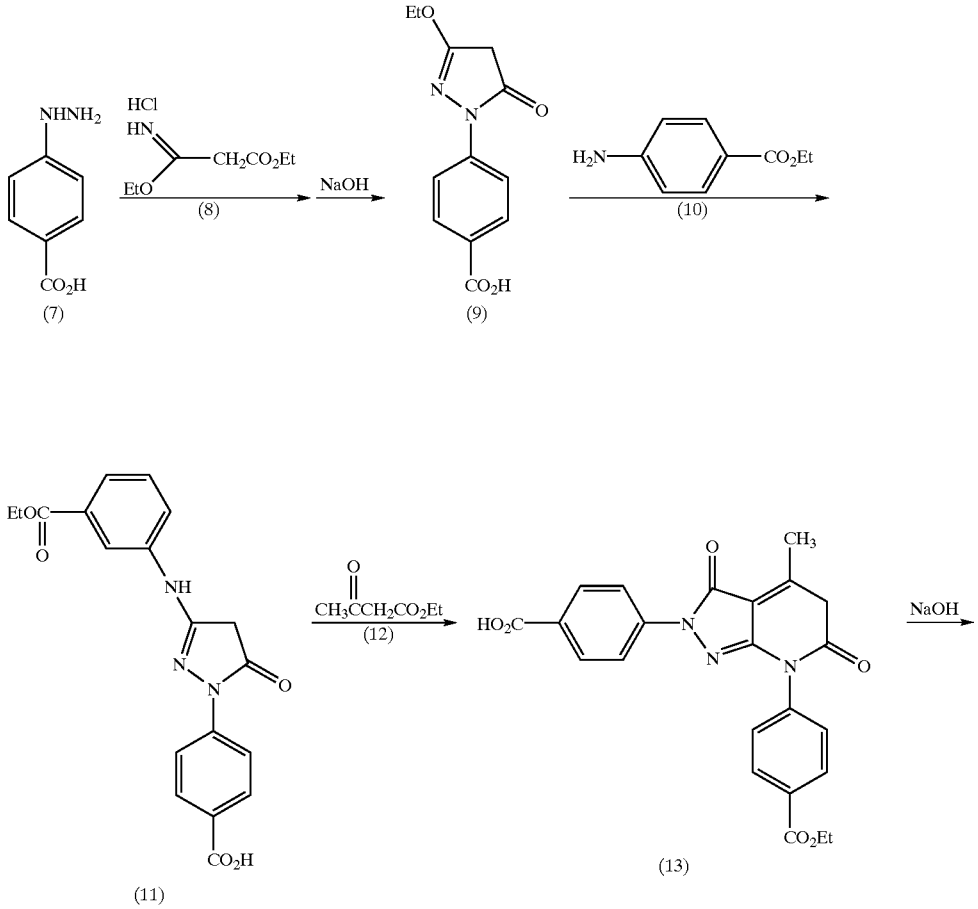

-continued

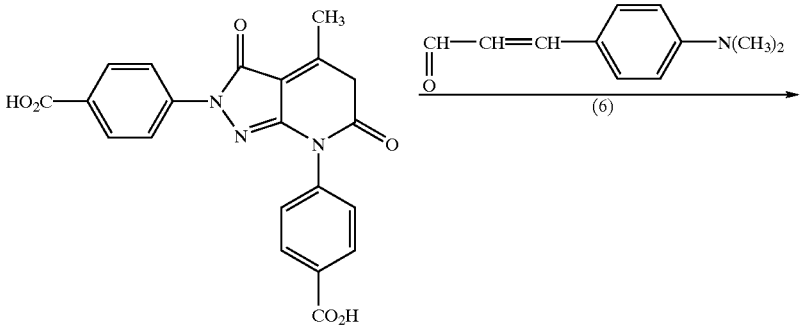

(14)

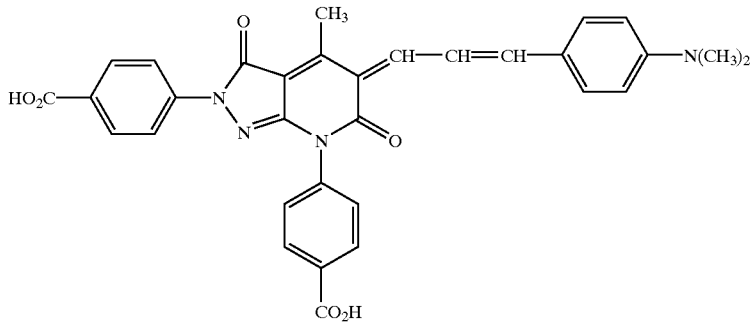

(illustrative compound F-81)

Steps of the process are explained below.

Synthesis of the Compound (9)

A three-neck flask was charged with 1.2 L of ethanol and 308 g of the compound (8). While the reaction mixture was stirred at room temperature, 228 g of the compound (7) was added dropwise to the reaction mixture over a period of 10 minutes. After the completion of the dropwise addition, the reaction mixture was stirred for additional 3 hours. Then, while the reaction mixture was stirred, a solution prepared by dissolving 198 g of sodium hydroxide in 1080 mL of water was added dropwise to the reaction mixture over a period of one hour. The addition caused the interior temperature to rise to 35° C. After the completion of the dropwise addition, the reaction mixture was stirred for additional one hour and 30 minutes. After that, the reaction mixture was poured into 6 L of methanol. Subsequently, 412 mL of a concentrated aqueous solution of hydrochloric acid was added dropwise to the reaction mixture in methanol over a period of 30 minutes and the mixture was stirred for additional one hour. The crystals that deposited were collected by filtration under suction. The crystals thus collected were washed with water and then dried. In this way, 345 g (95% yield) of the target compound (9) was obtained.

Synthesis of the Compound (11)

A three-neck flask was charged with 400 mL of sulfolane. While the sulfolane was stirred under a nitrogen stream, 310 g of the compound (9) was charged into the flask and thereafter 268 g of the compound (10) was charged into the flask. The reaction mixture was then heated to a liquid temperature of 90° C., at which temperature 24.0 g of methanesulfonic was added dropwise to the reaction mixture over a period of 3 minutes. After the completion of the dropwise addition, the reaction mixture was stirred at 135° C. for one hour and thereafter cooled to room temperature. The reaction mixture was then added to 1.5 L of methanol with stirring. After the completion of the addition, the mixture was stirred for one hour. The crystals that deposited were collected by filtration under suction and then dried. In this way, 404 g (88% yield) of the target compound (11) was obtained.

Synthesis of the Compound (13)

A three-neck flask was charged with 420 g of acetic acid. While the flask was cooled on an ice bath, 283 g of triethylamine was charged dropwise into the flask while the liquid temperature was kept at 50° C. or below. Further, 257 g of the compound (11) was charged into the flask and thereafter 109.3 g of the compound (12) was charged into the flask. After that, the reaction mixture was stirred at a liquid temperature of 90° C. for 5 hours and thereafter cooled to room temperature. The reaction mixture was then added to 2 L of methanol with stirring. After the completion of the addition, 292 mL of a concentrated aqueous solution of hydrochloric acid was added dropwise to the reaction mixture in methanol over a period of 30 minutes and the mixture was stirred for additional one hour. The crystals that deposited were collected by filtration under suction and then dried. In this way, 280 g (92% yield) of the target compound (13) was obtained.

Synthesis of the Compound (14)

A three-neck flask was charged with 260 g of the compound (13) and 1.2 L of ethanol. Then, while the reaction mixture was stirred, a solution prepared by dissolving 120 g of sodium hydroxide in 650 mL of water was added dropwise to the reaction mixture over a period of 30 minutes. After the completion of the dropwise addition, the reaction mixture was stirred for additional two hours. The reaction mixture was then added to 2.2 L of methanol with stirring. After the completion of the addition, 330 mL of a concentrated aqueous solution of hydrochloric acid was added dropwise to the reaction mixture in methanol over a period of 20 minutes and the mixture was stirred for additional one hour. The crystals that deposited were collected by filtration under suction and then dried. In this way, 241 g (99% yield) of the target compound (14) was obtained.

Synthesis of the Illustrative Compound (F-81)

A three-neck flask was charged with 109.4 g of the compound (14), 56.8 g of the compound (6), and 2.2 L of acetic acid. While the reaction mixture was stirred, 193 g of acetic anhydride was charged into the flask. After that, the reaction mixture was stirred at a liquid temperature of 100° C. for 2 hours and thereafter cooled to room temperature. The crystals that deposited were collected by filtration under suction and washed with solvents, that is, acetic acid, methanol, acetone and methanol, in that order. In this way, 384 g as methanol-wet cake of the illustrative compound (F-81) aimed at was obtained. Since the dye content of the substance thus obtained was 38.3%, the yield of the reaction was 97%.

(Synthesis-3) Synthesis of the Illustrative Compound F-118

The process for the synthesis of the illustrative compound F-118 is indicated by the following chemical formulae.

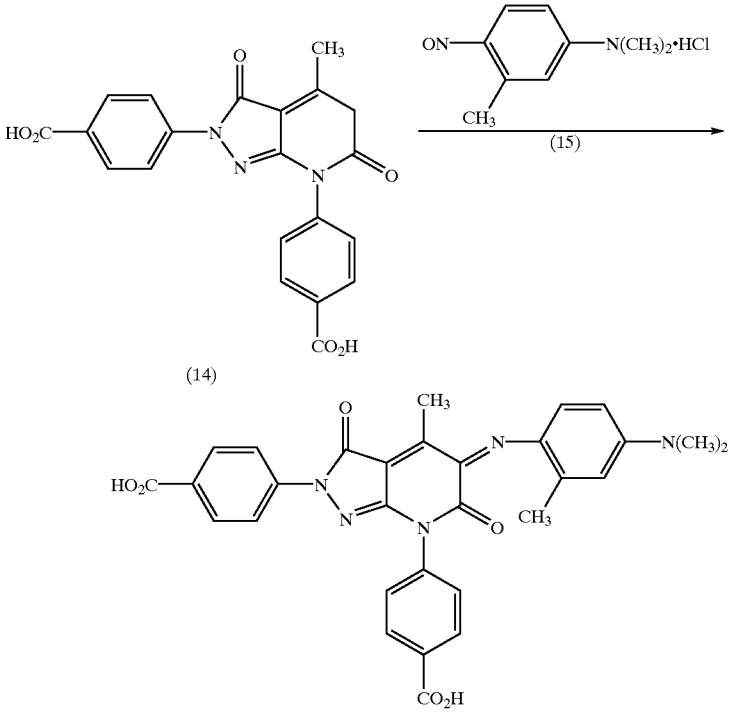

(illustrative compound F-118)

Synthesis of the Illustrative Compound F-118

A three-neck flask was charged with 20.3 g of the compound (14) and 60 mL of methanol. While the reaction mixture was stirred at room temperature, 7.0 mL of triethylamine was added dropwise to the reaction mixture over a period of 3 minutes. After the completion of the dropwise addition, 10.0 g of the compound (15) was added and thereafter 5.2 mL of acetic anhydride was added dropwise to the reaction mixture over a period of 10 minutes. The reaction mixture was stirred for additional 4 hours at room temperature and the crystals that deposited were collected by filtration under suction. The crystals thus obtained were added with 400 mL of methanol and 100 mL of acetone and the mixture was stirred. Next, while being washed with methanol, the crystals were collected by filtration under suction. In this way, 58.0 g as methanol-containing cake of the illustrative compound F-118 was obtained. Part of the cake was dried and the dye content was found to be 48.0% (99% yield).

The dye represented by the general formula (I) is used as a dispersion of solid fine powder (fine crystal particles) The dispersion of solid fine (crystal) particles of dye can be prepared in a mechanical way using, if desired, a proper solvent (water, alcohol, or the like), by a known pulverizing means (e.g., ball mill, vibration ball mill, planetary ball mill, sand mill, colloid mill, jet mill, roller mill, and so on) in the presence of a dispersant. The fine (crystal) particles of dye can also be obtained, for example, by a method wherein the dye is first dissolved in a proper solvent by using a dispersant and the solution is then added to a poor solvent of the dye to thereby deposit fine crystals, or by a method wherein the dye is first dissolved by controlling pH and then are converted into fine crystals by changing the pH. A layer containing fine powder of the dye can be obtained by preparing a solid dispersion of nearly uniform particles by dispersing the fine (crystal) particles obtained above in aproper binder and then coating the dispersion on a desired support. Alternatively, the layer containing the fine powder of the dye can be obtained by a coating a solution composed of a salt of dissociated dye on a support and then overcoating the layer with a primer and/or topcoat having an acidity in accordance with the pKa of the dissociative group to thereby disperse and fix the particles at the time of coating.

The binder is not particularly limited if it is a hydrophilic colloid which can be used for photosensitive layers (emulsion layers) and non-photosensitive layers. Normally, a naturally occurring polymer such as gelatin and the like or a synthetic polymer is used as the binder. The substances usable as the binder are, for example, protein such as gelatin derivatives, graft polymers made up of gelatin and other polymer, albumin or casein; cellulose derivatives, such as hydroxyethylcellulose, hydroxymethylcellulose, hydroxypropylcellulose, carboxymethylcellulose, ethylcellulose, methylcellulose, nitrocellulose, cellulose sulfate ester, and the like; saccharide derivatives, such as dextrin, sodium alginate, pectin, carboxymethyl starch, and the like; gum arabic, polyalkylene oxides, polyvinyl alcohol, modified polyvinyl alcohol described in JP-A No. 7-219,113, partially acetalized polyvinyl alcohol, polyvinyl butyral, poly-N-vinyl pyrrolidone, polyethyloxazoline, polyvinylmethyloxazoline, polyacrylic acid, polymethacrylic acid, acryloylmethylpropane/sulfonic acid copolymers, polymeric methacrylic acids such as those described in European Patent Application No. EP 678,770A2, and synthetic polymers, such as homopolymers and copolymers, e.g., copolymers of maleic acid, esters or amides thereof, polyacrylamide, polyvinylimidazole, polyvinylpyrazole, and so on. These substances may be added at the dispersing stage.

The dispersants may be known surface active agents. Examples of the dispersants include anionic dispersants, nonionic dispersants and combinations thereof described in U.S. Pat. No. 4,060,025, JP-A Nos. 62-215,272; 1-201,655; 4-125,548, U.S. Pat. No. 5,104,776, European Patent Application No. EP678,771A2, JP-A Nos. 63-11,935 and 63-60,446, amphoteric dispersants described in U.S. Pat. No. 3,542,581 and European Patent Application No. EP569,074A1, and fluorine-containing dispersants described in European Patent Application No. EP602,428A1. In particular, the use of anionic dispersants and/or nonionic dispersants is preferable. The anionic dispersants described in JP-A No. 4-324,858, oligomer-type polymers described in JP-A Nos. 60-158,437 and 7-13,300, and nonionic polymers described in U.S. Pat. No. 3,860,425 can be more preferably used. These can also be added after the dispersing operation. The amount to be used of the dispersant is 1 to 200% by weight based on the amount of the dye to be dispersed.

The average particle diameter of the fine particles of the dye in the dispersion of solid particles is 0.005 to 10 $\mu$m, preferably 0.01 to 1 $\mu$m, and more preferably 0.01 to 0.5 $\mu$m. It is preferably 0.01 to 0.1 $\mu$m in some cases.

Depending on the hue of the dye, the dispersion of the fine (crystal) particles of the dye represented by the general formula (I) can be used in any of a silver halide photosensitive layer and non-photosensitive layer. In the case where the dispersion of the fine (crystal) particles of the dye is incorporated in a non-photosensitive layer of a photosensitive material, for example a color negative photosensitive material, having an antihalation layer formed between a support and a silver halide emulation layer and a plurality of non-photosensitive layers, it is preferable that these layers are constructed such that a yellow filter layer is formed between a blue-sensitive silver halide photosensitive layer and a green-sensitive silver halide photosensitive layer; a magenta filter layer is formed between a green-sensitive silver halide photosensitive layer and red-sensitive silver halide photosensitive layer; and an antihalation layer is formed between a support and a red-sensitive silver halide photosensitive layer, and it is preferable that the dispersion of the fine (crystal) particles of the dye represented by the general formula (I) is incorporated in these non-photosensitive layers. Further, it is also possible to form a back layer on the support on the side opposite to the side having these silver halide photosensitive layers and non-photosensitive layers in order that the back layer contains the dispersion of the fine (crystal) particles of the dye represented by the general formula (I).

In the present invention, if non-photosensitive layers are formed as layers having the above-mentioned functions (such as antihalation layer, yellow filter layer, magenta filter layer, and the like), it is preferable that each of these non-photosensitive layers contains the dispersion of the fine (crystal) particles of the dye represented by the general formula (I).

In the present invention, the amount to be added of the dispersion the fine (crystal) particles of the dye represented by the general formula (I) to the photosensitive material (photosensitive layers and/or non-photosensitive layers) is in the range of from $5.0\times0^{-5}$to 5.0 g per $m^2$ of the photosensitive material. The amount is preferably in the range of from $5.0\times10^{-4}$ to 2.0 g and more preferably in the range of from $5.0\times10^{-3}$ to 1.0 g per $m^2$ of the photosensitive material. One or more kinds of the dyes may be incorporated in the same layer, or alternatively, one kind of the dye may be incorporated in a plurality of layers. Further, a known dye other than the dyes of the present invention may be used in combination, if necessary.

In the present invention, the use of the dispersion of the fine (crystal) particles of the dye represented by the general formula (I) alleviates the following problems. These problems are encountered in traditionally known processes, for example, a mordanting process wherein the dye molecule is fixed by the presence in the same layer of a hydrophilic polymer as a mordant which has an electric charge opposite to that of the dissociated anionic dye, and a process using a dispersion prepared from an oil-soluble dye finely dispersed or latex-dispersed in water or in a gelatin solution by use of an organic solvent having a high boiling point. The problems are undesirable influence on photographic properties such as reduction in sensitivity which is caused by the diffusion of dye to other layer due to insufficient fixation of the dye and image quality degradation caused by unnecessary absorption of the remaining color due to insufficient decolorization.

In the present invention, the dye represented by the general formula (I) (this dye is hereinafter referred to simply as "dye" upon occasion) is decolorized due to the reaction with a decolorizing agent when processed in the presence of the decolorizing agent.

Examples of the decolorizing agent include alcohol or phenols ($R_{51}OH$), amines or anilines ($(R_{52})_3N$), hydroxylamines ($(R_{52})_2NOR_{52}$), sulfinic acids ($R_{51}SO_2H$) or salts thereof, sulfurous acid or salts thereof, thiosulfuric acid or salts thereof, carboxylic acids ($R_{51}CO_2H$) or salts thereof, hydrazines ($(R_{52})_2NN(R_{52})_2$), guanidines ($[(R_{52})_2N]_2C{=}NH$), aminoguanidines ($(R_{52})_2NR_{52}N(R_{52}N)C'NH$), amidines, thiols ($R_{51}SH$), cyclic or chain-like active methylene compounds ($Z_{53}$—$CH_2$—$Z_{54}$), cyclic or chain-like methylene compounds ($Z_{53}CH(R_{51})$—$Z_{54}$) or $Z_{53}$—$CH(Z_{54})$—$Z_{55}$), where $Z_{55}$ is the same as $Z_{53}$ and where $Z_{53}$, $Z_{54}$, and $Z_{55}$ (or $R_{51}$) may join with each other to form a ring, and anionic species derived from these compounds.

In the compounds described above, $R_{51}$ represents an alkyl group, an alkenyl group, a cycloalkyl group, an aryl group or a heterocyclic group, while $R_{52}$ represents a hydrogen atom or the same group as $R_{51}$. Each of $R_{51}$ and $R_{52}$ may have a substituent group. If a plurality of $R_{51}$ or $R_{52}$ are present in the molecule, they may be the same or different. $Z_{53}$ and $Z_{54}$ are each selected from the group consisting of —CN, —$SO_2R_{51}$, —$COR_{51}$, —$COOR_{51}$, —$CON(R_{52})_2$, —$SO_2N(R_{52})_2$, —$C[{=}C(CN)_2]R_{51}$, and —$C[{=}C(CN)_2]N(R_{51})_2$ wherein $Z_{53}$ may be the same as or different from $Z_{54}$, and $Z_{53}$ and $Z_{54}$ may join together to form a ring.

Among these compounds, preferable are hydroxylamines, sulfinic acids, sulfurous acid, guanidines, aminoguanidines, heterocyclic thiols, cyclic or chain-like active methylene compounds and active methine compounds. Particularly preferable are guanidines and aminoguanidines.

These decolorizing agents may be incorporated into photosensitive materials at the preparation thereof, or these decolorizing agents may be added to the photosensitive materials by an appropriate method when the photosensitive materials are processed. Preferably, a processing material contains the decolorizing agent and the decolorizing agent is transferred to the photosensitive material at the time of thermal processing. When added, these decolorizing agents may be in the form of precursors.

The decolorizing agent is thought to make contact with dye molecules to undergo nucleophilic addition to the dye molecule so that the dye is decolorized when the photosensitive material is processed. As a preferable procedure, a dye-containing silver halide photosensitive material after imagewise exposure or at the time of imagewise exposure thereof is put together with a processing material, which contains a decolorizing agent or a precursor thereof, face to face in the presence of water, and then these materials are heated. When these materials are separated from each other after the heating step, a colored image is obtained in the silver halide photosensitive material and the dye is decolorized. In this case, the concentration of the dye after the decolorization is one third or less and preferably one fifth or less of the original concentration. The molar amount of the decolorizing agent to be used is in the range of 0.1 to 200 times and preferably 0.5 to 100 times that of the dye.

In the present invention, a photosensitive material, which comprises a transparent support having thereon at least three photosensitive layers, each layer containing at least photosensitive silver halide grains, a color developing agent, a coupler and a binder wherein the photosensitive wavelength regions differ each other and the absorption wavelength regions of the dyes to be formed from the developing agent and the coupler differ each other, and a processing material, which comprises a support having thereon a processing layer containing at least a base and/or base precursor, are used. These photosensitive material and processing material are placed face to face in such a manner that the photosensitive layer side of the photosensitive material and the processing layer side of the processing material are put together in the presence of water in an amount ranging from 1/10 to the equivalent of an amount which is required for the maximum swelling of the total of the layers of the photosensitive material and the processing material except for back layers thereof. These materials are heated, while being put together, for 1 to 120 seconds, preferably for 5 to 60 seconds, in such a manner that the temperature of the faces put together ranges from 50 to 100° C., preferably from 60 to 100° C., to thereby form an image based on the non-diffusive dyes of at least three colors. Furthermore, it is desirable to obtain a color image on other recording material based on the image information obtained in the above-described procedure. Needless to say, the same condition as the above-described condition can be applied to the formation of an image of a single color.

The photosensitive silver halide usable in the present invention (silver halide that contributes to the image formation) may be any of silver iodobromide, silver bromide, silver chlorobromide, silver iodochloride, silver chloride, and silver iodochlorobromide, and mixtures thereof. The grain size of the silver halide is preferably 0.1 to 2 $\mu$m and most preferably 0.2 to 1.5 $\mu$m based on the diameter of a sphere having an equivalent volume.

The shape of the silver halide grain may be selected from a regularly structured crystal such as a cube, octahedron, or tetradecahedron, and a tabular shape such as a hexagon or rectangle. Among these shapes, preferred is a tabular shape having an aspect ratio of 2 or more, more preferably an aspect ratio of 8 or more, and most preferably an aspect ratio of 20 or more. It is preferable to use an emulsion in which these tabular grains account for 50% or more, preferably 80% or more, and most preferably 90% or more of the projected area of the total grains.

In addition, preferably used are grains which have a further high aspect ratio and having a thickness less than 0.07 $\mu$m as described in U.S. Pat. Nos. 5,494,789; 5,503,970; 5,503,971; 5,536,632 and others.

Furthermore, preferably used are tabular grains which are rich in silver chloride and has (111) face as a main plane as described in U.S. Pat. Nos. 4,400,463; 4,713,323; 5,217,858 and others, and tabular grains which are rich in. silver chloride and has (100) face as a main plane as described in U.S. Pat. Nos. 5,264,337; 5,292,632; 5,310,635 and others.

Examples in which these silver halide grains are actually used are described in JP-A Nos. 9-274,295; 9-319,047; 10-115,888 and others.

It is preferable that the silver halide emulsion for the formation of the photosensitive layers in the present invention are normally chemically sensitized and spectrally sensitized.

As for the chemical sensitization, a chalcogen-sensitization method wherein sulfur, selenium or tellurium is used, a noble metal sensitization wherein gold, platimun, iridium or the like is used, a reductive sensitization method wherein a high sensitivity is obtained by introducing reductive silver nuclei using a properly reductive compound during grain formation, and a combination of these methods can be used.

As for the spectral sensitization, so-called spectrally sensitizing dyes, which are adsorbed on silver halide grains and make the grains sensitive to the wavelengths within the region of the absorption wavelengths of the dyes themselves, are used. Examples of these dyes include cyanine dyes, merocyanine dyes, complex cyanine dyes, complex merocyanine dyes, holopolar dyes, hemicyanine dyes, styryl dyes, hemioxonol dyes, and so on. These spectrally sensitizing dyes are used singly or in combinations. It is also preferable to use these dyes is combination with a super-sensitizing agent.

In the present invention, it is preferable to add a variety of stabilizers to the silver halide emulsion for photosensitive layers in order to prevent the fogging or to improve the storage stability. Examples of these stabilizers include nitrogen-containing heterocyclic compounds, such as azaindenes, triazoles, tetrazoles and purines, and mercapto compounds such as mercaptotetrazoles, mercaptotriazoles, mercaptoimidazoles and mercaptothiadiazoles.

As for the photographic additives for silver halide emulsions, preferably employed are those described in Journal of Research Disclosure Nos. 17,643 (December, 1978), 18,716 (November, 1979), 307,105 (November, 1989), 38,957 (September, 1996), and others.

The amount to be coated of the silver halide emulsion is generally 0.05 to 20 g/m$^2$ and preferably 0.1 to 10 g/m$^2$ based on silver.

The binder of the photosensitive material is preferably a hydrophilic binder. Examples the hydrophilic binders include those described in the above-cited Journal of Research Disclosure and JP-A No. 64-13,546, pages 71–75. Among these binders, particularly preferred are gelatin and a combination of gelatin with other water-soluble binder such as polyvinyl alcohol, modified polyvinyl alcohol, a cellulose derivative, acrylamide, or the like. The amount to be coated of the binder is generally 1 to 20 g/m$^2$, preferably 2 to 15 g/m$^2$, and more preferably 3 to 12 g/m$^2$. The proportion of gelatin in the binder is generally 50 to 100% and preferably 70 to 100%.

The color developing agent (or precursor thereof) for use in the photosensitive material of the present invention is preferably carbamoyl hydrazine whose structure is described in JP-A No. 8-286,340, p-phenylene diamines, or p-aminophenols. More preferably, the compounds represented by the following general formula (a) or (b) are used as the color developing agent (or precursor thereof).

Examples of the nucleophilic partial structure included in Z (═indicates non-covalent electron pair and the atom underlined by═has nucleophilicity)

General formula (a)

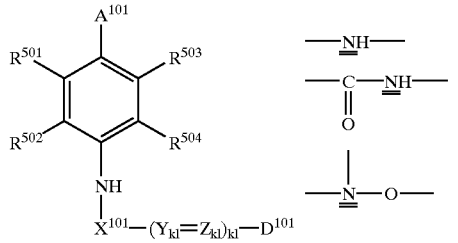

General formula (b)

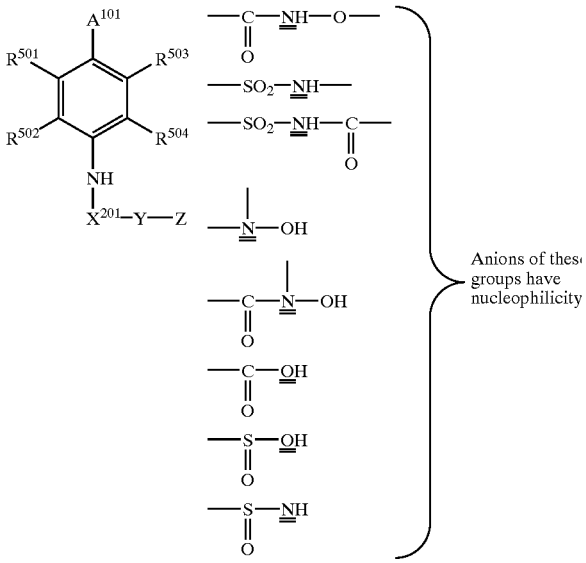

In the general formulae (a) and (b), $R^{501}$ to $R^{504}$ each represent a hydrogen atom or a substituent group. Specific examples of the substituent group include the following groups.

A halogen atom (e.g., a chlorine or bromine atom), an alkyl group (e.g., a methyl, ethyl, isopropyl, n-butyl, or t-butyl group), an aryl group (e.g., a phenyl, tolyl, or xylyl group), an carbonamide group (e.g., an acetylamino, propionylamino, butyloylamino, or benzoylamino group), an sulfonamide group (e.g., a methanesulfonylamino, ethanesulfonylamino, benzenesulfonylamino, or toluenesulfonylamino group), an alkoxy group (e.g., a methoxy or ethoxy group), an aryloxy group (e.g., a phenoxy group), an alkylthio group (e.g., a methylthio, ethylthio, or butylthio group), an arylthio group (e.g., a phenylthio or tolylthio group), an carbamoyl group (e.g., a methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl ethylphenylcarbamoyl, or benzylphenylcarbamoyl group), a sulfamoyl group (e.g., a methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl, or benzylphenylsulfamoyl), a cyano group, a sulfonyl group (e.g., a methanesulfonyl, ethanesulfonyl, phenylsulfonyl, 4-chlorophenylsulfonyl, or p-toluenesulfonyl group), an alkoxycarbonyl group (e.g., a methoxycarbonyl, ethoxycarbonyl, or butoxycarbonyl group), an aryloxycarbonyl group (e.g., a phenoxycarbonyl group), an acyl group (e.g., an acetyl, propionyl, or butyloyl, benzoyl, or alkylbenzoyl group), a ureido group (e.g., a methylaminocarbonamide or diethylaminocarbonamide group), a urethane group (e.g., a methoxycarbonamide or butoxycarbonamide group), and an acyloxy group (e.g., an acetyloxy, propionyloxy, or butyloyloxy group).

Among $R^{501}$ to $R^{504}$, $R^{502}$ and/or $R^{504}$ are each a hydrogen atom. If $A^{101}$ is a hydroxyl group, the sum of Hammett constants σ p of $R^{501}$ to $R^{504}$ is preferably 0 or more, while if $A^{101}$ is a substituted amino group, the sum of Hammett constants σ p of $R^{501}$ to $R^{504}$ is preferably 0 or less.

$A^{101}$ represents a hydroxyl group or a substituted amino group (e.g., a dimethylamino, diethylamino, or ethylhydroxyethylamino group) and is preferably a hydroxyl group.

In the general formula (a), $X^{101}$ represents a linking group having a valency of 2 or more and selected from the group consisting of —CO—, —SO—, —$SO_2$—, and $(Q^{101})P(=O)$— (where $Q^{101}$ represents a monovalent substituent group attached to P and specific examples of the substituent group include $-(Y_{k1}=Z_{k1})-D^{101}$ in addition to the groups listed as the substituent groups of the aforementioned $R^{501}$ to $R^{504}$; and O is linked to P by way of a double bond).

$Y_{k1}$ and $Z_{k1}$ each represents a nitrogen atom or a group represented by $-CR^{505}=$(where $R^{505}$ represents a hydrogen atom or a substituent group). Examples of $R^{505}$ include the groups listed as the substituent groups of the aforementioned $R^{501}$ to $R^{504}$.

k1 is an integer of 0 or greater, and is preferably 0, 1 or 3, more preferably 0 or 1, most preferably 0.

$D^{101}$ represents a proton-dissociative group or a group capable of becoming a cation and having a function to sever the N-$X^{101}$ linkage and to form a dye by the detachment of a substituent group from the coupling position of coupler, triggered by electron transfer from $D^{101}$, after the oxidized product of a compound, which is produced by an oxidation/reduction reaction between a compound represented by the general formula (a) and a silver halide, undergoes a coupling reaction with the coupler. More specifically, after the coupling reaction, electron transfer takes place toward the coupling position from the anion produced by proton dissociation or the non-covalent electron pair of the atom capable of becoming a cation on $D^{101}$ to thereby produce a double bond between $X^{101}$ and $Y_{k1}$ (between $X^{101}$ and $D^{101}$ when k1 is 0). As a result, the N-$X^{101}$ linkage is severed and the substituent group on the coupler side is detached as an anion simultaneously with the formation of the double bond between the coupling position on the coupler and the N atom. This series of electron transfer mechanism causes the formation of a dye and detachment of the substituent group. As atoms having the above-mentioned functions, examples of the proton-dissociative atom include an oxygen atom, a sulfur atom, a selenium atom, and a nitrogen or carbon atom substituted by an electron-attractive group or an electron-rich aromatic group (e.g., an aryl or heteroaromatic group). On the other hand, examples of the atom capable of becoming a cation include a nitrogen atom, a sulfur atom, and so on.

$D^{101}$ is a substituent group containing an atom capable of becoming a trigger for the above-described electron transfer and the atom may be substituted by a variety of substituent groups. The atom may be substituted, for example, by the following groups. An alkyl group (e.g., a methyl, ethyl, isopropyl, n-butyl, or t-butyl group), an aryl group (e.g., a phenyl, tolyl, or xylyl group), an carbonamide group (e.g., an acetylamino, propionylamino, butyloylamino, or benzoylamino group), an sulfonamide group (e.g., a methanesulfonylamino, ethanesulfonylamino, benzenesulfonylamino, or toluenesulfonylamino group), an alkoxy group (e.g., a methoxy or ethoxy group), an aryloxy group (e.g., a phenoxy group), an alkylthio group (e.g., a methylthio, ethylthio, or butylthio group), an arylthio group (e.g., a phenylthio or tolylthio group), an carbamoyl group (e.g., amethylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl ethylphenylcarbamoyl, or benzylphenylcarbamoyl group), a sulfamoyl group (e.g., a methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl, or benzylphenylsulfamoyl), a cyano group, a sulfonyl group (e.g., a methanesulfonyl, ethanesulfonyl, phenylsulfonyl, 4-chlorophenylsulfonyl, or p-toluenesulfonyl group), an alkoxycarbonyl group (e.g., a methoxycarbonyl, ethoxycarbonyl, or butoxycarbonyl group), an aryloxycarbonyl group (e.g., a phenoxycarbonyl group), an acyl group (e.g., an acetyl, propionyl, or butyloyl, benzoyl, or alkylbenzoyl group), an acyloxy group (e.g., an acetyloxy, propionyloxy, or butyloyloxy group), a ureido group, a urethane group, and a heterocyclic group (e.g., a pyridyl, furyl, or quinolyl group).

Particularly preferred as $D^{101}$ are an aralkyl group (a benzyl group in particular), an anilino group, a heterocyclic group, a methylene group substituted by an electron-attractive group, and a methine group. These groups may be substituted by a substituent group and examples of the substituent group include a hydroxyl group and the groups listed as the substituent groups of the aforementioned $R^{501}$ to $R^{504}$. Further, at least two atoms or substituent groups selected from $Y_{k1}$, $Z_{k1}$- and $D^{101}$ may join together to form a ring.

In the general formula (b), $X^{201}$ represents a linking group having a valency of 2 or more and selected from the group consisting of —CO—, —SO—, —$SO_2$, and —P(═O)<.

Z represents a nucleophilic group having a function to form a dye by attacking the carbon, sulfur or phosphorus atom of $X^{201}$, after the oxidized product of a compound, which is produced as a result of reduction of a silver halide by a compound represented by the general formula (b), undergoes a coupling reaction with a coupler.

What causes nucleophilicity in the nucleophilic group are, as generally observed in the field of organic chemistry, an atom having a non-covalent electron pair (e.g., a nitrogen, phosphorus, oxygen, sulfur, or selenium atom) and an anionic species (e.g., a nitrogen, oxygen, carbon, or sulfur anion). Examples of the nucleophilic group include the groups having aforementioned partial structures or dissociated forms thereof.

Y represents a divalent linking group. The linking group is a group which links Z to such a position that conveniently enables the intramolecular nucleophilic attack on $X^{201}$. Actually, when the nucleophilic group nucleophilically attacks $X^{201}$, the transitional state preferably has atoms linked together such that a 5- or 6-membered ring can be formed.

Preferred examples of Y include a 1, 2- or 1,3-alkylene group, a 1,2-cycloalkylene group, a Z-vinylene group, a 1,2-arylene group, a 1,8-naphthylene group, and so on.

$R^{501}$ and $R^{502}$ may join together to form a ring. $R^{503}$ and $R^{504}$ may join together to form a ring. Preferred examples of these rings are 5~6-membered carbon rings or heterocyclic rings.

In the present invention, the compounds represented by the general formula (a) or (b) are preferably oil-soluble compounds. In other word, it is preferable that the compounds represented by the general formula (a) or (2) each have at least one group which has a ballasting property. The term "ballast group" as used herein means a group which imparts the oil-solubility and comprises an oil-soluble partial structure having 8 to 80, preferably 10 to 40, carbon atoms. Because of this, it is preferable that at least one of $R^{501}$~$R^{502}$, $Y_{k1}$, $Z_{k1}$ and $D^{101}$ in the general formula (a), and $X^{201}$, Y and Z in the general formula (b) has a substituent group having 8 or more carbon atoms.

The color developing agent represented by the general formula (a) or (b) can be added to the silver halide photographic photosensitive material in the following way. First, a coupler, the color developing agent, and an organic solvent having a high boiling point (e.g., an alkyl ester of phosphoric acid, an alkyl ester of phthalic acid, or the like) are mixed together and thereafter dissolved in a solvent having a low boiling point (e.g., ethyl acetate, methyl ethyl ketone, or the like). The solution thus prepared is dispersed in water by an emulsifying method known in the art and the dispersion is added to the photosensitive material. Further, the addition can also be made by the solid dispersion method described in JP-A No. 63-271,339.

The amount to be added of the color developing agent represented by the general formula (a) or (b) has a wide range. But, the amount is preferably 0.01 to 100 times, more preferably 0.1 to 10 times, the molar amount of the coupler.

Although a single color developing agent or a combination of a plurality of color developing agents may be used, the total amount is generally 0.05 to 20 mmol/$m^2$ and preferably 0.1 to 10 mmol/$m^2$.

Specific examples of the compounds (color developing agents D-1 to D-115) represented by the general formula (a) or (b) are given below. It should be understood that the present invention is not limited by these specific examples.

D-1
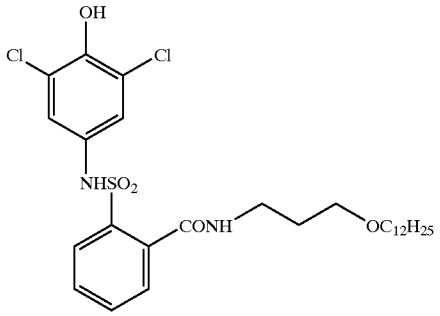
D-2
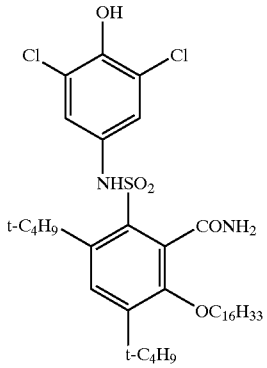
D-3
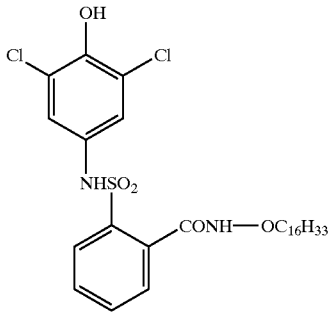
D-4
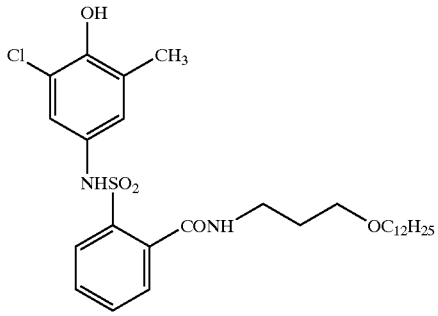
D-5
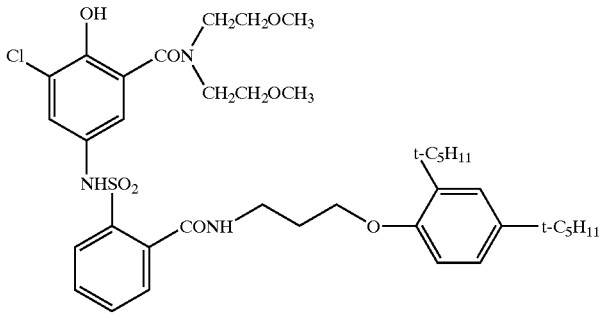
D-6
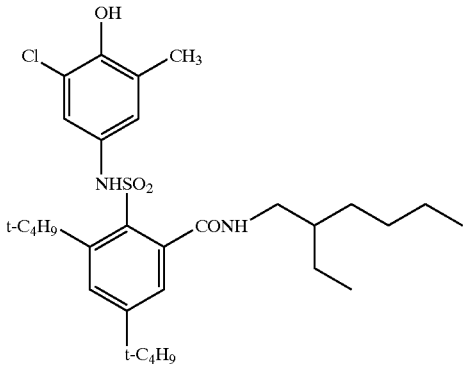
D-7
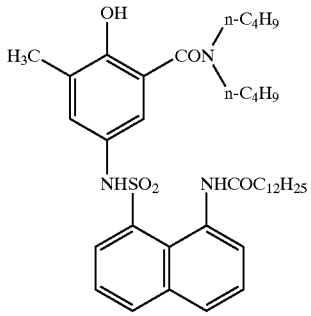

-continued
D-8
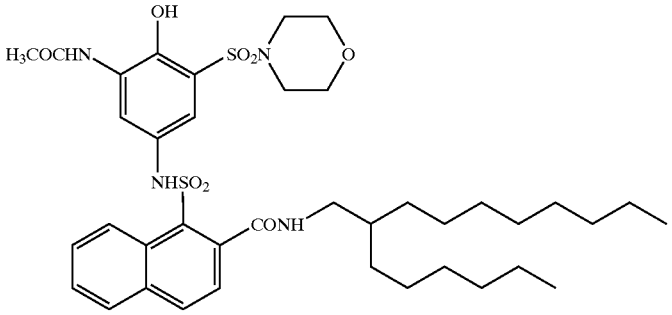
D-9
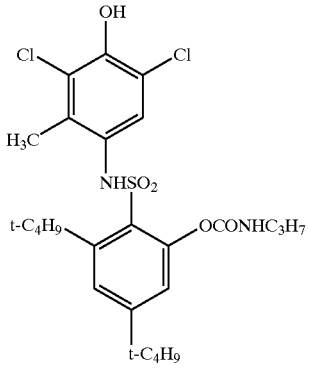
D-10
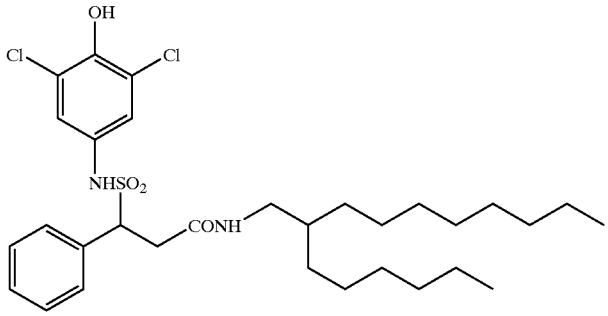
D-11
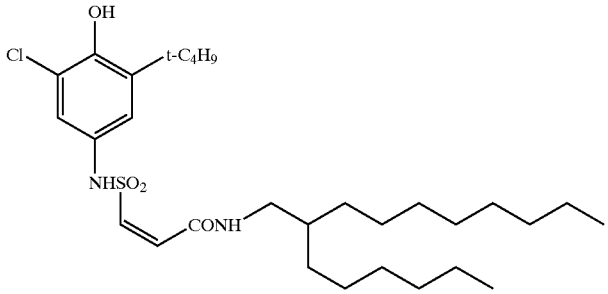

-continued
D-12
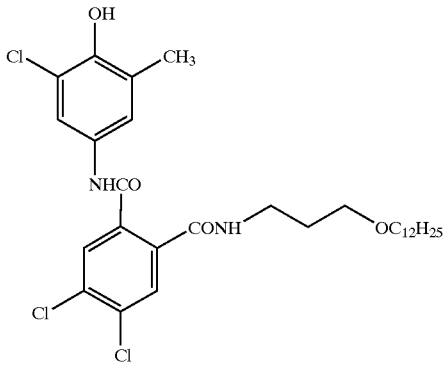
D-13
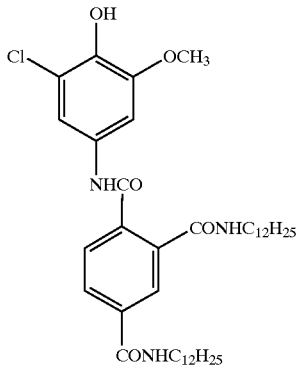
D-14
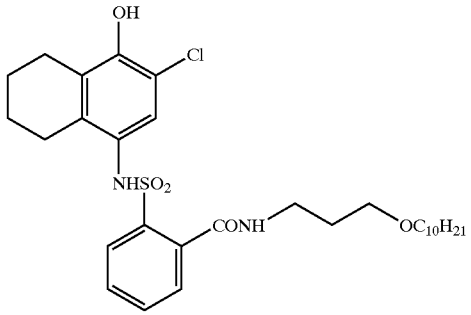
D-15
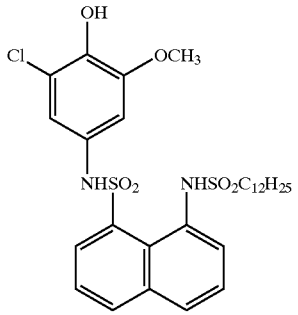
D-16
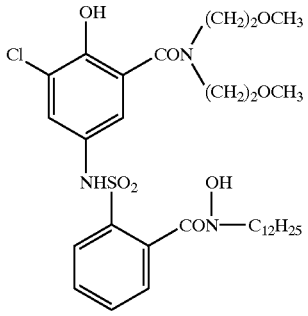
D-17
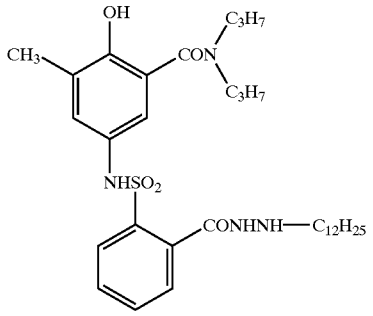
D-18
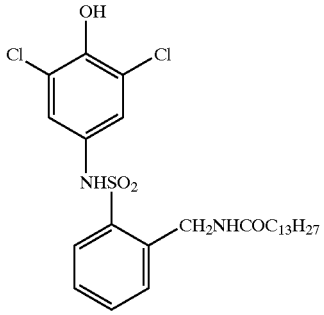
D-19
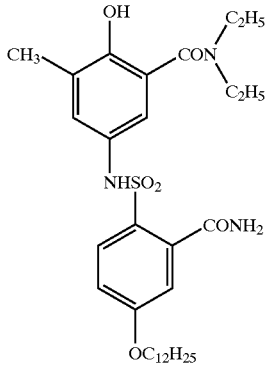

-continued
D-20
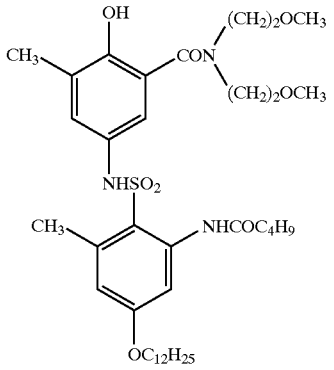
D-21
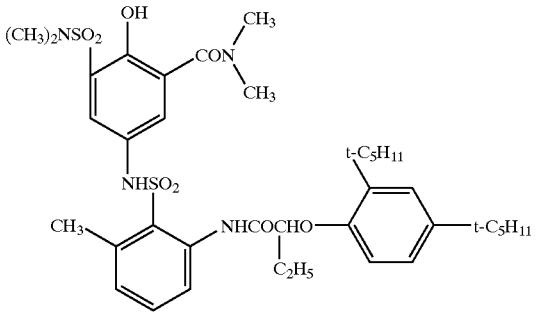
D-101
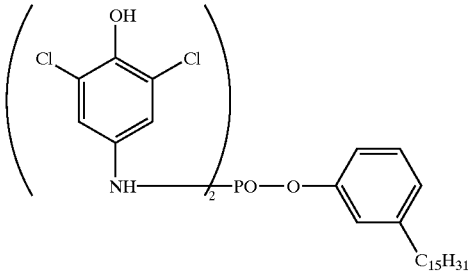
D-102
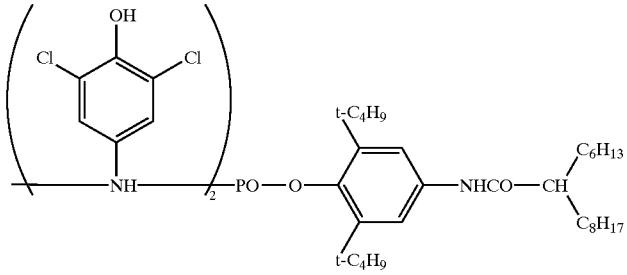
D-103
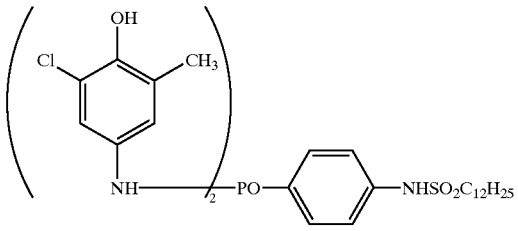
D-104
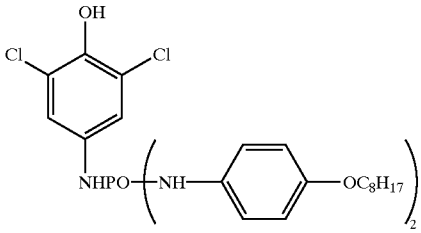
D-105
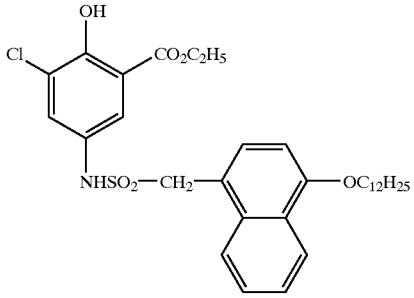
D-106
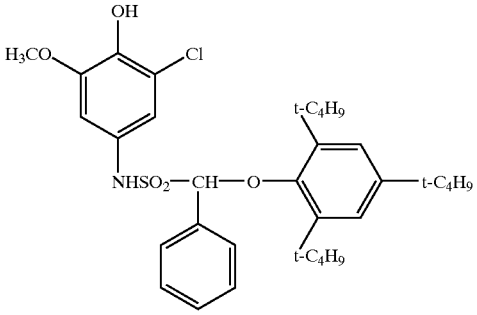

-continued
D-107
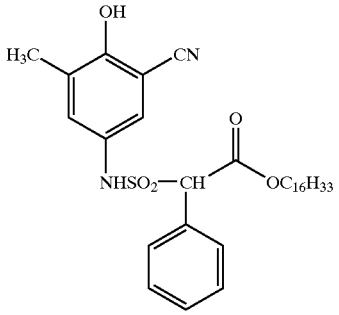
D-108
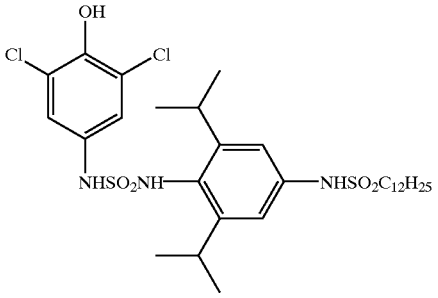
D-109
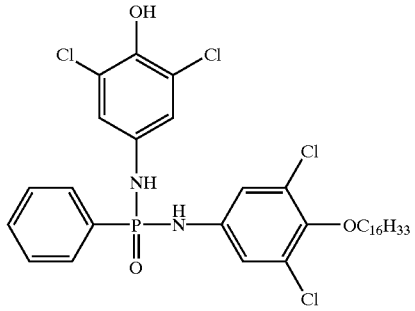
D-110
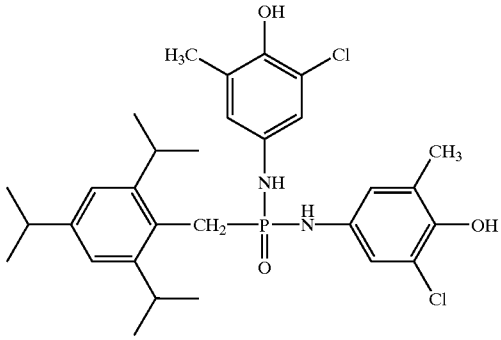
D-111
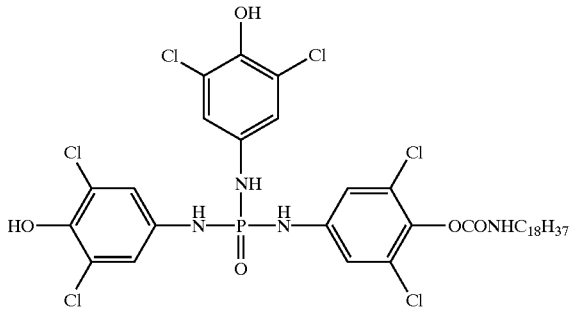
D-112
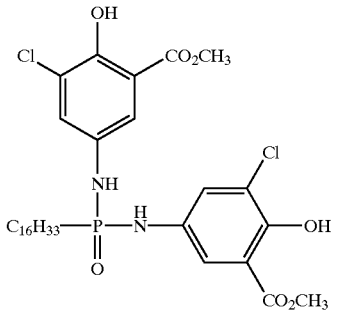
D-113
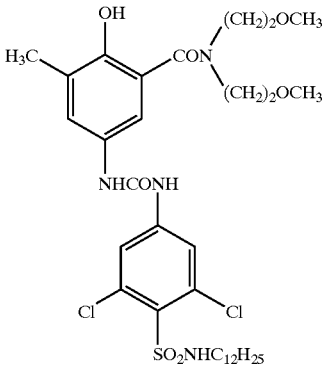

-continued

D-114

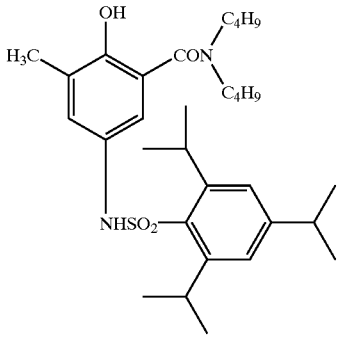

D-115

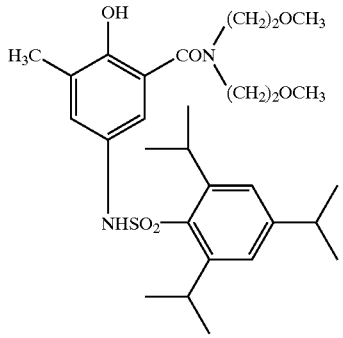

A coupler, which undergoes a coupling reaction with the oxidized product of the color developing agent to form a dye, is used in the photosensitive layer of the photosensitive material. Preferred examples of the coupler include compounds generally called active methylenes, 5-pyrazolones, pyrazoloazoles, phenols, naphthols and pyrrolotriazoles. Specific examples of these couplers are those cited in Journal of Research Disclosure No. 38,957 (June, 1996), pp.616–624. Particularly preferred examples of the coupler include the pyrazoloazole couplers described in JP-A No. 8-110,608, and the pyrrolotriazole couplers described in JP-A Nos. 8-122,994 and 9-218,496. The amount to be used of the coupler is generally 0.05 to 10 mmol/$m^2$, preferably 0.1 to 5 mmol/$m^2$, for each color.

It is also possible to use a colored coupler, which compensates the unnecessary absorption of coloring dyes, and a compound (including a coupler) which reacts with the oxidized product of the color developing agent to release a photographically useful residue of compound, e.g., a development suppressor.

Normally, the photosensitive material comprises 3 or more photosensitive layers each having a different sensitivity to color. Each photosensitive layer contains at least one-silver halide emulsion layer, and, in a typical example, the photosensitive layer comprises a plurality of silver halide emulsion layers each having substantially the same sensitivity to color but a different photosensitivity. The photosensitive layer is a unit photosensitive layer having sensitivity to any one of blue light, green light and red light. In a multi layered silver halide color photographic photosensitive material, a generally adopted order of the unit photosensitive layers from the support side is a red-sensitive layer, a green-sensitive layer and a blue-sensitive layer. However, depending on the purpose, this order may be reversed, or photosensitive layers sensitive to the same color may sandwich a photosensitive layer sensitive to a different color. The total thickness of the photosensitive layer is generally 1 to 20 $\mu$m and preferably 3 to 15 $\mu$m.

The silver halide, the color developing agent and the coupler may be incorporated in the same photosensitive layer or in different photosensitive layers. A non-photosensitive layer, such as a protective layer, a primer layer, an intermediate layer, the aforementioned yellow filter layer and antihalation layer, and the like, may be formed in addition to the photosensitive layer. Further, a back layer may be formed on the reverse side of the support. The total thickness of the. layers on the photosensitive layer side is generally 3 to 25 $\mu$m and preferably 5 to 20 $\mu$m.

For various purposes, the photosensitive material may contain such agents as a hardener, a surfactant, a photographic stabilizer, an antistatic agent, a slicking agent, a matting agent, a latex, a formalin scavenger, a dye, a UV absorber, and so on. Specific examples of these agents are described in the Journal of Research Disclosure cited above, JP-A No. 9-204,031, and others. Particularly preferred examples of the antistatic agent are fine particles of metal oxide such as ZnO, $TiO_2$, $SnO_2$, $Al_2O_3$, $In_2O_3$, $SiO_2$, MgO, BaO, $MoO_3$, $V_2O_5$, and the like.

As for the support of the photosensitive material, preferable are supports for use in photography as described in "Fundamentals of Photographic Engineering—Silver Salt Photography Section", pp.223–240, edited by Photographic Society of Japan, published by Corona Co., Ltd., 1979. Specific examples of the support include polyethylene terephthalate, polyethylene naphthalate, polycarbonate, syndiotactic polystyrene, celluloses (e.g., triacetylcellulose), and so on.

For the purpose of improvement of optical properties and physical properties, these supports may be subjected to a heat treatment (control of degree of crystallization and orientation), uniaxially or biaxially stretching (control of orientation), blending with other polymers, a surface treatment, and so on.

It is preferable to use a support having a magnetic recording layer, described, for example in JP-A Nos. 4,124,645; 5-40,321; 6-35,092 and 6-31,875, so that the photographing information and others can be recorded.

It is also preferable that the reverse side of the support is coated with a water-proof polymer such as the one described in JP-A No. 8-292,514.

Details of the polyester support, which is particularly preferred for use in the above-described photosensitive material having a magnetic recording layer, are described in Journal of Technical Disclosure No. 94-6023 (issued on Mar. 15, 1994 from The Japan Institution of Innovation and Invention).

The thickness of the support is generally 5 to 200 $\mu$m and preferably 40 to 120 $\mu$m.

The combination, as a base precursor, of a basic metal compound poorly soluble in water and a compound which can cause a complex forming reaction with the metal ion constituting the metal compound (referred to as complex forming compound) is described in JP-A No. 62-12,848, European Patent Application Laid-Open No. 210,660A2, U.S. Pat. No.4,740,445, and others.

The basic metal compounds, poorly soluble in water, for use in the photosensitive material are oxides, hydroxides, and basic carbonates of zinc or aluminum, and most preferably zinc oxide, zinc hydroxide, and zinc basic carbonate.

The basic metal compounds poorly soluble in water is utilized as a dispersion of fine particles in a hydrophilic binder as described in JP-A No. 59-174,830. The average particle diameter of the fine particles is 0.001 to 5 μm and preferably 0.01 to 2 μm. The content of the basic metal compound in the photosensitive material is 0.01 to 5 g/m$^2$ and preferably 0.05 to 2 g/m$^2$.

The complex forming compound to be used in the processing material is a compound known as a chelating agent in analytical chemistry and a compound known as a softener for hard water in photographic chemistry. Details of the complex forming compound are described in the official gazettes cited above and also in A. Ringbom, "Complex Forming Reaction", translated by N. Tanaka and H. Sugi (sangyo Tosho Publishing Co., Ltd.). The complex forming compound preferable as the one for use in the present invention is a water-soluble compound. Example of the compound include an aminopolycarboxylic acid (including salt thereof) such as ethylenediaminetetraacetic acid, nitrilotriacetic acid, diethylenetriaminepentaacetic acid or the like, an aminophosphonic acid (salt) such as aminotris (methylenephosphonic acid), ethylenediaminetetramethylenephosphonic acid or the like, pyridinecarboxylic acid (salt) such as 2-picolinic acid, pyridine-2,6-dicarboxylic acid, 5-ethyl-2-picolinic acid or the like. Among these compounds, the pyridinecarboxylic acid (salt) is particularly preferable.

In the present invention, it is preferable that the complex forming compound is used as a salt produced by neutralization with a base. In particular, preferred examples are salts with organic bases such as guanidines, amidines, hdyroxytetraalkylammoniums, and the like, and salts with alkaline metals such as sodium, potassium, lithium and the like as well as mixtures of these salts. Specific examples of these preferred complex forming compounds are described in above-cited JP-A No. 129,848, European Patent Application Laid-Open No. 210,660A2, and others. The content of the complex forming compound in the processing material is 0.01 to 10 g/m$^2$and preferably 0.05 to 5 g/m$^2$.

The processing material may contain a mordant and the mordant is preferably a polymeric one.

As described in JP-A No. 9-146,246, the processing material may contain physical development nuclei such colloidal silver or palladium sulfide and a solvent for silver halide such as hydantoin so that the silver halide in the photosensitive material is solubilized simultaneously with development and fixed to the processing material.

Further, the processing material may contain a development stopper, a printout preventing agent, and so on.

The processing material may have a protective layer, a primer layer, a back layer, and other auxiliary layers besides the processing layer.

The processing material is preferably composed of a continuous web and a processing layer coated thereon in order that part of the processing material, after being fed from delivery rolls and used in processing, does not need to be cut and is wound on other roll. This example is described in JP-A No. 9-127,670.

The support for the processing material is not particularly limited and plastic films or paper, such as those listed in the explanation of the photosensitive material, may be used. The thickness is 4 to 120 μm and preferably 6 to 70 μm.

The film which is vacuum-deposited with aluminum and is described in JP-A No. 9-222,690 can be preferably used.

One of the methods for supplying water at the time of heat development is a method wherein a photosensitive material or processing material is immersed in water and thereafter the excess water is removed by means of a squeezing roller. Other preferred method is described, for example, in JP-A No. 10-26,817. This method uses a water spraying apparatus comprising a plurality of nozzles which eject water and are linearly arranged at certain intervals in the direction perpendicular to the direction of the transfer of the photosensitive material or processing material and also actuators which displace the nozzles in the direction of the photosensitive material or processing material being transferred. Further, a method wherein water is coated with of a sponge or the like onto the photosensitive material or processing material is also suitable.

Examples of the heating method in the developing process include a method in which the materials are brought into contact with a heated block or plate, and a method which employs a heat roller, a heat drum, or an infrared or far infrared lamp.

In the present invention, a separate bleaching/fixing step, intended for the removal of the silver halide remaining in the photosensitive material after development or for further removal of the developed silver, is not essential. However, a fixing step and/or a bleaching step may be employed in order to lessen the load on reading image information and to enhance the storage stability of images. If these steps employed, although these steps may be carried out by ordinary treatments using liquids, it is preferable to employ a step in which the photosensitive material is heated after being put together with other sheet coated with a processing agent as described in JP-A No. 9-258,402.

According to the present invention, after an image is obtained on the photosensitive material, it is preferable to use the image to obtain a color image on other recording material. Although this process may be performed by an ordinary projection exposure using a photosensitive material such as color paper, a preferred method for this purpose comprises the steps of photoelectrically reading the image information by measuring the intensity of the transmitted light, converting the data into digital signals, and outputting the signals onto other recording material after image treatment. The material on which the output is made may be a sublimation-type heat sensitive recording material, a full-color direct heat-sensitive recording material, an ink-jet material, an electro-photographing material, or the like in addition to a photosensitive material using silver halide.

Besides, the photosensitive material of the present invention can also be developed by a liquid-based developing method for ordinary photosensitive materials described in Journal of Research Disclosures No. 17,642, pp.28–29, No. 18,716, pp.651, left to right column, and No. 307,105, pp.880–881, each cited previously.

EXAMPLES

In order to better explain the present invention, the following examples are given by way of illustration and not by way of limitation. In the following examples and comparative examples, "%" means "weight %" unless otherwise specified.

Preparation of Photosensitive Emulsion

A mixture of 0.74 g of gelatin having an average molecular weight of 15,000, 0.7 g of potassium bromide, and 930 mL of distilled water was placed in a reaction vessel, and thereafter the temperature of the mixture was raised to 40° C. To this solution, which was vigorously stirred, there were added 30 mL of an aqueous solution containing 0.34 g of silver nitrate and 30 mL of an aqueous solution containing 0.24 g of potassium bromide over a period of 20 seconds. Upon completion of the addition, after the reaction solution was kept at 40° C. for 1 minute, the temperature was raised to 75° C.

Next, 27.0 g of gelatin and 200 mL of distilled water were added together to the reaction solution. After that, 100 mL of an aqueous solution containing 23.26 g of silver nitrate and 80 mL of an aqueous solution containing 16.37 g of potassium bromide were added to the reaction solution over a period of 36 minutes in such a manner that the flow rate of the addition was gradually increased. Further, 250 mL of an aqueous solution containing 83.2 g of silver nitrate and an aqueous solution containing potassium iodide and potassium bromide at a molar ratio of the former to the latter of 3:97 (having a potassium bromide concentration of 26%) were added to the reaction solution over a period of 60 minutes in such a manner that the flow rate of the addition was gradually increased and that the silver potential of the reaction solution was −20 mV with reference to a saturated calomel electrode. Furthermore, 75 mL of an aqueous solution containing 18.7 g of silver nitrate and a 21.9% potassium bromide aqueous solution were added to the reaction solution over a period of 10 minutes in such a manner that the silver potential of the reaction solution was 20 mV with reference to a saturated calomel electrode. After the completion of the addition, the temperature of the reaction solution was kept at 75° C. for 1 minute, and the temperature of the reaction solution was then lowered to 40° C. Then, 100 mL of an aqueous solution containing 10.5 g of sodium p-iodoacetamidebenzenesulfonate monohydrate to adjust the pH of the reaction solution to 9.0. Further, 50 mL of an aqueous solution containing 4.3 g of sodium sulfite was added. After the addition, the reaction solution was kept at 40° C. for 3 minutes, and the temperature of the reaction solution was then raised to 55° C. Next, after the pH of the reaction solution was adjusted to 5.8, 0.8 mg of sodium benzenethiosulfinate, 0.04 mg of potasium hexachloroiridate (IV) and 5.5 g of potassium bromide were added to the reaction solution. After the completion of the addition, the temperature of the reaction solution was kept at 55° C. for 1 minute. Then, 180 mL of an aqueous solution containing 44.3 g of silver nitrate and 160 mL of an aqueous solution containing 34.0 g of potassium bromide and 8.9 mg of potassium hexacyanoferrate (II) were added to the reaction solution over a period of 30 minutes. The temperature of the reaction solution was then lowered, and a desalting treatment was performed by a standard method. After the desalting treatment, gelatin was added to the reaction solution such that the gelatin content became 7% by weight and the pH of the reaction solution was adjusted to 6.2.

The emulsion obtained was made up of hexagonal tabular grains having an average grain size expressed in an equivalent-sphere diameter of 1.29 μm, an average grain thickness of 0.27 μm and having an average aspect ratio, i.e., a ratio obtained by dividing the projected grain diameter by grain thickness, of 8.5. This emulsion was designated as emulsion A-1.

The procedure of the preparation of Emulsion A-1 was repeated, except that the amounts of the silver nitrate and potassium bromide to be added at the initial stage of grain formation were changed so as to change the number of nuclei to be formed. The emulsion obtained in this way was made up of hexagonal tabular grains having an average grain size expressed in an equivalent-sphere diameter of 0.75 μm, an average grain thickness of 0.18 μm and an average aspect ratio of 6.9. This emulsion was designated as emulsion A-2. Further, the procedure of the preparation of Emulsion A-1 was repeated, except that the amounts of the silver nitrate and potassium bromide to be added at the initial stage of grain formation were changed. The emulsion obtained in this way was made up of hexagonal tabular grains having an average grain size expressed in an equivalent-sphere diameter of 0.52 μm, an average grain thickness of 0.18 μm and an average aspect ratio of 4.0. This emulsion was designated as emulsion A-3. In these preparations, the amounts of the potasium hexachloroiridate (IV) and potassium hexacyanoferrate (II) were changed in inverse proportion to the grain volume while the amount of the sodium p-iodoacetamidebenzenesulfonate monohydrate was changed in proportion to the length of grain periphery.

Next, 5.6 mL of 1% aqueous solution of potassium iodide was added to Emulsion A-1 at 40° C. After the addition, the spectral sensitization and the chemical sensitization of this emulsion were performed by the addition thereto of the following blue-sensitizing dye in an amount of $6.1\times10^{-4}$ mol/mol of silver, the following compound I as a stabilizer in an amount of $1\times10^{-5}$ mol/mol of silver, potassium thiocyanate, chloroauric acid, sodium thiosulfate and mono (pentafluorophenyl)diphenylphosphine selenide as chemical sensitizers. After the completion of the spectral sensitization and chemical sensitization, the following stabilizer S was added. The amounts of the chemical sensitizers were adjusted so that the level of the chemical sensitization of the emulsion was optimized.

Blue-sensitizing Dye

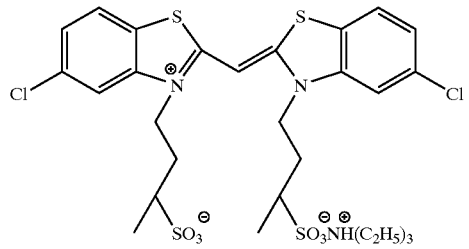

Compound I (Stabilizer)

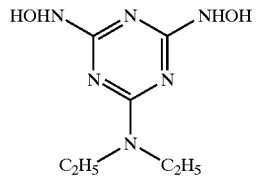

Stabilizer S (Mixture of the Following Compounds)

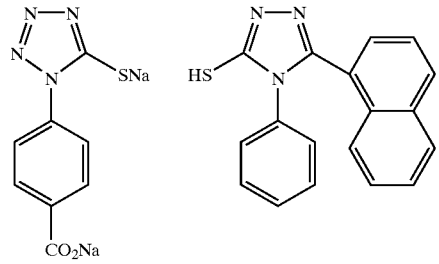

$2\times10^{-4}$ mol/molAg of silver $8\times10^{-5}$ mol/molAg for the emulsion A-1

The blue-sensitive emulsion thus prepared was designated as A-1 b. Similarly, the spectral sensitization and chemical sensitization for the emulsions A-2 and A-3 were conducted so as to prepare blue-sensitive emulsion A-2 b and blue-sensitive emulsion A-3 b, except that the amounts of the spectral sensitizing dyes were changed in accordance with the surface area of the silver halide grains in the emulsions. On the other hand, the amounts of the chemical sensitizers were adjusted so that the levels of the chemical sensitization of the emulsions were optimized.

Furthermore, green-sensitive emulsions A-1 g, A-2 g and A-3 g were prepared by replacing the bleu-sensitizing dyes by the following green-sensitizing dyes I to III, while red-sensitive emulsions A-1 r, A-2 r and A-3 r were prepared by replacing the bleu-sensitizing dyes by the following red-sensitizing dyes I to III.

Green-sensitizing Dye I

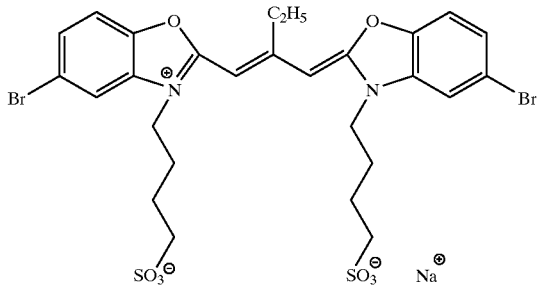

$5.5\times10^{-4}$ mol/mol of silver for the emulsion A-1

Green-sensitizing Dye II

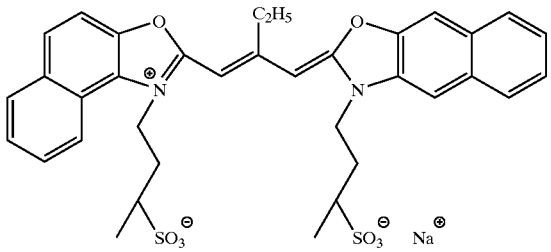

$1.3\times10^{-4}$ mol/mol of silver for the emulsion A-1

Green-sensitizing Dye III

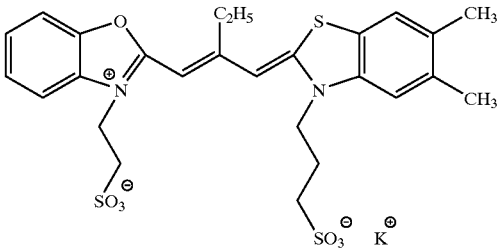

$4.8\times10^{-5}$ mol/mol of silver for the emulsion A-1

Red-sensitizing Dye I

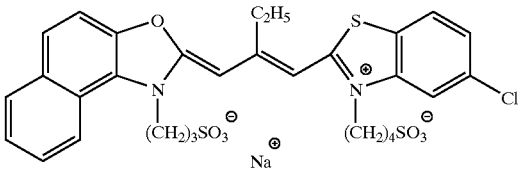

$2.5\times10^{-4}$ mol/mol of silver for the emulsion A-1

Red-sensitizing Dye II

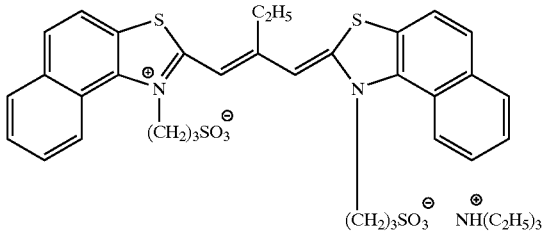

$6.3\times10^{-5}$ mol/mol of silver for the emulsion A-1

Red-sensitizing Dye III

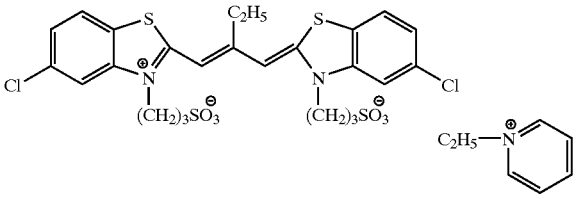

$3\times10^{-4}$ mol/mol of silver for the emulsion A-1

Preparation of a Dispersion of Zinc Hydroxide

Next, a dispersion of zinc hydroxide serving as a base precursor was prepared in the following way.

A mixture, which comprised 31 g of zinc hydroxide powder having an average diameter of primary particles of 0.2 $\mu$m, 1.6 g of carboxymethylcellulose and 0.4 g of sodium polyacrylate as dispersants, 8.5 g of lime-treated ossein gelatin and 158.5 mL of water, was dispersed for one hour by means of a mill with glass beads. After filtering off the glass beads from the mixture, 188 g of a dispersion of zinc hydroxide was obtained.

Preparation of an Emulsified Dispersion Liquid Containing a Coupler and an Incorporated Color Developing Agent An emulsified dispersion liquid containing a coupler and an incorporated color developing agent (hereinafter referred to simply as "developing agent " upon occasion) was prepared in the following way.

Emulsified Dispersion Liquid Containing a Yellow Coupler and a Developing Agent A mixture, which comprised 8.95 g of the following yellow coupler (a), 7.26 g of the following developing agent (b), 1.47 g of the following developing agent (c), 0.17 g of the following anti-fogging agent (d), 0.28 g of the following anti-fogging agent (e), 18.29 g of the following organic solvent having a high boiling point (f) and 50.0 mL of ethyl acetate, was made into a solution at 60° C. The solution was blended into 200 g of an aqueous solution comprising 18.0 g of a lime-treated gelatin and 0.8 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant emulsion was mixed at 2,000 revolutions per minute for 10 minutes. In this way, an emulsified dispersion liquid containing a yellow coupler and a developing agent was obtained.

Yellow coupler (a)

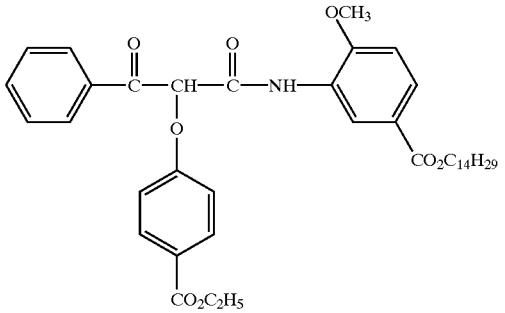

Developing agent (b)

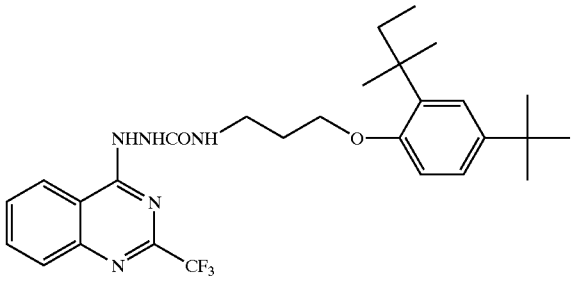

Developing agent (c)

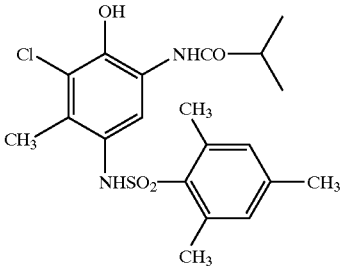

Anti-fogging agent (d)

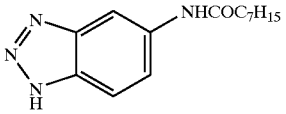

Anti-fogging agent (e)

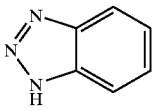

Organic solvent having a high boiling point (f)

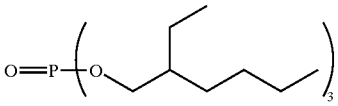

Emulsified Dispersion Liquid Containing a Magenta Coupler and a Developing Agent A mixture, which comprised 7.65 g of the following magenta coupler (g), 1.12 g of the following magenta coupler (h), 8.13 g of the following developing agent (i), 1.05 g of the above-mentioned developing agent (c), 0.11 g of the above-mentioned anti-fogging agent (d), 7.52 g of the following organic solvent having a high boiling point (i) and 38.0 mL of ethyl acetate, was made into a solution at 60° C. The solution was blended into 150 g of an aqueous solution comprising 12.2 g of a lime-treated gelatin and 0.8g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant emulsion was mixed at 2,000 revolutions per minute for 10 minutes. In this way, an emulsified dispersion liquid containing a magenta coupler and a developing agent was obtained.

Emulsified Dispersion Liquid Containing a Cyan Coupler and a Developing Agent A mixture, which comprised 10.78 g of the following cyan coupler (k), 8.23 g of the following magenta coupler (i), 1.06 g of the above-mentioned developing agent (c), 0.15 g of the above-mentioned anti-fogging agent (d), 8.27 g of the following organic solvent having a high boiling point (j) and 38.0 mL of ethyl acetate, was made into a solution at 60° C. The solution was blended into 150 g of an aqueous solution comprising 12.2 g of a lime-treated gelatin and 0.8 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant emulsion was mixed at 2,000 revolutions per minute for 10 minutes. In this way, an emulsified dispersion liquid containing a cyan coupler and a developing agent was obtained.

Magenta coupler (g)

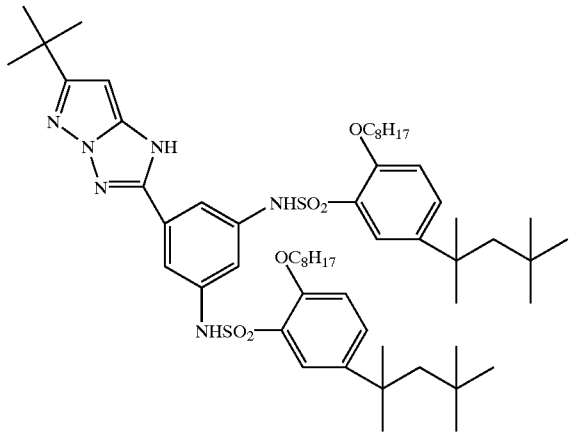

Magenta coupler (h)

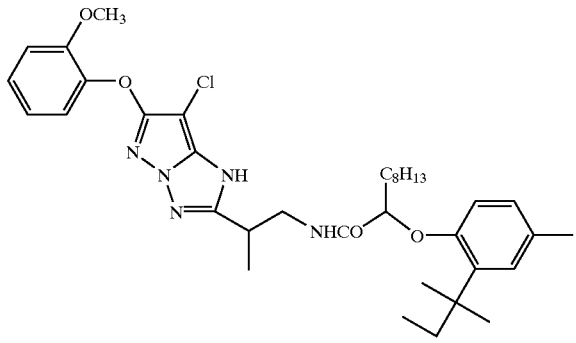

-continued

Developing agent (i)

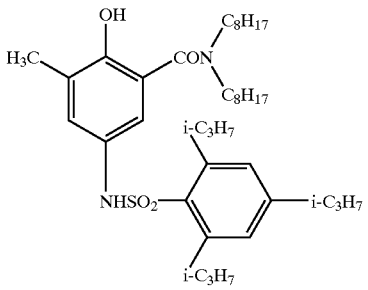

Organic solvent having a high boiling point (j)

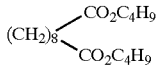

Cyan coupler (k)

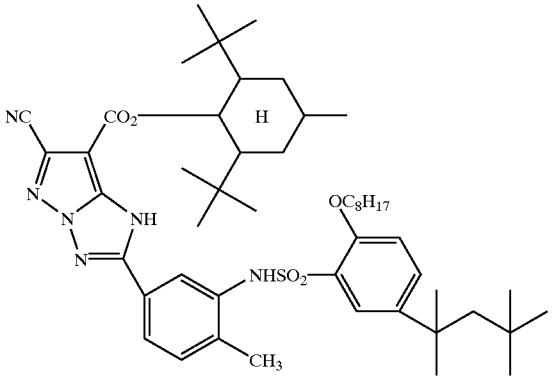

Example 1 to 13

Preparation of Support

A support used in Example 1 was prepared as follows.

100 parts by weight of a polyethylene-2,6-naphthalate (PEN) polymer and 2 parts by weight of Tinuvin P.326 (manufactured by Ciba-Geigy Co.) as an ultraviolet absorbent were dried, melted at 300° C., and extruded from a T-die. The resultant material was longitudinally stretched by 3.3 times at 140° C., then transversely stretched by 3.3 times at 130° C., and thermally fixed at 250° C. for 6 seconds. The result was a 90 μm-thick PEN film. Proper amounts of blue, magenta and yellow dyes (I-1, I-4, I-6, I-24, I-26, I-27and II-5described in Journal of Technical Disclosure No.94-6, 023) were added to this PEN film so that a yellow density of 0.01, a magenta density of 0.08 and a cyan density of 0.09 were obtained. The PEN film was wound around a stainless steel core having a diameter of 20 cm and given a thermal hysteresis of 30 hours at 113° C., thereby manufacturing a support with a high resistance to curling.

Formation of Primer Layers

The two surfaces of the support were subjected to corona discharge, UV irradiation and glow discharge and thereafter coated, by using a bar coater, each with 10 cc/m$^2$ of a primer solution consisting of gelatin (0.1 g/m$^2$), sodium α-sulfo-di-2-ethylhexylsuccinate (0.01 g/m$^2$), salicylic acid (0.025 g/m$^2$), the following PQ-1 (0.005 g/m$^2$), and the following PQ-2 (0.006 g/m$^2$). Drying was performed at 115° C. for 6minutes (all of the rollers and conveyors in the drying zone were maintained at 115° C.).

Formation of Back Layer (1) Formation of Antistatic Layer

The support was coated with a mixture composed of a dispersion (secondary aggregate particle size: about 0.08 μm) (0.027 g/m$^2$) of a fine powder of a tin oxide/antimony oxide composite material having an average particle size of 0.005 μm and a specific resistance of 5Ω·cm, gelatin (0.03 g/m$^2$), $(CH_2{=}CHSO_2CH_2CH_2NHCO)_2CH_2$ (0.02 g/m$^2$), polyoxyethylene-p-nonylphenol (polymerization degree: 10) (0.005 g/m$^2$), the following PQ-3 (0.008 g/m$^2$), and resorcin (0.001 g/m$^2$)

(2) Formation of Magnetic Recording Layer 0.006 g/m$^2$ of cobalt-γ-iron oxide (specific surface area: 43 m$^2$/g; major axis: 0.14 μm: minor axis: 0.03 μm; saturation magnetization: 89 emu/g; $Fe^{+2}/Fe^{+3}$:6/94; surface-treated with aluminum oxide/silicon oxide in an amount corresponding to 2% by weight of the iron oxide) coated with 3-polyoxyethylene-propyloxytrimethoxysilane (polymerization degree: 15) (15% by weight), 1.15 g/m$^2$of diacetylcellulose (iron oxide was dispersed by means of an open kneader and a sand mill), and the following PQ-4 (0.075 g/m$^2$) and the following PQ-5 (0.004 g/m$^2$), as hardeners, were applied by means of a bar coater by using acetone, methyl ethyl ketone, cyclohexanone, and dibutyl phthalate as solvents, thus forming a 1.2 μm-thick magnetic layer. Further, 5 mg/m$^2$ of $C_6H_{13}CH(OH)C_{10}H_{20}COOC_{40}H_{81}$ (50 mg/m$^2$) as a slicking agent, 15 mg/m$^2$of silica particles (average particle diameter: 0.1 μm) as a matting agent, and 15 mg/m$^2$ of aluminum oxide particles (ERC-DBM; average particle diameter: 0.44 μm, manufactured by Reynolds Metal Corporation) as an abrasive, were added. Drying was performed at 115° C. for 6 minutes (all of the rollers and conveyors in the drying zone were maintained at 115° C.). The color density increment of DB of the magnetic recording layer as measured by an X-light (blue filter) was 0.1. The saturation magnetization moment, coercive force, and squareness ratio of the magnetic recording layer were 4.2 emu/g, 7.5×10$^4$ A/m, and 65%, respectively.

(3) Formation of Sliding Layer

A mixture of hydroxyethylcellulose (25 mg/m$^2$), the following PQ-6 (7.5 g/m$^2$), the following PQ-7 (1.5 g/m$^2$), and a polydimethylsiloxane (1.5 mg/m$^2$) was applied. It should be noted that this mixture was melted in xylene/propyleneglycolmonomethyl ether (1/1) at 105° C., added to and dispersed in propyleneglycolmonomethyl ether (tenfold amount) at room temperature, and formed into a dispersion (average particle size: 0.01 μm) in acetone before being added. Drying was performed at 115° C. for 6 minutes (all of the rollers and conveyors in the drying zone were maintained at 115° C.) The resultant sliding layer was found to have excellent characteristics. That is, the coefficient of kinetic friction was 0.10 (stainless steel hard ball having a diameter of 5 mm; load: 100 g; speed: 6 cm/minute) and the coefficient of static friction was 0.09 (clip method). The coefficient of kinetic friction between an emulsion surface described previously and the sliding layer was also excellent and gave a value of 0.18.

PQ-1

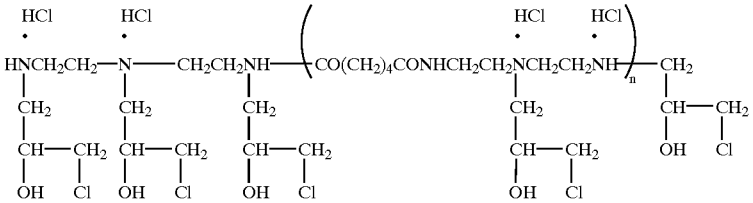

(n=30)

PQ-2

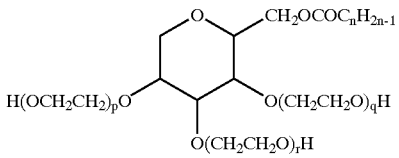

(n=17)
(p+q+r=20)

PQ-3

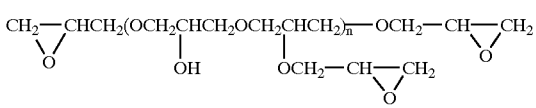

(n=3)

PQ-4

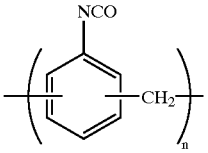

(n=2~5)

PQ-5 $(CH_3O)_3SiCH_2CH_2CH_2O(CH_2CH_2O)_nCH_3$ (n=7.3)

PQ-6 $(C_{50}H_{101}(CH_2CH_2O)_nH$ (n=16)

PQ-7

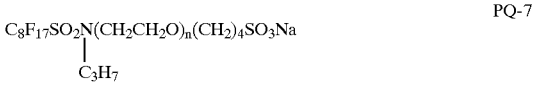

(n=4)

Preparation of Dye Compositions for Yellow Filter Layer, Magenta Filter Layer, and Antihalation Layer The dye compositions (decolorizing dye compositions) for yellow filter layer, magenta filter layer, and antihalation layer were prepared as follows.

Dye for Yellow Filter Layer

The dye for yellow filter layer was prepared as an emulsified dispersion.

7.1 g of the following yellow dye (1) was dissolved in a mixture of 7.1 g of the following organic solvent having a high boiling point (m), 30 mL of ethyl acetate and 30 mL of cyclohexanone. The solution was blended into 135 g of a 7.8% aqueous solution of gelatin containing 1.25 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 260 g, and the resultant emulsion was mixed at 2,000 revolutions per minute for 10 minutes. In this way, an emulsified dispersion of dye for yellow filter layer was prepared.

Dye for Magenta Filter Layer

The dye for magenta filter layer was also prepared as an emulsified dispersion.

6.1 g of the following yellow dye (n) was dissolved in a mixture of 6.1 g of the following organic solvent having a high boiling point (o), 30 mL of ethyl acetate and 30 mL of cyclohexanone. The solution was blended into 135 g of a 7.8% aqueous solution of gelatin containing 0.46 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 260 g, and the resultant emulsion was mixed at 2,000 revolutions per minute for 10 minutes. In this way, an emulsified dispersion of dye for magenta filter layer was prepared.

Dye for Antihalation Layer

The dye (cyan dye) for antihalation layer was prepared as a dispersion of solid fine particles.

2.64 g of a 10 weight % aqueous solution of the following surfactant (p) and 94 mL of water were added to 3.0 g of the cyan dye as the illustrative compound (F-81). The mixture was dispersed by means of a sand grinder mill with zirconia beads having an average diameter of 0.5 mm for 24 hours. After the dispersing operation, the beads were separated and the dye for antihalation layer was prepared as a dispersion of solid fine particles. The particle size of the dispersion of solid fine particles was measured by Master Sizer, manufactured by Malvern Corporation, and the average particle diameter was found to be 0.16 $\mu$m.

Yellow dye (1)

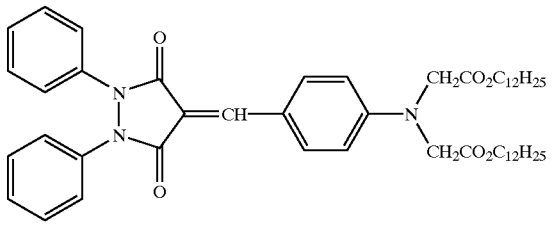

A 1:1 mixture of organic solvent having a high boiling point (m) and EMPARA K65 (manufactured by Ajinomoto Co., Ltd.)

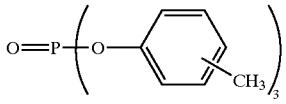

Magenta dye (n)

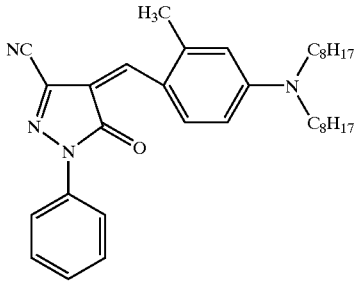

Organic solvent having a high boiling point (o)

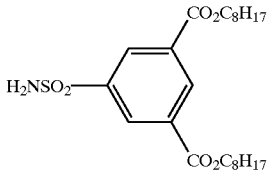

Surfactant (p)

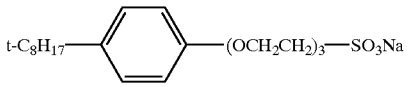

By using the above-described support and materials, the multi layered photosensitive material 101 shown in the following Tables 1 to 3 was prepared.

TABLE 1

| | | Coating weight of each compound in mg/m$^2$ constituting photosensitive material 101 |
|---|---|---|
| Protective layer | | |
| Lime-treated gelatin | | 914 |
| Matting agent (silica) | | 50 |
| Surfactant (q) | | 30 |
| Surfactant (r) | | 40 |
| Water-soluble polymer (s) | | 15 |
| Hardener (t) | | 110 |
| Intermediate layer | | |
| Lime-treated gelatin | | 461 |
| Surfactant (r) | | 5 |
| Zinc hydroxide | | 340 |
| Formalin scavenger (u) | | 300 |

TABLE 1-continued

| | | Coating weight of each compound in mg/m$^2$ constituting photosensitive material 101 |
|---|---|---|
| Water-soluble polymer (s) | | 15 |
| Yellow-coloring layer (high-sensitive layer) | | |
| Lime-treated gelatin | | 1750 |
| Emulsion | A-1b | |
| (based on the coating amount of silver) | | 635 |
| Yellow coupler (a) | | 298 |
| Developing agent (b) | | 242 |
| Developing agent (c) | | 50 |
| Anti-fogging agent (d) | | 5.8 |
| Anti-fogging agent (e) | | 9.5 |
| Organic solvent having a high boiling point (f) | | 500 |
| Surfactant (y) | | 27 |
| Water-soluble polymer (s) | | 1 |
| Yellow-coloring layer (medium-sensitive layer) | | |
| Lime-treated gelatin | | 1400 |
| Emulsion | A-2b | |
| (based on the coating amount of silver) | | 280 |
| Yellow coupler (a) | | 277 |
| Developing agent (b) | | 225 |
| Developing agent (c) | | 46 |
| Anti-fogging agent (d) | | 5.3 |
| Anti-fogging agent (e) | | 8.8 |
| Organic solvent having a high boiling point (f) | | 566 |
| Surfactant (y) | | 25 |
| Water-soluble polymer (s) | | 2 |
| Yellow-coloring layer (low-sensitive layer) | | |
| Lime-treated gelatin | | 1400 |
| Emulsion | A-3b | |
| (based on the coating amount of silver) | | 285 |
| Yellow coupler (a) | | 277 |
| Developing agent (b) | | 225 |
| Developing agent (c) | | 46 |
| Anti-fogging agent (d) | | 5.3 |
| Anti-fogging agent (e) | | 8.8 |
| Organic solvent having a high boiling point (f) | | 566 |
| Surfactant (y) | | 25 |
| Water-soluble polymer (s) | | 2 |

TABLE 2

| | | |
|---|---|---|
| Intermediate layer (yellow filter layer) | | |
| Lime-treated gelatin | | 560 |
| Surfactant (y) | | 15 |
| Surfactant (r) | | 24 |
| Yellow dye (l) | | 85 |
| Organic solvent having a high boiling point (m) | | 85 |
| Zinc hydroxide | | 125 |
| Water-soluble polymer (s) | | 15 |
| Magenta-coloring layer (high-sensitive layer) | | |
| Lime-treated gelatin | | 781 |
| Emulsion | A-1g | |
| (based on the coating amount of silver) | | 1635 |
| Magenta coupler (g) | | 80 |
| Magenta coupler (h) | | 12 |
| Developing agent (i) | | 85 |
| Developing agent (c) | | 11 |
| Anti-fogging agent (d) | | 1.2 |
| Organic solvent having a high boiling point (j) | | 79 |
| Surfactant (y) | | 8 |

TABLE 2-continued

| | | |
|---|---|---|
| Water-soluble polymer (s) | | 8 |
| Magenta-coloring layer (medium-sensitive layer) | | |
| Lime-treated gelatin | | 659 |
| Emulsion (based on the coating amount of silver) | A-2g | 935 |
| Magenta coupler (g) | | 103 |
| Magenta coupler (h) | | 15 |
| Developing agent (i) | | 110 |
| Developing agent (c) | | 14 |
| Anti-fogging agent (d) | | 1.5 |
| Organic solvent having a high boiling point (j) | | 102 |
| Surfactant (y) | | 11 |
| Water-soluble polymer (s) | | 14 |
| Magenta-coloring layer (low-sensitive layer) | | |
| Lime-treated gelatin | | 711 |
| Emulsion (based on the coating amount of silver) | A-3g | 550 |
| Magenta coupler (g) | | 274 |
| Magenta coupler (h) | | 40 |
| Developing agent (i) | | 291 |
| Developing agent (c) | | 38 |
| Anti-fogging agent (d) | | 3.9 |
| Organic solvent having a high boiling point (j) | | 269 |
| Surfactant (y) | | 29 |
| Water-soluble polymer (s) | | 14 |

TABLE 3

| | | |
|---|---|---|
| Intermediate layer (magenta filter layer) | | |
| Lime-treated gelatin | | 850 |
| Surfactant (y) | | 15 |
| Surfactant (r) | | 24 |
| Magenta dye (n) | | 200 |
| Organic solvent having a high boiling point (o) | | 200 |
| Formalin scavenger (u) | | 300 |
| Zinc hydroxide | | 2028 |
| Water-soluble polymer (s) | | 15 |
| Cyan-coloring layer (high-sensitive layer) | | |
| Lime-treated gelatin | | 842 |
| Emulsion (based on the coating amount of silver) | A-1r | 1635 |
| Cyan coupler (k) | | 64 |
| Developing agent (i) | | 75 |
| Developing agent (c) | | 6 |
| Anti-fogging agent (d) | | 0.9 |
| Organic solvent having a high boiling point (j) | | 49 |
| Surfactant (y) | | 5 |
| Water-soluble polymer (s) | | 18 |
| Cyan-coloring layer (medium-sensitive layer) | | |
| Lime-treated gelatin | | 475 |
| Emulsion (based on the coating amount of silver) | A-2r | 1135 |
| Cyan coupler (k) | | 134 |
| Developing agent (i) | | 102 |
| Developing agent (c) | | 13 |
| Anti-fogging agent (d) | | 1.9 |
| Organic solvent having a high boiling point (j) | | 103 |
| Surfactant (y) | | 10 |
| Water-soluble polymer (s) | | 15 |
| Cyan-coloring layer (low-sensitive layer) | | |
| Lime-treated gelatin | | 825 |
| Emulsion (based on the coating amount of silver) | A-3r | 720 |
| Cyan coupler (k) | | 234 |

TABLE 3-continued

| | |
|---|---|
| Developing agent (i) | 179 |
| Developing agent (c) | 23 |
| Anti-fogging agent (d) | 3.3 |
| Organic solvent having a high boiling point (j) | 179 |
| Surfactant (y) | 17 |
| Water-soluble polymer (s) | 10 |
| Antihalation layer | |
| Lime-treated gelatin | 440 |
| Dye (illustrative compound F-81) | 132 |
| Surfactant (p) | 12 |
| Water-soluble polymer (s) | 15 |
| Primer layer | |
| PEN support having a thickness of 92 $\mu$m | |
| Primer layer | |
| Antistatic layer | |
| Magnetic recording layer | |
| Sliding layer | |

Further, processing materials P-1 and P-2 as shown in Tables 4 and 5 were prepared.

TABLE 4

Construction of processing material P-1

| Layer construction | Materials added | Amounts added (mg/m$^2$) |
|---|---|---|
| 4$^{th}$ layer protective layer | Acid-treated gelatin | 220 |
| | Water-soluble polymer (v) | 60 |
| | Water-soluble polymer (W) | 200 |
| | Additive (x) | 80 |
| | Potassium nitrate | 16 |
| | Matting agent (z) | 10 |
| | Surfactant (r) | 7 |
| | Surfactant (aa) | 7 |
| | Surfactant (ab) | 10 |
| 3$^{rd}$ layer intermediate layer | Lime-treated gelatin | 240 |
| | Water-soluble polymer (W) | 24 |
| | Hardener (ac) | 180 |
| | Surfactant (y) | 9 |
| 2$^{nd}$ layer base generating layer | Lime-treated gelatin | 2100 |
| | Water-soluble polymer (W) | 360 |
| | Water-soluble polymer (ad) | 700 |
| | Water-soluble polymer (ae) | 600 |
| | Organic solvent having a high boiling point (af) | 2120 |
| | Additive (ag) | 20 |
| | Guanidine picolinate | 2613 |
| | Potassium quinolinate | 225 |
| | Sodium quinolinate | 192 |
| | Surfactant (y) | 24 |
| 1$^{st}$ layer primer layer | Lime-treated gelatin | 247 |
| | Water-soluble polymer (v) | 12 |
| | Surfactant (r) | 14 |
| | Hardener (ac) | 178 |
| Transparent support (63 $\mu$m) | | |

TABLE 5

Construction of processing material P-2

| Layer construction | Materials added | Amounts added (mg/m$^2$) |
|---|---|---|
| 5$^{th}$ layer protective layer | Acid-treated gelatin | 490 |
| | Matting agent (z) | 10 |
| 4$^{th}$ layer intermediate layer | Lime-treated gelatin | 240 |
| | Hardener (ac) | 250 |
| 3$^{rd}$ layer solvent layer | Lime-treated gelatin | 4890 |
| | Solvent for silver halide (ah) | 5770 |
| 2$^{nd}$ layer intermediate layer | Lime-treated gelatin | 370 |
| | Hardener (ac) | 500 |

TABLE 5-continued

Construction of processing material P-2

| Layer construction | Materials added | Amounts added (mg/m$^2$) |
|---|---|---|
| 1st layer primer layer | Lime-treated gelatin | 247 |
| | Water soluble polymer (v) | 12 |
| | Surfactant (r) | 14 |
| | Hardener (ac) | 178 |
| | Transparent support (63 $\mu$m) | |

Surfactant (q)

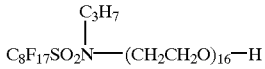

Surfactant (r)

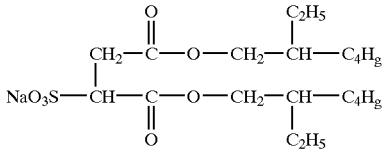

Water-soluble polymer (s)

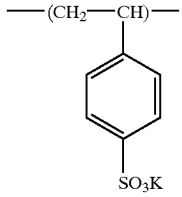

Hardener (t)

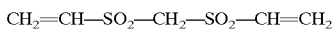

Formalin scavenger (u)

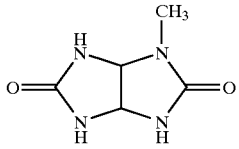

Water-soluble polymer (v): κ-carrageenan

Water-soluble polymer (w): Sumikagel L-5H (manufactured by Sumitomo Chemical Co., Ltd.)

Additive (x)

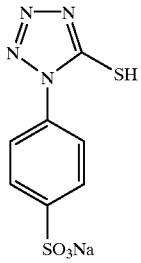

Surfactant (y)

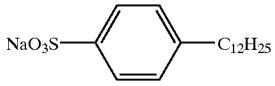

Matting Agent (z): SYLOID 79 (manufactured by Fuji-Davison Chemical Co., Ltd.)

Surfactant (aa)

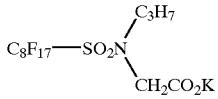

Surfactant (ab)

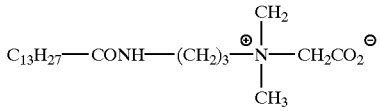

Hardener (ac)

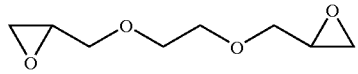

Water-soluble polymer (ad): Dextran (molecular weight: 70,000);

Water-soluble polymer (ae): MP Polymer MP102 manufactured by Kuraray Co., Ltd.

Organic solvent having a high boiling point (af): EMPARA K65 (manufactured by Ajinomoto Co., Ltd.)

Additive (ag)

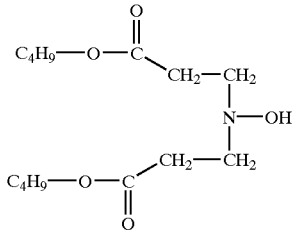

Solvent for silver halide (ah)

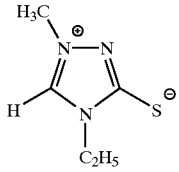

Photosensitive materials 102 to 113 were prepared by the same procedure for preparation of layers as that of the photosensitive material 101, except that the cyan dye and the surfactant for use as dispersant of the solid dispersion of the cyan dye in the antihalation layer of the photosensitive material 101 were changed according to Table 6.

TABLE 6

| Photo-sensitive material | 1st layer (antihalation layer) Decolorizing dye No. (coating weight of dye g/m$^2$) | Dispersant (coating weight of dispersant g/m$^2$) | |
|---|---|---|---|
| 101 | F-81 (0.132 g/m$^2$) | Surfactant (p) (0.012) | Example 1 |
| 102 | F-47 (0.105) | Surfactant (p) (0.009) | Example 2 |
| 103 | F-49 (0.121) | Surfactant (p) (0.011) | Example 3 |
| 104 | F-50 (0.115) | Surfactant (p) (0.010) | Example 4 |
| 105 | F-3 (0.100) | Surfactant (p) (0.009) | Example 5 |
| 106 | F-85 (0.147) | Surfactant (p) (0.013) | Example 6 |
| 107 | F-116 (0.129) | Surfactant (p) (0.012) | Example 7 |
| 108 | F-117 (0.136) | Surfactant (p) (0.012) | Example 8 |
| 109 | F-81 (0.132) | Surfactant (c-1) (0.012) | Example 9 |
| 110 | F-81 (0.132) | Surfactant (c-2) (0.012) | Example 10 |
| 111 | F-81 (0.132) | Sodium dodecylbenzenesulfonate (0.012) | Example 11 |

TABLE 6-continued

| Photo-sensitive material | 1st layer (antihalation layer) Decolorizing dye No. (coating weight of dye g/m²) | Dispersant (coating weight of dispersant g/m²) | |
|---|---|---|---|
| 112 | F-50 (0.115) | Surfactant (c-1) (0.010) | Example 12 |
| 113 | F-50 (0.115) | Surfactant (c-2) (0.010) | Example 13 |

Surfactant (C-1)

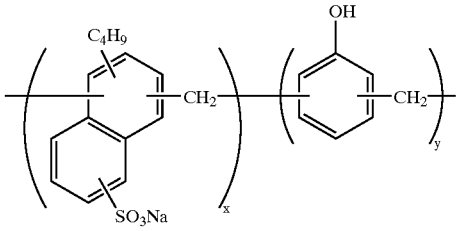

x/y=70/30 (molar ratio); number average molecular weight: 5,300

Surfactant (C-2)

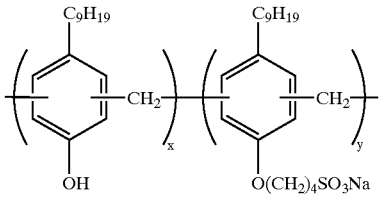

x/y=55/45

Comparative Examples 1 to 3

Photosensitive materials H-1 and H-2 were prepared by the same procedure for preparation of layers as that of the photosensitive material 101, except that the cyan dye in the antihalation layer of the photosensitive material 101 was changed according to Table 7. The cyan dye (ai) of H-2 was added as an emulsified dispersion of the cyan dye (ai).

The emulsified dispersion was prepared by the same procedure as that of the preparation of the emulsified dispersion of dye for the yellow filter layer, except that 7.1 g of the yellow dye (1) was replaced by 14.2 g of the following cyan dye (ai) and 7.1 g of the organic solvent having a high boiling point was replaced by 14.2 g of the following organic solvent having a high boiling point (C-3).

Further, photosensitive materials H-3 was prepared by the same procedure for preparation of layers as that of the photosensitive material 101 of the photosensitive material 101, except that the cyan dye in the antihalation layer was replaced by black colloidal silver as shown in Table 7.

TABLE 7

| Photo-sensitive material | 1st layer (antihalation layer) Decolorizing dye (coating weight of dye g/m²) | Dispersant (coating weight of dispersant g/m²) | |
|---|---|---|---|
| H-1 | No dye used | — | Comparative example 1 |
| H-2 | Compound (ai) (0.158) | Sodium dodecylbenzene-sulfonate (0.014) | Comparative example 2 |
| H-3 | Black colloidal silver (coating weight based on silver: 0.24 g/m²) | — | Comparative example 3 |

Cyan dye (ai)

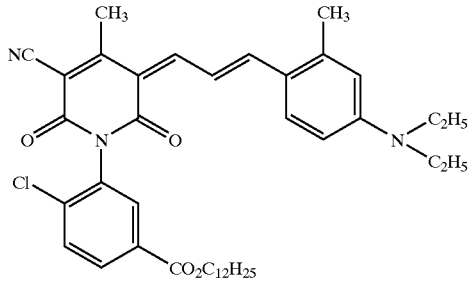

Organic solvent having a high boiling point (C-3)

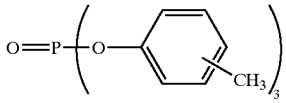

15 mL/m²of water (equivalent of 45% of the amount required for maximum swelling) of 40° C. was supplied to the photosensitive materials 101 to 113 and H-1 to H-3, without being exposed to light. Then, these photosensitive materials were each put together with the processing material P-1 and heated from the back face of the photosensitive material by a heat drum of 83° C. for 17 seconds. After that, the processing material P-1 was peeled from the photosensitive material. Again, 15 mL/m² of water of 40° C. was supplied to the photosensitive material. Then, the photosensitive material was put together with the processing material P-2 and heated at 83° C. for 10 seconds. The processing material P-2 was then peeled from the photosensitive material. The photosensitive materials thus obtained were subjected to the measurement of transmitted density by status filter A. The measurement was conducted at 3 points and the averages are shown as results in Table 8.

As is apparent from the results shown in Table 8, since Dmin of the photosensitive materials of the present invention after processing is equivalent to that of the photosensitive material H-1 (Comparative Example 1) containing no dye, the photosensitive materials of the present invention, in which the decolorizing dye having the structure represented by the general formula (I) and silver are present in the same layer, are so excellent in decolorizing property that the color is completely lost by the processing.

In addition, the photosensitive materials 101 to 113 and H-1 to H-3, without being exposed to light, were developed by using a liquid developer (CN-16) manufactured by Fuji Photo Film Co., Ltd. and the photosensitive materials thus obtained were subjected to the evaluation of Dmin according to the same method as that described above. As is apparent from the results shown in Table 8, the photosensitive materials of the present invention have excellent decolorizing property also in development by the liquid developer as in heat development.

The photosensitive material thus prepared was cut into APS format, punched, and loaded in a cartridge, which was then loaded in an APS camera. In this way, photographs of a person and a Macbeth chart were taken by using the photosensitive material.

From this photosensitive material thus exposed was processed using the processing materials P-1 and P-2 in the above-described way to thereby obtain a negative image on the photosensitive material. The image was read out by a digital image scanner, "Frontier SP-1000" manufactured by Fuji Photo Film Co., Ltd., and image-processed in work station. After that, a print image was obtained by a heat-development printer ("Pictrography" 4000 manufactured by Fuji Photo Film Co., Ltd.). The quality of print images was evaluated, and the results are shown in Table 8 according to the following rating: ○: sharpness and color reproduction are excellent; ×: sharpness and color reproduction are poor or defects such as halation are observed.

Negative images were obtained from the photosensitive materials exposed in the same way as above but by development using a liquid developer (CN-16). The negative images were processed in the same way as above and the quality (sharpness and color reproduction) of the images was evaluated. The results were expressed by ○ and × based on the same criterion as above.

Further, the photosensitive materials of the present invention were left for aging in a condition of 45° C. and 80% humidity for 3 days. After that, the photosensitive materials were processed (2 kinds, i.e., heat development and liquid development) and evaluated in the same way. The results are shown in Table 8.

TABLE 6

| Photosensitive material | Examples and Comparative Examples | Dmin transmitted density (status A filter) | | | | | | | | Evaluation results of print images | | | |
|---|---|---|---|---|---|---|---|---|---|---|---|---|---|
| | | Heat development | | | | Liquid development | | | | Heat development | | Liquid development | |
| | | Cyan density | Magenta density | Yellow density | Decolorizing property | Cyan density | Magenta density | Yellow density | Decolorizing property | Before aging test | After 3 days storage at 45° C. and 80% humidity | Before aging test | After 3 days storage at 45° C. and 80% humidity |
| 101 | Example 1 | 0.51 | 0.62 | 1.12 | ○ | 0.28 | 0.84 | 1.05 | ○ | ○ | ○ | ○ | ○ |
| 102 | Example 2 | 0.49 | 0.63 | 1.15 | ○ | 0.27 | 0.85 | 1.04 | ○ | ○ | ○ | ○ | ○ |
| 103 | Example 3 | 0.52 | 0.60 | 1.13 | ○ | 0.26 | 0.86 | 1.05 | ○ | ○ | ○ | ○ | ○ |
| 104 | Example 4 | 0.52 | 0.62 | 1.10 | ○ | 0.24 | 0.87 | 1.03 | ○ | ○ | ○ | ○ | ○ |
| 105 | Example 5 | 0.53 | 0.63 | 1.15 | ○ | 0.26 | 0.84 | 1.02 | ○ | ○ | ○ | ○ | ○ |
| 106 | Example 6 | 0.48 | 0.60 | 1.12 | ○ | 0.24 | 0.85 | 1.03 | ○ | ○ | ○ | ○ | ○ |
| 107 | Example 7 | 0.50 | 0.61 | 1.13 | ○ | 0.25 | 0.86 | 1.04 | ○ | ○ | ○ | ○ | ○ |
| 108 | Example 8 | 0.51 | 0.63 | 1.12 | ○ | 0.24 | 0.86 | 1.05 | ○ | ○ | ○ | ○ | ○ |
| 109 | Example 9 | 0.48 | 0.61 | 1.14 | ○ | 0.26 | 0.86 | 1.04 | ○ | ○ | ○ | ○ | ○ |
| 110 | Example 10 | 0.52 | 0.62 | 1.15 | ○ | 0.25 | 0.85 | 1.04 | ○ | ○ | ○ | ○ | ○ |
| 111 | Example 11 | 0.52 | 0.60 | 1.12 | ○ | 0.26 | 0.84 | 1.03 | ○ | ○ | ○ | ○ | ○ |
| 112 | Example 12 | 0.49 | 0.62 | 1.14 | ○ | 0.27 | 0.85 | 1.05 | ○ | ○ | ○ | ○ | ○ |
| 113 | Example 13 | 0.48 | 0.61 | 1.12 | ○ | 0.26 | 0.85 | 1.02 | ○ | ○ | ○ | ○ | ○ |
| H-1 | Comparative example 1 | 0.48 | 0.59 | 1.05 | Reference standard | 0.25 | 0.81 | 1.01 | Reference standard | × | × | × | × |
| H-2 | Comparative example 2 | 0.46 | 0.60 | 1.10 | ○ | 1.21 | 0.90 | 1.05 | × | ○ | ○ | ○ | ○ |
| H-3 | Comparative example 3 | 1.22 | 1.10 | 1.60 | × | 0.32 | 0.85 | 1.08 | ○ | ○ | ○ | ○ | ○ |

The following can be seen from the results of Table 8.

In the print image obtained from the photosensitive material H-1 of Comparative Example 1, the edges of image having cyan density were not sharp. This indicates that antihalation effect is not sufficient. As in the photosensitive material H-2 of Comparative Example 2, the edges of image become sharp if the cyan dye (ai) is used in the antihalation layer. However, the problem of the photosensitive material H-2 is that the decolorizing property after liquid development is insufficient and unnecessary color components remain when image data are read out. Further, as in the photosensitive material H-3 of Comparative Example 3, the edges of image become sharp if black colloidal silver is used in the antihalation layer. However, the problem of the photosensitive material H-2 is that the decolorizing property after heat development is insufficient and unnecessary color components remain. To the contrary, in the photosensitive materials 101 to 113 of the present invention in Examples 1 to 13, the halation preventing effect is so sufficient that no unnecessary color components remain either after heat development or liquid development. Furthermore, images having the same sharpness can be obtained both before and after the storage test, thus indicating good decolorizing property of the photosensitive materials of the present invention.

Although Examples described above provide examples in which the dye represented by the general formula (I) is incorporated in a non-photosensitive layer, it goes without saying that the same effect is obtained also in the case where the dye in incorporated in a photosensitive layer.

The present invention provides a silver halide color photographic photosensitive material incorporated with a color developing agent and a coupler, characterized in that the decolorizing property of dye is so excellent in simple development that any unnecessary color component does not remain when color information is read out and in that images excellent in color separation and sharpness can be obtained even after the storage of the photosensitive material. Further, the present invention provides an image forming method using the silver halide color photographic photosensitive material.

What is claimed is:

1. A method of forming an image, comprising the steps of:

(a) providing a silver halide color photographic photosensitive material which comprises:

a support having thereon a photosensitive silver halide emulsion layer containing photosensitive silver halide grains, a color developing agent, a coupler and a binder, and a non-photosensitive layer, and an antihalation layer formed between the silver halide emulsion layer and the support, or on a surface of the support at a side thereof opposite to a side thereof on which the silver halide emulsion layer is provided, wherein an antihalation dye is contained as a dispersion of solid fine particles in the antihalation layer, the dye being selected from at least one of the group consisting of (I-7) and General formula (I-7)

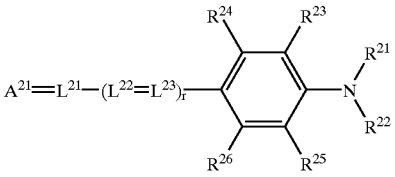

General formula (I-8)

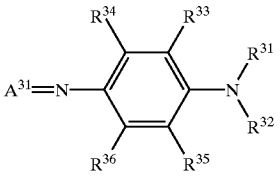

wherein $A^{21}$ and $A^{31}$ each represents 2-pyrazoline-5-one, iso-oxazoline, hydroxypyridine, pyrazolidine-dione, or barubituric acid; $L^{21}$, L22 and $L^{23}$ each represents a methine group; $R^{21}$, $R^{22}$, $R^{31}$ and $R^{32}$ each represents an alkyl or aryl group; $R^{23}$, $R^{24}$, $R^{25}$, $R^{26}$, $R^{33}$, $R^{34}$, $R^{35}$ and $R^{36}$ each represents a hydrogen atom or a substituent group; and r represents an integer selected from the group consisting of 0, 1 and 2, wherein $R^{23}$ and $R^{24}$, $R^{21}$ and $R^{23}$, $R^{21}$ and $R^{22}$ $R^{22}$ and $R^{25}$, $R^{25}$ and $R^{26}$, $R^{23}$ and $R^{34}$, $R^{31}$ and $R^{33}$, $R^{31}$ and $R^{32}$, $R^{32}$ and $R^{35}$, and $R^{35}$ and $R^{36}$ may optionally form a ring;

(b) exposing imagewise the silver halide color photographic photosensitive material; and (c) developing, contemporaneously with or after the step of exposing, the silver halide color photographic photosensitive material in the presence of a decolorizing agent or a precursor thereof, wherein said dye has a dissociative proton or a group having a dissociative proton, which is linked to said dye directly or via a divalent linking group.

2. The method of forming an image according to claim 1, wherein at least one of said layers contains a decolorizing agent or a precursor thereof.

3. The method of forming an image according to claim 1, wherein at least one of said layers contains a basic metal compound, which is slightly soluble in water.

4. The method of forming an image according to claim 1, wherein the photosensitive layer and the non-photosensitive layer have a combined thickness of at least 15 $\mu$m.

5. A method of forming an image comprising the steps of:

(a) providing a silver halide color photographic photosensitive material which comprises:

a support having thereon a photosensitive silver halide emulsion layer containing photosensitive silver halide grains, a color developing agent, a coupler and a binder, and a non-photosensitive layer, and an antihalation layer formed between the silver halide emulsion layer and the support, or on a surface of the support at a side thereof opposite to a side thereof on which the silver halide emulsion layer is provided, wherein an antihalation dye is contained as a dispersion of solid fine particles in the antihalation layer, the dye being selected from at least one of the group consisting of (I-7) and (I-8);

General formula (I-7)

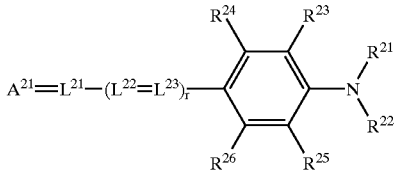

General formula (I-8)

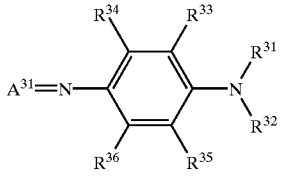

wherein $A^{21}$ and $A^{31}$ each represents 2-pyrazoline-5-one, iso-oxazoline, hydroxypyridine, pyrazolidine-dione, or barubituric acid; $L^{21}$, $L^{22}$ and $L^{23}$ each represents a methine group; $R^{21}$, $R^{22}$, $R^{31}$ and $R^{32}$ each represents an alkyl or aryl group; $R^{23}$, $R^{24}$, $R^{25}$, $R^{26}$, $R^{33}$, $R^{34}$, $R^{35}$ and $R^{36}$ each represents a hydrogen atom or a substituent group; and r represents an integer selected from the group consisting of 0, 1 and 2, wherein $R^{23}$ and $R^{24}$, $R^{21}$ and $R^{23}$, $R^{21}$ and $R^{22}$, $R^{22}$ and $R^{25}$, $R^{25}$ and $R^{26}$, $R^{33}$ and $R^{34}$, $R^{31}$ and $R^{33}$, $R^{31}$ and $R^{32}$, $R^{32}$ and $R^{35}$, and $R^{35}$ and $R^{36}$ may optionally form a ring; and wherein at least one of the layers contains a basic metal compound which is slightly soluble in water;

(b) providing a processing material containing a decolorizing agent and having a processing layer containing a compound capable of performing a complex forming reaction with a metal ion resulting from said basic metal compound;

(c) placing the processing material together with the photosensitive layer thereon facing the processing layer;

(d) swelling the layers by adding water, wherein the amount of water ranges from the minimum amount required for maximum swelling, excluding layers that function only as backing, to 1/10 of said minimum; and (e) heating from 1 to 120 seconds to achieve a temperature ranging from 50 to 100° C. in the photosensitive layer and processing layer, wherein said dye has a dissociative proton or a group having a dissociative proton, which is linked to said dye directly or via a divalent linking group.

6. The method of forming an image according to claim 1, wherein said decolorizing agent is alcohol or phenols ($R_{51}OH$), amines or anilines ($(R_{52})_3N$), hydroxylamines ($(R_{52})_2NOR_{52}$), sulfinic acids ($R_{51}SO_2H$) or salts thereof, sulfurous acid or salts thereof, thiosulfuric acid or salts thereof, carboxylic acids ($R_{51}CO_2H$) or salts thereof, hydrazines ($(R_{52})_2NN(R_{52})_2$), guanidines ($((R_{52})_2N)_2C{=}NH$), aminoguanidines ($(R_{52})_2NR_{52}N(R_{52}N)\ C{=}NH$), amidines, thiols ($R_{51}SH$), cyclic or chain active methylene compounds ($Z_{53}{-}CH_2{-}Z_{54}$), cyclic or chain methylene compounds ($Z_{53}CH\ (R_{51}){-}Z_{54}$) or $Z_{53}{-}CH(Z_{54}){-}Z_{55}$), where $Z_{55}$ is the same as $Z_{53}$ and where $Z_{53}$, $Z_{54}$, and $Z_{55}$ (or $R_{51}$) may join with each other to form a ring, and anionic species derived from these compounds; and $R_{51}$ represents an alkyl group, an alkenyl group, a cycloalkyl group, an aryl group or a heterocyclic group, while $R_{52}$ represents a hydrogen atom or the same group as $R_{51}$, each of $R_{51}$ and $R_{52}$ may have a substituent group, if a plurality of $R_{51}$ or $R_{52}$ are presents in the molecule, they may be the same or different, $Z_{53}$ and $Z_{54}$ are each selected from the group consisting of $-CN$, $-SO_2R_{51}$, $-COR_{51}$, $-COOR_{51}$, $-CON\ (R_{52})_2$, $-SO_2N\ (R_{52})_2$, $-C({=}C(CN)_2)R^{51}$ and $-C({=}C(CN)_2)N\ (R_{51})_2$ wherein $Z_{53}$ may be the same as or different from $Z_{54}$, and $Z_{53}$ and $Z_{54}$ may join together to form a ring.

7. The method of forming an image according to claim 5, wherein said decolorizing agent is alcohol, phenols ($R_{51}OH$), amines, anilines ($(R_{52})_3N$), hydroxylamines ($(R_{52})_2NOR_{52}$), sulfinic acids ($R_{51}SO_2H$) or salts thereof, sulfurous acid or salts thereof, thiosulfuric acid or salts thereof, carboxylic acids ($R_{51}CO_2H$) or salts thereof, hydrazines ($(R_{52})_2NN(R_{52})_2$), guanidines ($(((R_{52})_2N)_2C{=}NH$), aminoguanidines ($(R_{52})_2NR_{52}N(R_{52}N)C{=}NH$), amidines, thiols ($R_{51}SH$), cyclic or chain active methylene compounds ($Z_{53}{-}CH_2{-}Z_{54}$), cyclic or chain methylene compounds ($Z_{53}CH(R_{51}){-}Z_{54}$) or $Z_{53}{-}CH(Z_{54}){=}Z_{55}$), wherein $Z_{55}$ is the same as $Z_{53}$ and where $Z_{53}$, $Z_{54}$, and $Z_{55}$ (or $R_{51}$) may join with each other to form a ring, and anionic species derived from these compounds; and $R_{51}$ represents an alkyl group, an alkenyl group, a cycloalkyl group, an aryl group or a heterocyclic group, while $R_{52}$ represents a hydrogen atom or the same group as $R_{51}$, each of $R_{51}$ and $R_{52}$ may have a substituent group; if a plurality of $R_{51}$ or $R_{52}$ are present in the molecule, they may be the same or different; $Z_{53}$ and $Z_{54}$ are each selected from the group consisting of $-CN$, $-SO_2R_{51}$, $-COR_{51}$, $-COOR_{51}$, $-CON(R_{52})_2$, $-SO_2N(R_{52})_2$, $-C({=}C(CN)_2)R_{51}$ and $-C({=}(CN)_2)N\ (R_{51})_2$ wherein $Z_{53}$ may be the same as or different from $Z_{54}$, and $Z_{53}$ and $Z_{54}$ may optionally join together to form a ring.

* * * * *